US009657539B2

(12) United States Patent
Gupta et al.

(10) Patent No.: US 9,657,539 B2
(45) Date of Patent: May 23, 2017

(54) AUTOMATED ROUGHNECK

(71) Applicant: NABORS CORPORATE SERVICES, Houston, TX (US)

(72) Inventors: Ashish Gupta, Houston, TX (US); Vladimir Scekic, New Westminster (CA); Padira Reddy, Richmond, TX (US); Brian Ellis, Spring, TX (US); Faisal Yousef, Houston, TX (US); Chris Magnuson, Houston, TX (US); Larry Heighington, Houston, TX (US)

(73) Assignee: NABORS CORPORATION SERVICES, Houston, TX (US)

( * ) Notice: Subject to any disclaimer, the term of this patent is extended or adjusted under 35 U.S.C. 154(b) by 262 days.

(21) Appl. No.: 14/503,600

(22) Filed: Oct. 1, 2014

(65) Prior Publication Data

US 2015/0101826 A1 Apr. 16, 2015

Related U.S. Application Data

(60) Provisional application No. 61/885,381, filed on Oct. 1, 2013.

(51) Int. Cl.
*E21B 19/16* (2006.01)

(52) U.S. Cl.
CPC ..... *E21B 19/164* (2013.01)

(58) Field of Classification Search
USPC ..... 166/377, 66, 77.51
See application file for complete search history.

(56) References Cited

U.S. PATENT DOCUMENTS

| | | | |
|---|---|---|---|
| 2006/0196316 | A1 | 9/2006 | Slettedal et al. |
| 2007/0074606 | A1 | 4/2007 | Halse |
| 2008/0257116 | A1 | 10/2008 | Vatne |
| 2009/0235786 | A1 | 9/2009 | Stensland |
| 2011/0030512 | A1 | 2/2011 | Begnaud, Jr. |
| 2011/0067529 | A1 | 3/2011 | Pietras et al. |

OTHER PUBLICATIONS

International Search Report and Written Opinion issued in International Application No. PCT/US2014/058533, dated Jan. 5, 2014 (14 pages).
International Search Report and Written Opinion issued in International Application No. PCT/US2014/058533, dated Jan. 20, 2014 (14 pages).

*Primary Examiner* — Taras P Bemko
(74) *Attorney, Agent, or Firm* — Adolph Locklar

(57) ABSTRACT

An automated roughneck may include a backup tong and a makeup tong. The makeup tong and backup tong may be selectively movable relative to one another. The makeup tong and backup tong may include spinner and gripper assemblies respectively adapted to make up and break out threaded connections. The automated roughneck may be configurable to be removable from the drill string in a lateral direction.

58 Claims, 31 Drawing Sheets

AUTOMATED ROUGHNECK

CROSS-REFERENCE TO RELATED APPLICATIONS

This application is a nonprovisional application which claims priority from U.S. provisional application No. 61/885,381, filed Oct. 1, 2013.

TECHNICAL FIELD/FIELD OF THE DISCLOSURE

The present disclosure relates generally to making-up and breaking out threadedly connected tubular members, and more particularly to an automated device and associated methods for making up and breaking out tool strings.

BACKGROUND OF THE DISCLOSURE

In many stages of the drilling and completion of an oil and gas well, tubular members are coupled end-to-end to form what is known as a string. For the purposes of this disclosure, the term "drill string" will be used to refer to any such string, including without limitation drill strings, tool strings, casing strings, and completion strings. Typically, tubular members are made up in approximately 30-90 foot segments known as pipe stands, and include threaded couplings at each end. Commonly known as "box" and "pin" connections for the female and male portions, respectively, the threaded connections serve to both form a fluid seal between the tubular segments and to resiliently couple the adjacent tubulars.

When "making up" a drill string, multiple rotations of one of the tubulars are required to fully engage the threads of the box with the threads of the pin. Generally, these rotations are accomplished by use of a pipe spinner, a high speed, low torque device to quickly thread the tubular members together. After the tubulars have been connected with the low torque pipe spinner, mechanical tongs or iron roughnecks are typically used to apply high-torque to the joint to ensure a complete and durable connection by ensuring both shoulders of the box and pin fully engage. Similarly, when "breaking out" a drill string, mechanical tongs or iron roughnecks are used to provide the high torque required to initially separate the tubular segments, and a pipe spinner is used to quickly unthread the tubulars the rest of the way.

The amount of torque required to securely tighten the tubulars, known as make up torque, may ensure the threaded connections do not separate while downhole. Such an unintended disconnection may result in costly and time-consuming "fishing" operations to retrieve the disconnected section of drill pipe, during which drilling operations must be suspended. Additionally, if excess make up torque is applied, material yielding in the threaded connections may cause damage to the tubulars which may also result in, for example, unintended disconnection downhole.

SUMMARY

The present disclosure provides for an automated roughneck. The automated roughneck may be used for connecting and disconnecting threadedly coupled tubular members of a tubular string. The automated roughneck may include a backup tong. The backup tong may have a central opening adapted to receive the tubular string. The backup tong may include a backup tong housing. The backup tong housing may include a backup tong housing door removably coupled to the backup tong housing. The backup tong housing door may be adapted to allow the backup tong to be radially installed or removed from the tubular string. The backup tong may also include a gripper assembly. The gripper assembly may be coupled to the backup tong housing. The gripper assembly may include a plurality of gripper jaws adapted to extend radially inwardly into the central opening and engage the outer surface of a first tubular member and prevent the rotation of the first tubular member. The gripper assembly may be to be selectively separable into at least two gripper subunits. The automated roughneck may further include a makeup tong. The makeup tong may be positioned generally parallel with the backup tong. The makeup tong may have a central opening generally collinear with the central opening of the backup tong. The makeup tong may be coupled to and movable relative to the backup tong. The makeup tong may include a makeup tong housing. The makeup tong housing may include a makeup tong housing door removably coupled to the makeup tong housing adapted to allow the makeup tong to be radially installed or removed from the tubular string. The makeup tong may further include a spinner assembly. The spinner assembly may be coupled to the makeup tong housing. The spinner assembly may include a plurality of spinner jaws adapted to extend radially inwardly into the central opening and engage an outer surface of a second tubular member. The spinner assembly may be adapted to be rotatable relative to the makeup tong housing to rotate the second tubular member. The spinner assembly may be adapted to be selectively separable into at least two spinner subunits. The makeup tong may further include a drive assembly. The drive assembly may be generally annular in shape and adapted to house the spinner assembly in an interior thereof. The drive assembly may be adapted to be rotated by one or more spinner motors coupled to the makeup tong housing. The drive assembly may be coupled to the spinner assembly and adapted to rotate the spinner assembly relative to the makeup tong housing. The drive assembly may include a removable segment rotatably positionable in alignment with the makeup tong housing door of the makeup tong housing to allow the drive assembly to be radially removable from the tubular string.

The present disclosure also provides for a method for removing an automated roughneck from a drill string while the drill string remains in place. The method may include providing an automated roughneck. The automated roughneck may include a backup tong. The backup tong may have a central opening adapted to receive the tubular string. The backup tong may include a backup tong housing. The backup tong housing may include a backup tong housing door removably coupled to the backup tong housing. The backup tong housing door may be adapted to allow the backup tong to be radially installed or removed from the tubular string. The backup tong may also include a gripper assembly. The gripper assembly may be coupled to the backup tong housing. The gripper assembly may include a plurality of gripper jaws adapted to extend radially inwardly into the central opening and engage the outer surface of a first tubular member and prevent the rotation of the first tubular member. The gripper assembly may be to be selectively separable into at least two gripper subunits. The automated roughneck may also include a makeup tong. The makeup tong may be positioned generally parallel with the backup tong. The makeup tong may have a central opening generally collinear with the central opening of the backup tong. The makeup tong may be coupled to and movable relative to the backup tong. The makeup tong may include a makeup tong housing. The makeup tong housing may include a makeup tong housing door removably coupled to the makeup tong housing adapted to allow the makeup tong to be radially installed or removed from the tubular string. The makeup tong may further include a spinner assembly. The spinner assembly may be to the makeup tong housing. The spinner assembly may include a plurality of spinner jaws adapted to extend radially inwardly into the central opening and engage an outer surface of a second tubular member. The spinner assembly may be adapted to be rotatable relative to the makeup tong housing to rotate the second tubular member. The spinner assembly may be adapted to be selectively separable into at least two spinner subunits. The makeup tong may further include a drive assembly. The drive assembly may be generally annular in shape and adapted to house the spinner assembly in an interior thereof. The drive assembly may be adapted to be rotated by one or more spinner motors coupled to the makeup tong housing. The drive assembly may be coupled to the spinner assembly and adapted to rotate the spinner assembly relative to the makeup tong housing. The drive assembly may include a removable segment rotatably positionable in alignment with the makeup tong housing door of the makeup tong housing to allow the drive assembly to be radially removable from the tubular string. The method may also include positioning the drill string through the automated roughneck. The method may also include removing the spinner assembly from the makeup tong. The method may also include separating the spinner assembly into two or more spinner subunits. The method may also include aligning the removable segment of the drive assembly with the makeup tong housing door. The method may also include removing the removable segment of the drive assembly. The method may also include removing the makeup tong housing door. The method may also include removing the gripper assembly from the backup tong. The method may also include separating the gripper assembly into two or more gripper subunits. The method may also include removing the backup tong removable door. The method may also include displacing the automated roughneck laterally such that the drill string passes through the radial opening formed in the drive assembly, makeup tong housing, and backup tong housing.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
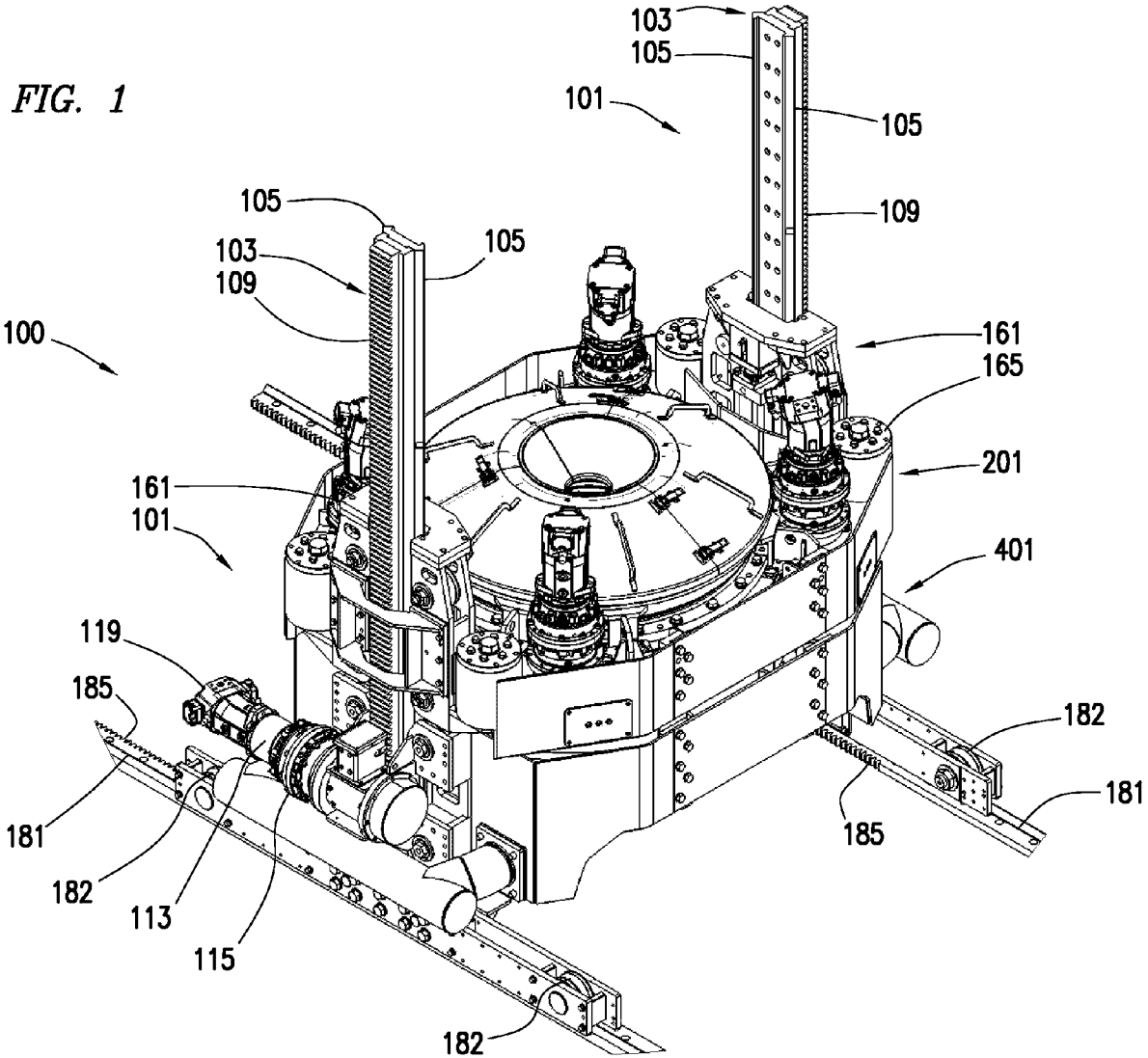
FIG. 1 depicts a perspective view of an automated roughneck consistent with embodiments of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

In some embodiments of the present disclosure as depicted in FIGS. 1-5, automated roughneck 100 may include frame 101, makeup tong 201, and backup tong 401. In some embodiments, frame 101 may include one or more uprights 103. Uprights 103 may be adapted to, for example and without limitation, connect makeup tong 201 with backup tong 401. In some embodiments, for example and without limitation, uprights 103 may include one or more rails 105 adapted to allow casters 107 coupled to one or more of makeup tong 201 and backup tong 401 to slide therealong. In some such embodiments, rails 105 may be adapted to allow casters 107 to restrict movement of makeup tong 201 and/or backup tong 401 to only a generally vertical direction, thus preventing both horizontal movement and rotation relative to each other and to frame 101.

Figure 3:
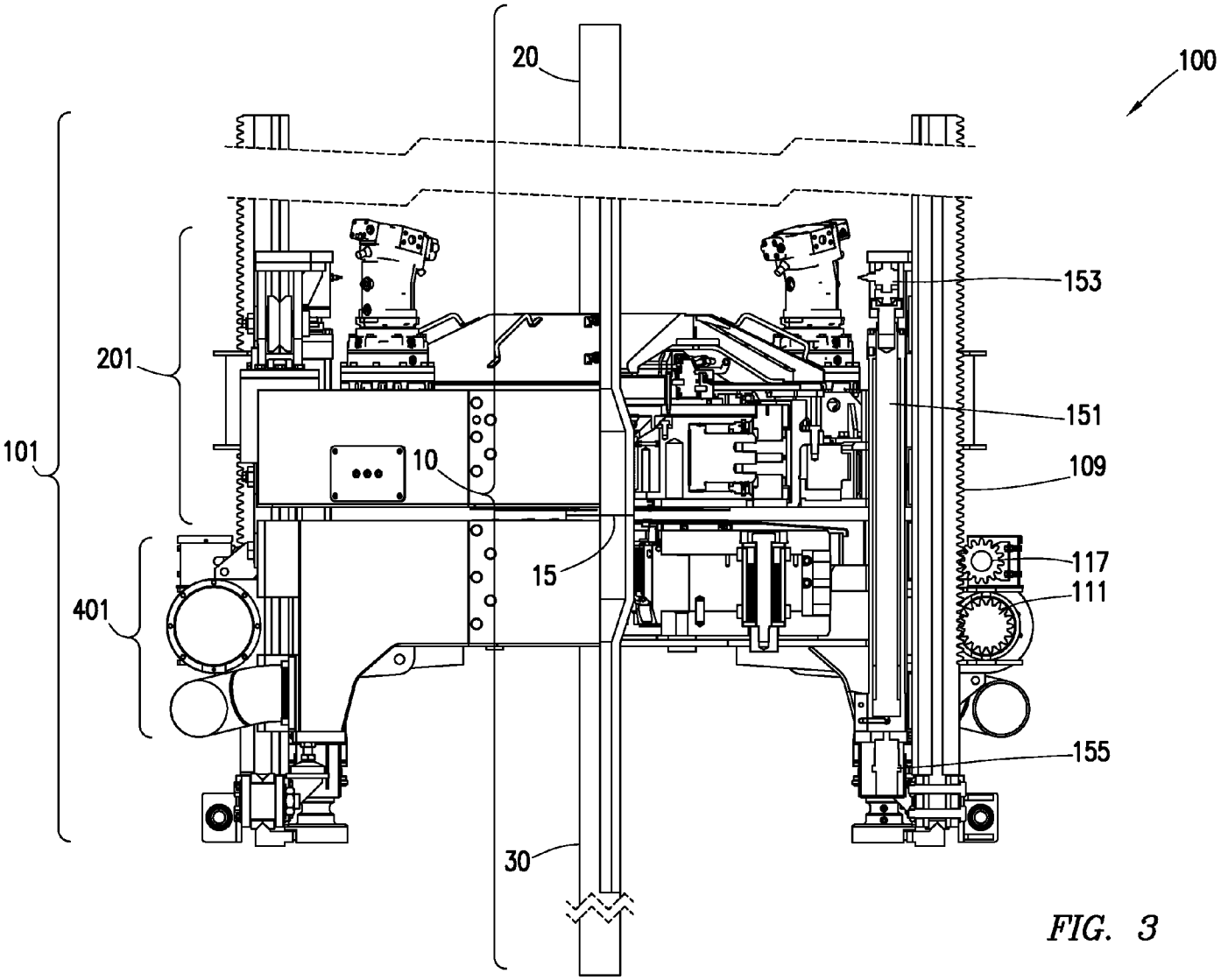
FIG. 3 depicts a partial cross-section of the automated roughneck of FIG. 1.

In some embodiments, frame 101 may be coupled directly to makeup tong 201. In some embodiments, frame 101 may be coupled to makeup tong 201 and/or backup tong 401 by a linear actuator to allow makeup tong 201 and backup tong 401 to selectively move vertically relative to frame 101. For the purposes of this disclosure, a linear actuator is intended to include any device adapted to cause relative motion between two objects in a generally straight line. For example and without limitation, at least one upright 103 may include rack 109. Rack 109 may be adapted to interface with one or more pinions 111 adapted to be turned by lift motors 113 coupled to makeup tong 201 and/or backup tong 401 as depicted in FIG. 3. Although depicted herein as only coupled to backup tong 401, one having ordinary skill in the art with the benefit of this disclosure will understand that lift motors 113 may be included coupled to both makeup tong 201 and backup tong 401. In some embodiments, lift motors 113 may couple to pinions 111 through gearbox 115. In some embodiments, one or more lubrication pinions 117 may be positioned to, for example, apply a lubricant such as grease to rack 109. In some embodiments, lift motors 113 may be coupled to lift brake 119 to, for example and without limitation, allow makeup tong 201 and/or backup tong 401 to be held in position relative to frame 101 by preventing rotation of pinions 111. Although discussed as using a rack and pinion, one having ordinary skill in the art with the benefit of this disclosure will understand that the linear actuator may be any other linear actuator capable of lifting makeup tong 201, backup tong 401, and any connected drill string 10 (as discussed below), including, for example and without limitation, hydraulic pistons, screw drives, screw jacks, etc.

Figure 2:
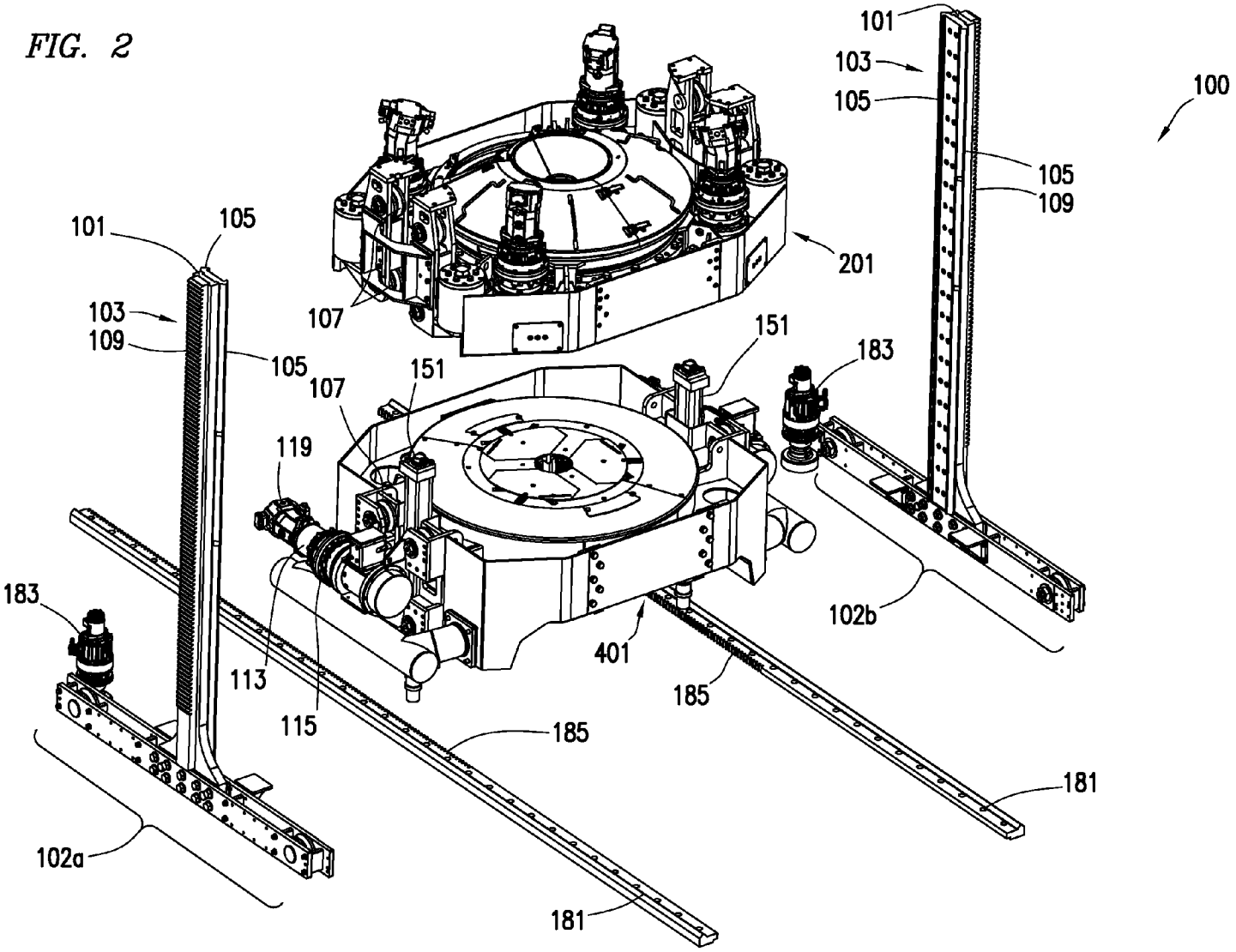
FIG. 2 depicts a disassembled view of the automated roughneck of FIG. 1.

As depicted in FIG. 2, in some embodiments, frame 101 may be formed of multiple subunits 102*a*, 102*b*. One having ordinary skill in the art with the benefit of this disclosure will understand that frame 101 may be formed as a single unit or as multiple subunits.

Figure 4:
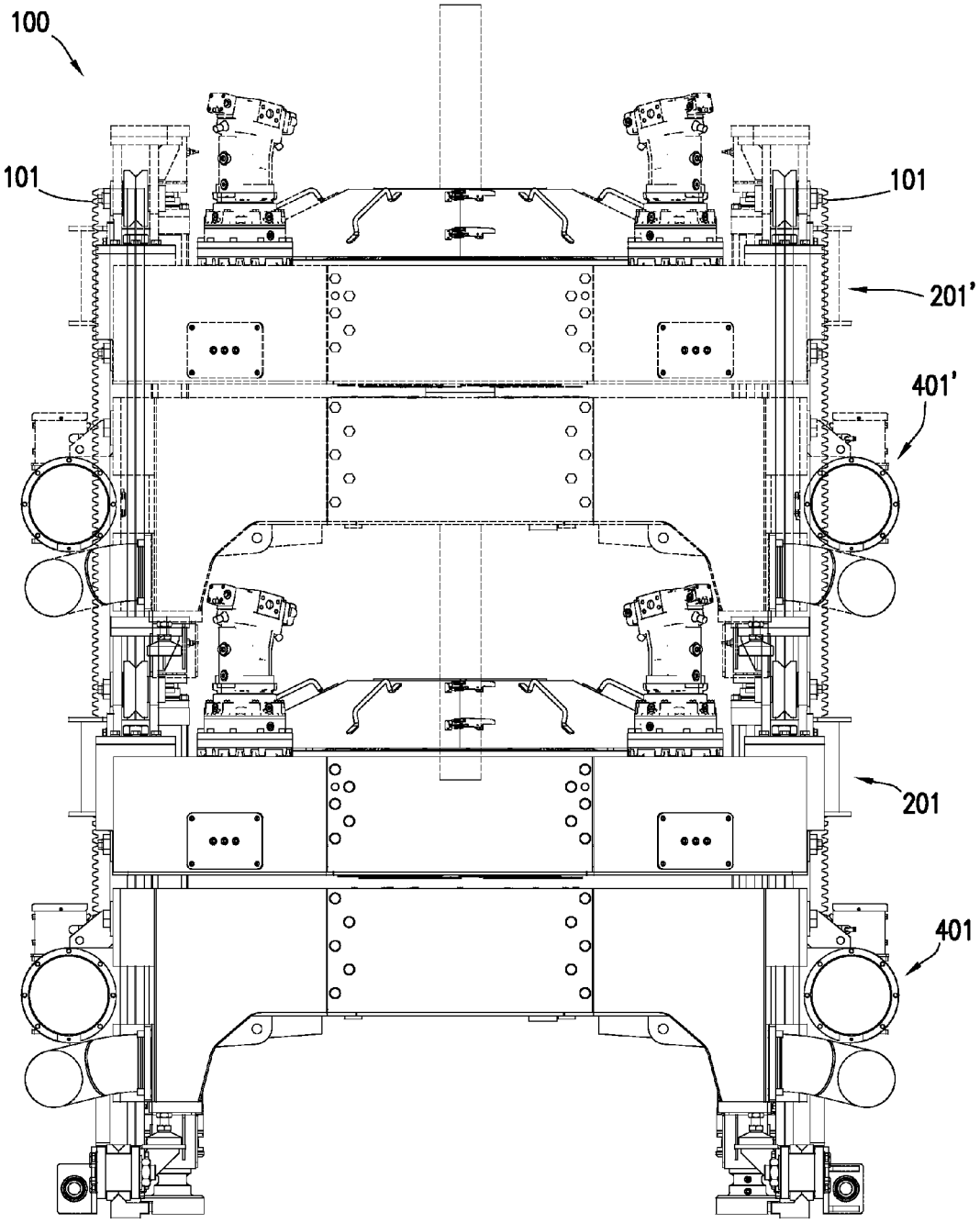
FIG. 4 depicts a front elevation view of the automated roughneck of FIG. 1.
Figure 5:
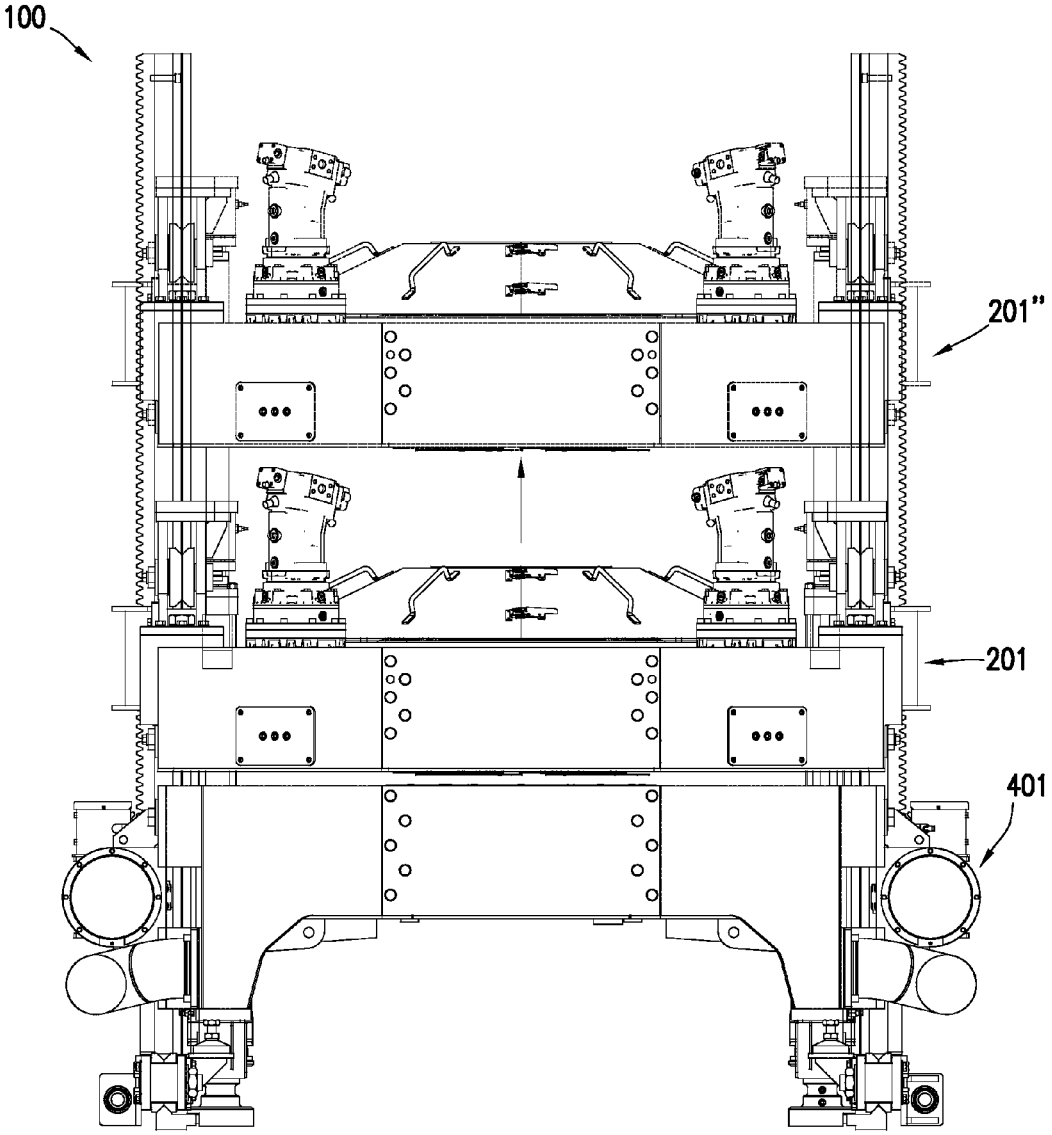
FIG. 5 depicts a front elevation view of the automated roughneck of FIG. 1.

As depicted in FIGS. 3-5, makeup tong 201 and backup tong 401 may each include a central aperture adapted to allow drill string 10 to pass therethrough. In some embodiments, makeup tong 201 and backup tong 401 may be adapted to grip drill string 10 on either side of tool joint 15. As understood in the art, tool joint 15 may be a threaded connection between upper tubular segment 20 and lower tubular segment 30. As understood in the art, lower tubular segment 30 may be a drill string extending into a wellbore (not shown). In some embodiments, upper tubular segment 20 may be a pipe stand to be added during a make up operation such as a tripping-in operation or adding an additional pipe stand during a drilling operation. In some embodiments, upper tubular segment 20 may be the uppermost pipe stand of drill string 10 to be removed from lower tubular segment 30 during a break out operation such as a tripping-out operation.

In some embodiments, as depicted in FIG. 3, makeup tong 201 may be adapted to grip upper tubular segment 20 generally at or near tool joint 15. Backup tong 401 may likewise be adapted to grip lower tubular segment 30 generally at or near tool joint 15. Makeup tong 201 may be adapted to rotate upper tubular segment 20 as backup tong 401 holds lower tubular segment 30 still, thus making up or breaking out tool joint 15 by threadedly coupling or decoupling upper tubular segment 20 from lower tubular segment 30.

As depicted in FIG. 4, makeup tong 201 and backup tong 401 may be moved vertically relative to frame 101. FIG. 4 depicts makeup tong 201 and backup tong 401 in a lowered position and makeup tong 201' and backup tong 401' in a raised position. In some embodiments, before a makeup or breakout operation, makeup tong 201 and backup tong 401 may be selectively vertically positioned such that tool joint 15 is substantially positioned such that upper tubular segment 20 and lower tubular segment 30 divide between makeup tong 201 and backup tong 401. In some embodiments, a positioning sensor (not shown) may be utilized to detect tool joint 15 and allow makeup tong 201 and backup tong 401 to be properly positioned by an operator or automatically.

In some embodiments, the positioning sensor may be positioned on an upper surface of makeup tong 201. In some embodiments, the positioning sensor may scan drill string 10 to detect tool joint 15 as makeup tong 201 and backup tong 401 are moved vertically. One having ordinary skill in the art with the benefit of this disclosure will understand that the positioning sensor may instead be located at any other location on automated roughneck 100 or any other surrounding structure (not shown) without deviating from the scope of this disclosure. The positioning sensor may be any sensor capable of detecting the location of tool joint 15 in order to position makeup tong 201 and backup tong 401. In some embodiments, the positioning sensor may be, for example and without limitation, an optical sensor such as a camera, infrared range finder, or sound based sensor such as an ultrasonic sensor. One having ordinary skill in the art with the benefit of this disclosure will understand that multiple positioning sensors may be utilized without deviating from the scope of this disclosure.

In some embodiments, as depicted in FIG. 5, makeup tong 201 may be selectively vertically movable relative to backup tong 401. FIG. 5 depicts makeup tong 201 in a lowered position and makeup tong 201" in a raised position relative to backup tong 401. As understood in the art, as a threaded connection is made up or broken out, the threaded components move axially closer together or further apart as they are rotated. By moving makeup tong 201 relative to backup tong 401, the relative axial movement of upper tubular segment 20 and lower tubular segment 30 may be compensated for while maintaining constant grip on both sides of tool joint 15.

In some embodiments, makeup tong 201 may be coupled to frame 101 by a linear actuator as previously discussed. In other embodiments, as depicted in FIGS. 1-5, makeup tong 201 may be coupled to backup tong 401 by a linear actuator. As depicted in FIGS. 2 and 3, in some embodiments, the linear actuator may be one or more hydraulic cylinders 151. Hydraulic cylinders 151 may be adapted to, when extended, move makeup tong 201 away from backup tong 401. One having ordinary skill in the art with the benefit of this disclosure will understand that hydraulic cylinders 151 may be replaced by any linear actuator capable of moving makeup tong 201 relative to backup tong 401 without deviating from the scope of this disclosure, and may be, for example and without limitation, racks and pinions, screw drives, or screw jacks.

In some embodiments, the relative positioning between makeup tong 201 and backup tong 401 may be controlled by an operator. In some embodiments, the relative positioning between makeup tong 201 and backup tong 401 may be controlled automatically. In some embodiments, a controller adapted to control hydraulic cylinder 151 may utilize feedback from the positioning sensors to minimize loading between upper tubular segment 20 and lower tubular segment 30 during a make up or break out operation. In some embodiments, the controller may utilize known information about tool joint 15 to control hydraulic cylinder 151. For example, the controller may utilize thread data such as pitch and number of starts to calculate axial movement based on the number of rotations of upper tubular segment 20.

Figure 21:
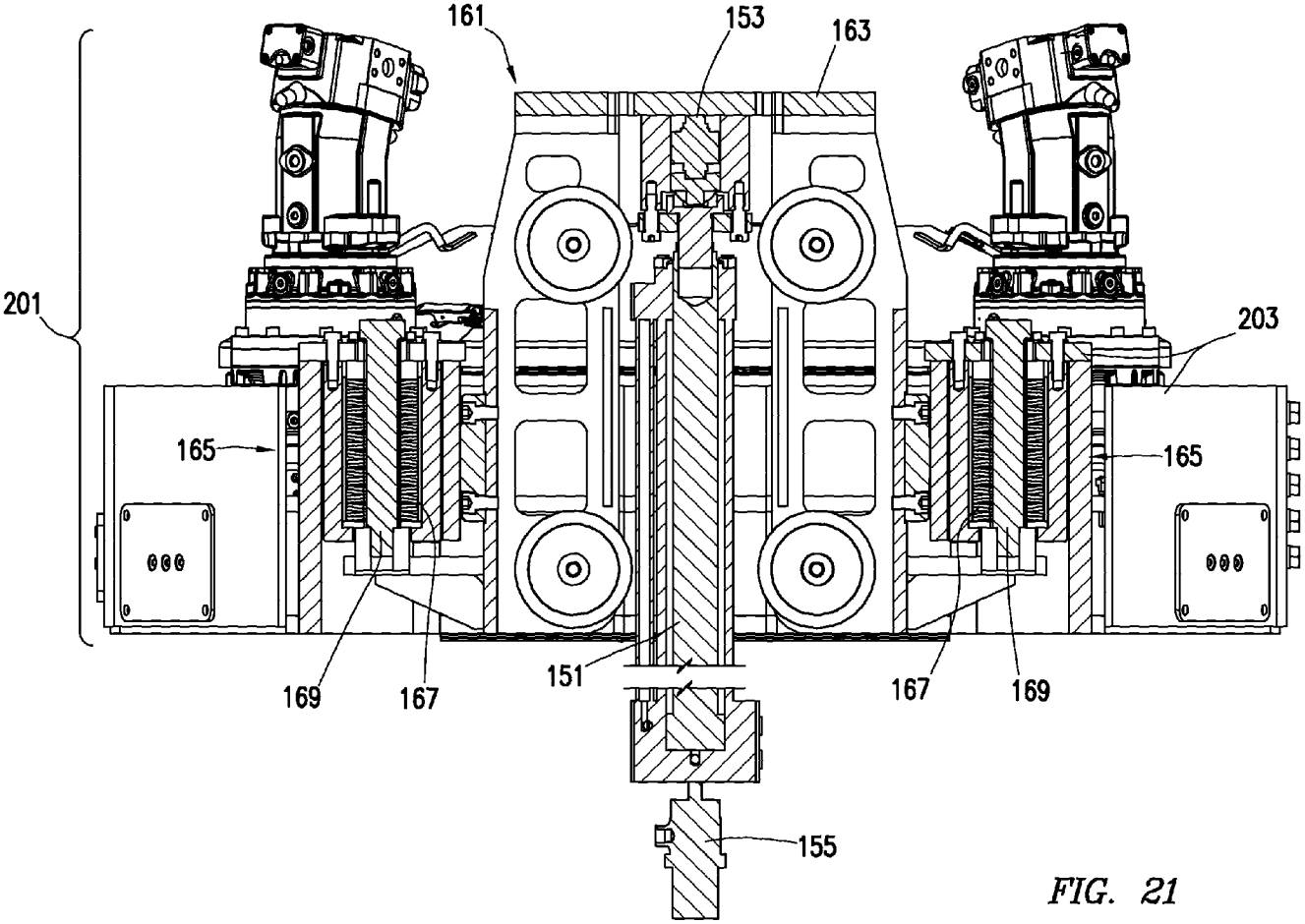
FIG. 21 depicts a partial cross section of a makeup tong consistent with embodiments of the present disclosure.

In some embodiments, one or more sensors may be positioned to detect loading between upper tubular segment 20 and lower tubular segment 30 while they are threadedly coupled or decoupled. For example, in some embodiments as depicted in FIGS. 3 and 21, one or more load cells 153 may be adapted to detect the force transfer between makeup tong 201 and backup tong 401. By detecting the force transfer between makeup tong 201 and backup tong 401, the amount of force exerted between upper tubular segment 20 and lower tubular segment 30 may be determined. In some embodiments, load cell 153 may be located between hydraulic cylinder 151 and makeup tong 201. One having ordinary skill in the art with the benefit of this disclosure will understand that load cell 153 may be positioned at any location suitable to detect the force transfer between makeup tong 201 and backup tong 401. In some embodiments, by moving makeup tong 201 relative to backup tong 401 to maintain the detected force transfer within a predetermined loading range, the amount of force exerted between upper tubular segment 20 and lower tubular segment 30 may be regulated to prevent, for example and without limitation, damage to the threads of tool joint 15.

In some embodiments, one or more pressure sensors (not shown) may be utilized to detect the hydraulic pressure in hydraulic cylinder 151. By detecting the hydraulic pressure in hydraulic cylinder 151, the force exerted between upper tubular segment 20 and lower tubular segment 30 may be determined. In some embodiments, by moving makeup tong 201 relative to backup tong 401 to maintain the detected pressure within a predetermined pressure range, the amount of force exerted between upper tubular segment 20 and lower tubular segment 30 may be regulated to prevent, for example and without limitation, damage to the threads of tool joint 15.

In some embodiments, one or more linear positioning sensors 155 may be included in automated roughneck 100 to detect the relative distance between makeup tong 201 and backup tong 401. By detecting the relative distance between makeup tong 201 and backup tong 401, linear positioning sensors 155 may allow more accurate control of the position of makeup tong 201 relative to backup tong 401 as makeup tong 201 is moved.

In some embodiments, the controller may use data collected from more than one sensor, including but not limited to load cells 153, pressure sensors, and linear positioning sensors 155, to automatically move makeup tong 201 relative to backup tong 401 during a make up or break out operation. In some embodiments, hydraulic cylinders 151 may be controlled by a servo-actuated valve (not depicted) to, for example and without limitation, maintain a constant pressure in hydraulic cylinders 151 and/or to allow for fine positioning control of makeup tong 201 relative to backup tong 401.

Figure 6:
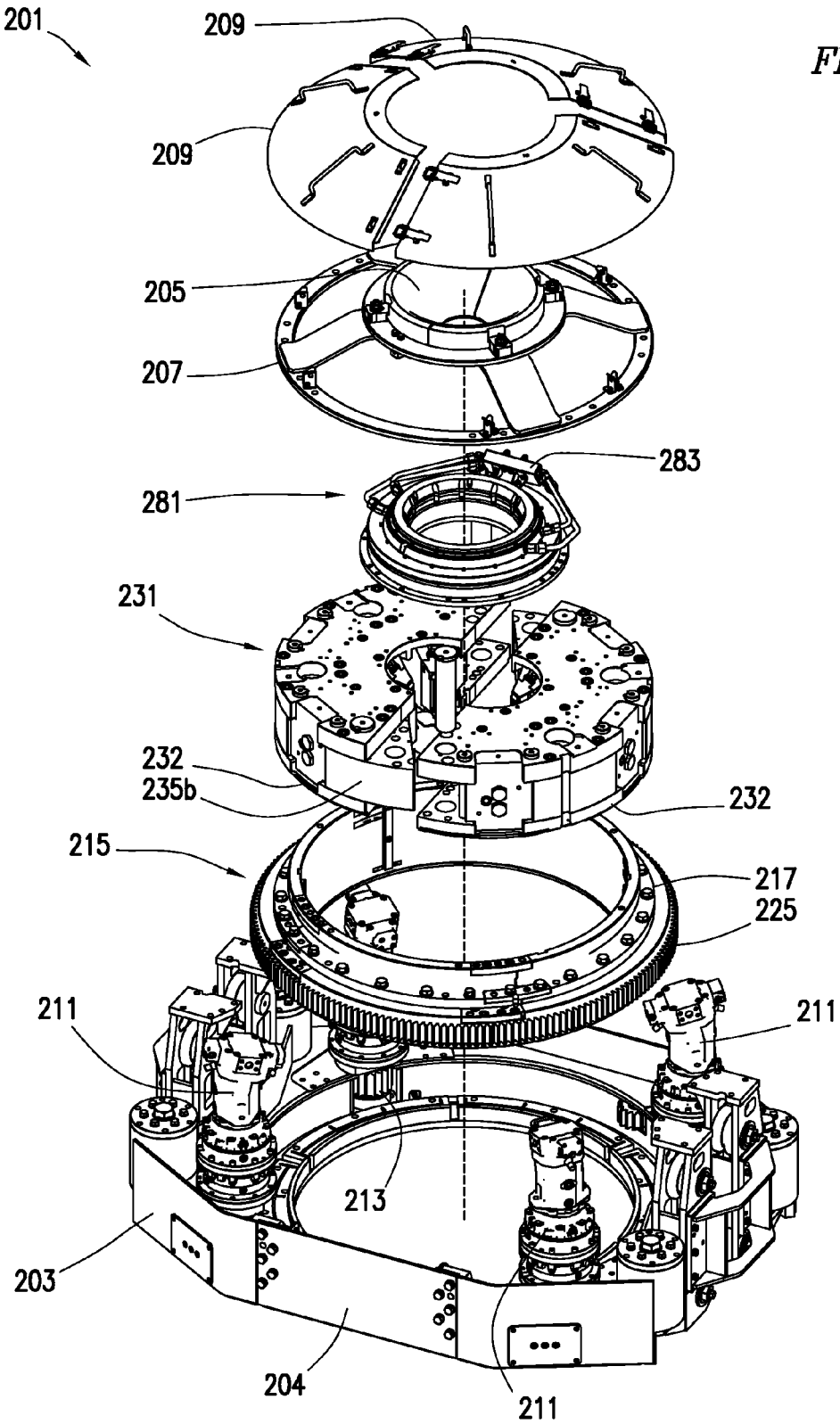
FIG. 6 depicts an exploded view of a makeup tong consistent with embodiments of the present disclosure.
Figure 7:
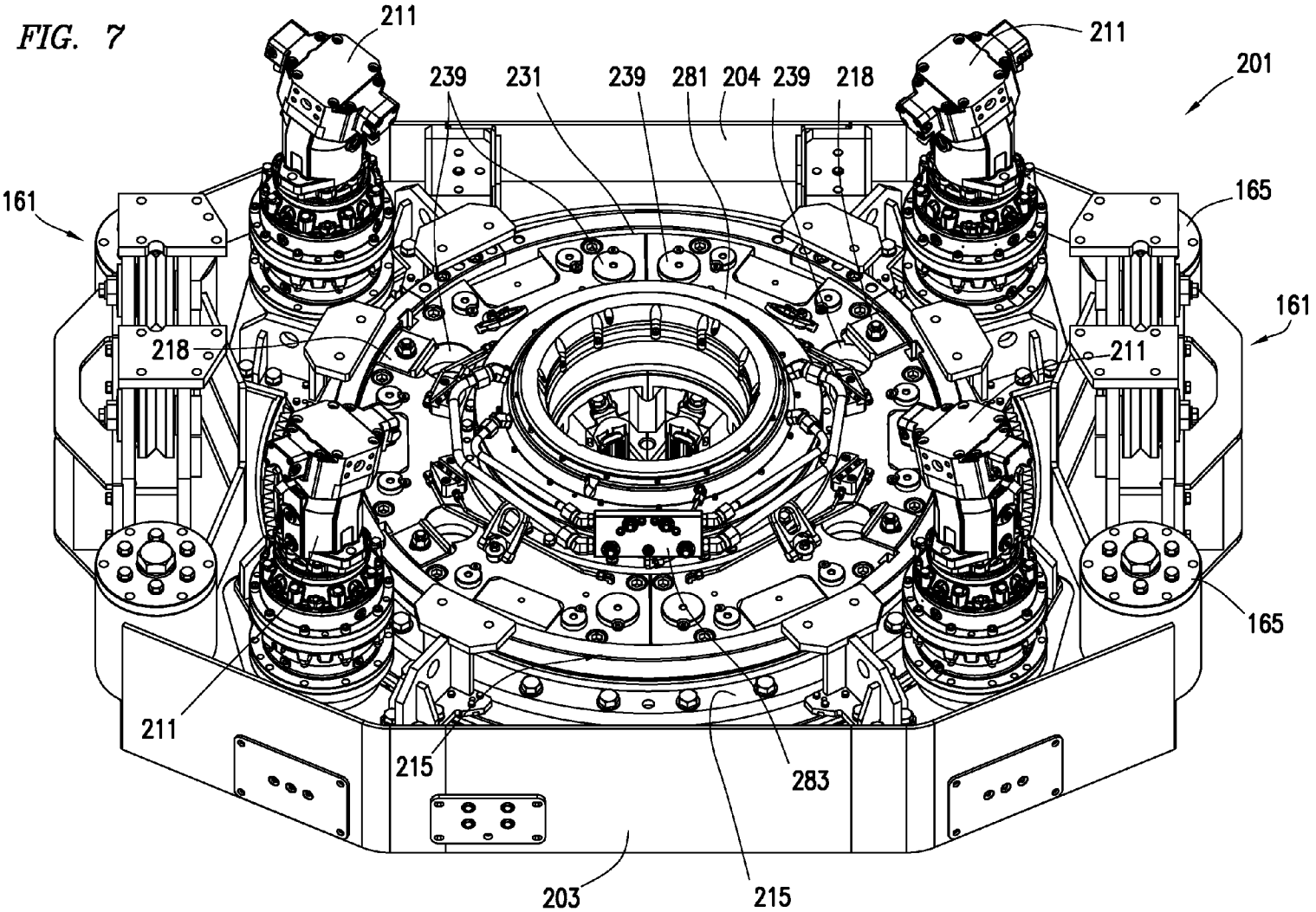
FIG. 7 depicts a perspective view of a makeup tong consistent with embodiments of the present disclosure.

With reference to FIGS. 6-7, in some embodiments, makeup tong 201 may include makeup tong housing 203, drive assembly 215, spinner assembly 231, and rotary seal 281. In some embodiments, as depicted in FIGS. 6, 7, 29 and 30, makeup tong housing 203 may include makeup tong housing door 204. Makeup tong housing door 204 may be adapted to be removable from makeup tong housing 203 in order to, for example and without limitation, create an access point to radially remove makeup tong housing 203 from drill string 10 as discussed below.

In some embodiments of the present disclosure, as depicted in FIGS. 1, 2, and 21, makeup tong housing 203 may be coupled to hydraulic cylinder 151 through trolley 161. Trolley 161 may, in some embodiments, house casters 107 adapted to interface with rails 105 to generally restrict movement of makeup tong 201 to a vertical direction relative to frame 101 as previously described. In some embodiments, as depicted in FIG. 21, the upper end of hydraulic cylinder 151 may interface with and transfer the lifting load onto trolley 161 at load plate 163. One having ordinary skill in the art with the benefit of this disclosure will understand that any method of coupling any linear actuator utilized to trolley 161 may be utilized.

In some embodiments, trolley 161 may be coupled directly between hydraulic cylinder 151 and makeup tong housing 203 of makeup tong 201. In some embodiments, trolley 161 may be coupled to makeup tong housing 203 of makeup tong 201 via one or more generally compliant joints. In some embodiments, for example and without limitation, trolley 161 may be coupled to makeup tong housing 203 by one or more suspension assemblies 165. Suspension assemblies 165 may, in some embodiments, include one or more springs 167 adapted to support the weight of makeup tong 201 and transfer that weight and any loading to trolley 161, thence on to hydraulic cylinder 151.

Suspension assemblies 165 may, as understood in the art, include a pin or bolt connection 169, adapted to allow both vertical relative displacement and, in some embodiments, a desired amount of horizontal or angular relative movement between makeup tong 201 and trolley 161 while preventing makeup tong 201 and trolley 161 from separating. In some embodiments, vertical, lateral, and/or angular displacement between makeup tong 201 and trolley 161 may, for example and without limitation, allow makeup tong 201 to dynamically compensate for any irregularity, bending, or damage to a tubular being rotated during a make up or break out operation, as will be discussed in further detail herein below.

In some embodiments, as depicted in FIG. 6, makeup tong 201 may further include funnel 205. Funnel 205 may be coupled to makeup tong housing 203 by upper support 207. Funnel 205 may be adapted to taper inward to, for example and without limitation, allow upper tubular segment 20 (not shown) to be more easily inserted into makeup tong 201 during a make up operation. In some embodiments, makeup tong 201 may further include one or more cover segments 209. Cover segments 209 may be positioned to, for example and without limitation, prevent materials or debris from entering makeup tong 201. Cover segments 209 may be coupled to makeup tong housing 203 by upper support 207. In some embodiments, cover segments 209 may be selectively removable to, for example and without limitation, allow access to the interior of makeup tong 201 from the top. In some embodiments, funnel 205 and upper support 207 may likewise be removable to allow access to the interior of makeup tong 201. In some embodiments, funnel 205, upper support 207, and cover segments 209 may each have a central aperture to allow drill string 10 to pass therethrough (as in FIG. 3). In some embodiments, funnel 205, upper support 207, and/or cover segments 209 may be segmented or separable into one or more components to allow their removal while drill string 10 is in place as will be discussed herein below.

Figure 20:
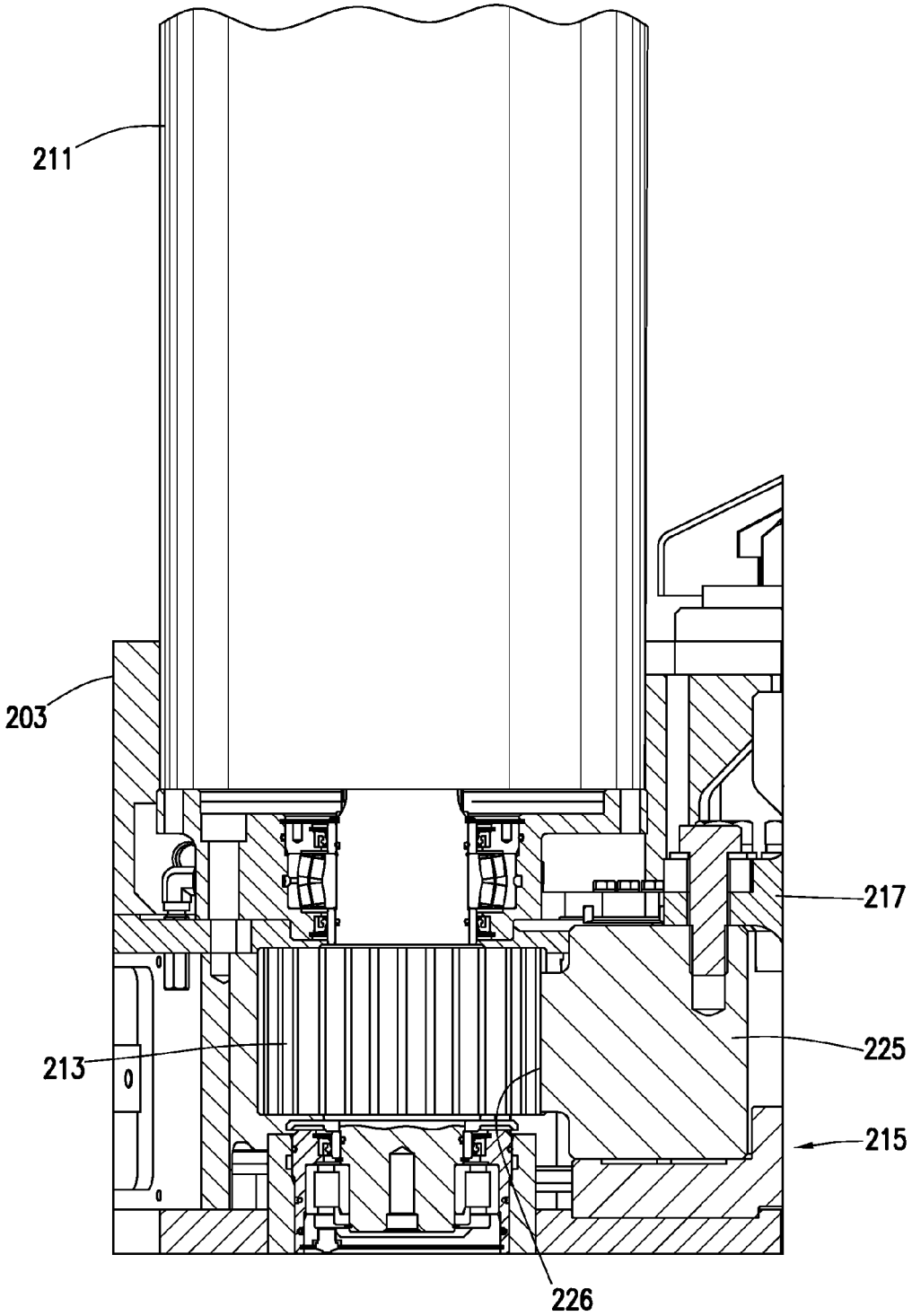
FIG. 20 depicts a partial cross section of a pinion motor and ring gear of a makeup tong consistent with embodiments of the present disclosure.

In some embodiments, as depicted in FIGS. 6, 7, and 20, makeup tong housing 203 may be coupled to and support one or more spinner motors 211. Spinner motors 211 may be adapted to, by rotating spinner pinions 213, rotate drive assembly 215 relative to makeup tong housing 203 as discussed herein below.

Figure 8:
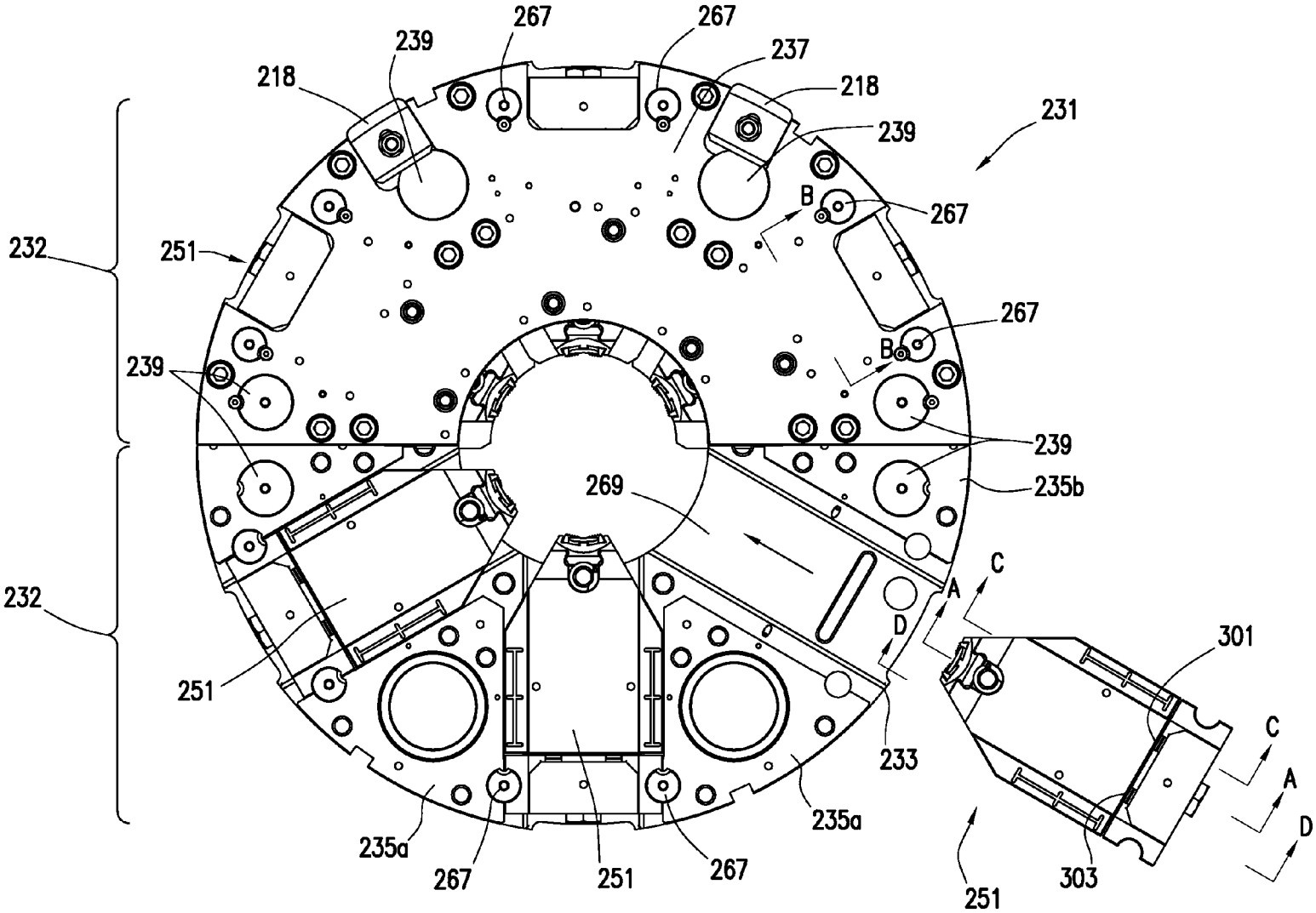
FIG. 8 depicts a top view of a makeup spinner assembly consistent with embodiments of the present disclosure.

In some embodiments, as depicted in FIGS. 6 and 8, spinner assembly 231 may be separable into two or more spinner subunits 232. By allowing spinner assembly 231 to be separable into two or more spinner subunits 232, spinner assembly 231 may be removed from makeup tong 201 without removing drill string 10. Although described throughout this disclosure as being separable into two spinner subunits 232, one having ordinary skill in the art with the benefit of this disclosure will understand that any number of spinner subunits 232 as described herein may be utilized without deviating from the scope of this disclosure.

Figure 9:
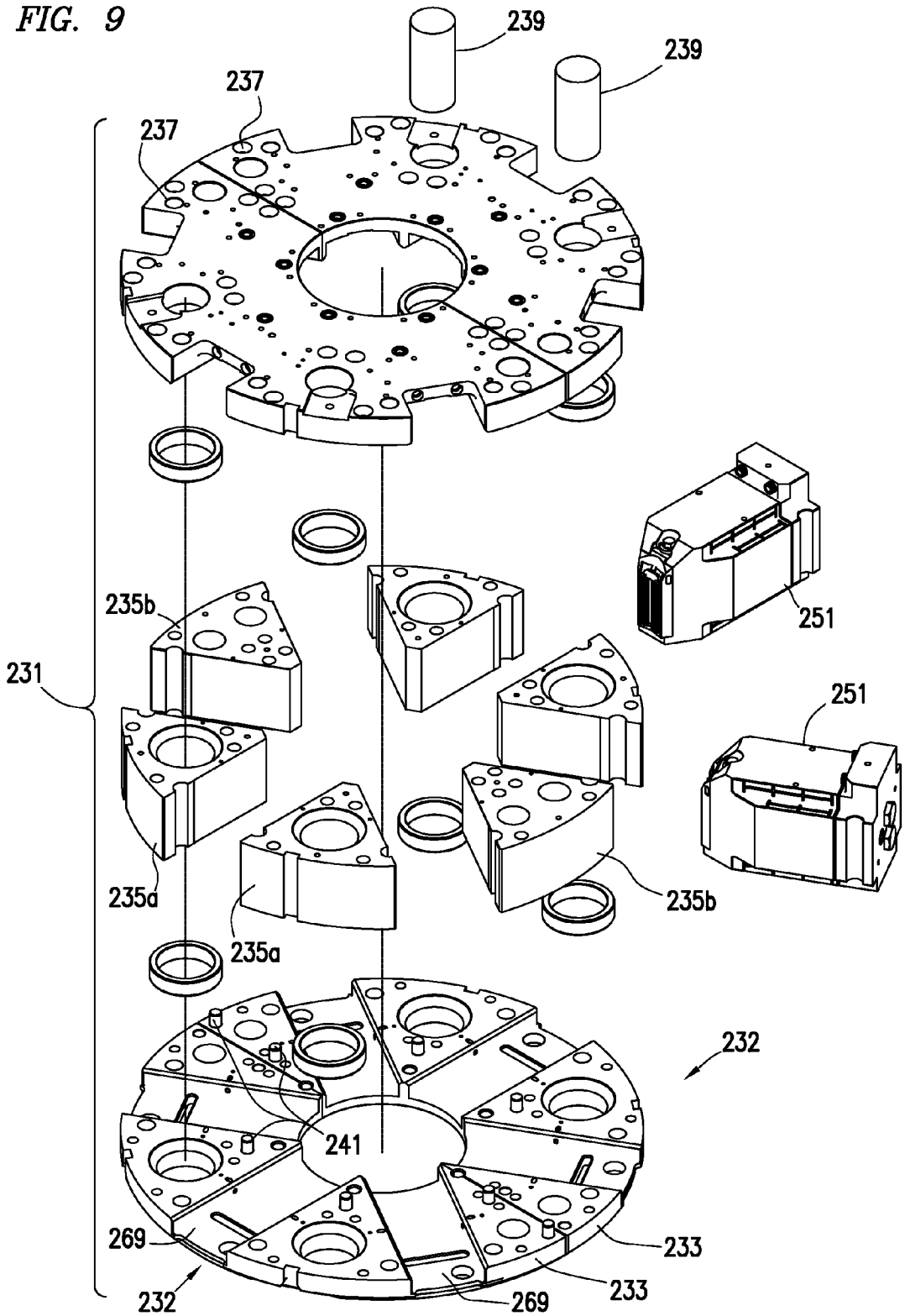
FIG. 9 depicts an exploded view of the makeup spinner assembly of FIG. 8.

As depicted in FIG. 9, in some embodiments, spinner assembly 231 may include lower spinner plates 233; body wedges 235*a*, bridge wedges 235*b*; upper spinner plates 237; and spinner jaws 251. In some embodiments, each spinner subunit 232 may be formed identically to each other spinner subunit 232. Note that in FIG. 9, lower spinner plates 233 and upper spinner plates 237 of each spinner subunit 232 are depicted adjacent to each other. Although depicted throughout this disclosure as having six wedges 235*a*, 235*b* and six spinner jaws 251, one having ordinary skill in the art with the benefit of this disclosure will understand that any number of wedges 235*a*, 235*b* and spinner jaws 251 may be utilized as described herein without deviating from the scope of this disclosure. As depicted in FIGS. 7, 8, 9, and 17, in some embodiments, spinner assembly 231 may be assembled and held together utilizing a plurality of wedge pins 239. However, one having ordinary skill in the art with the benefit of this disclosure will understand that although discussed as utilizing wedge pins 239, other fasteners may be utilized without deviating from the scope of this disclosure, including, for example and without limitation, bolts or other threaded fasteners.

Figure 17:
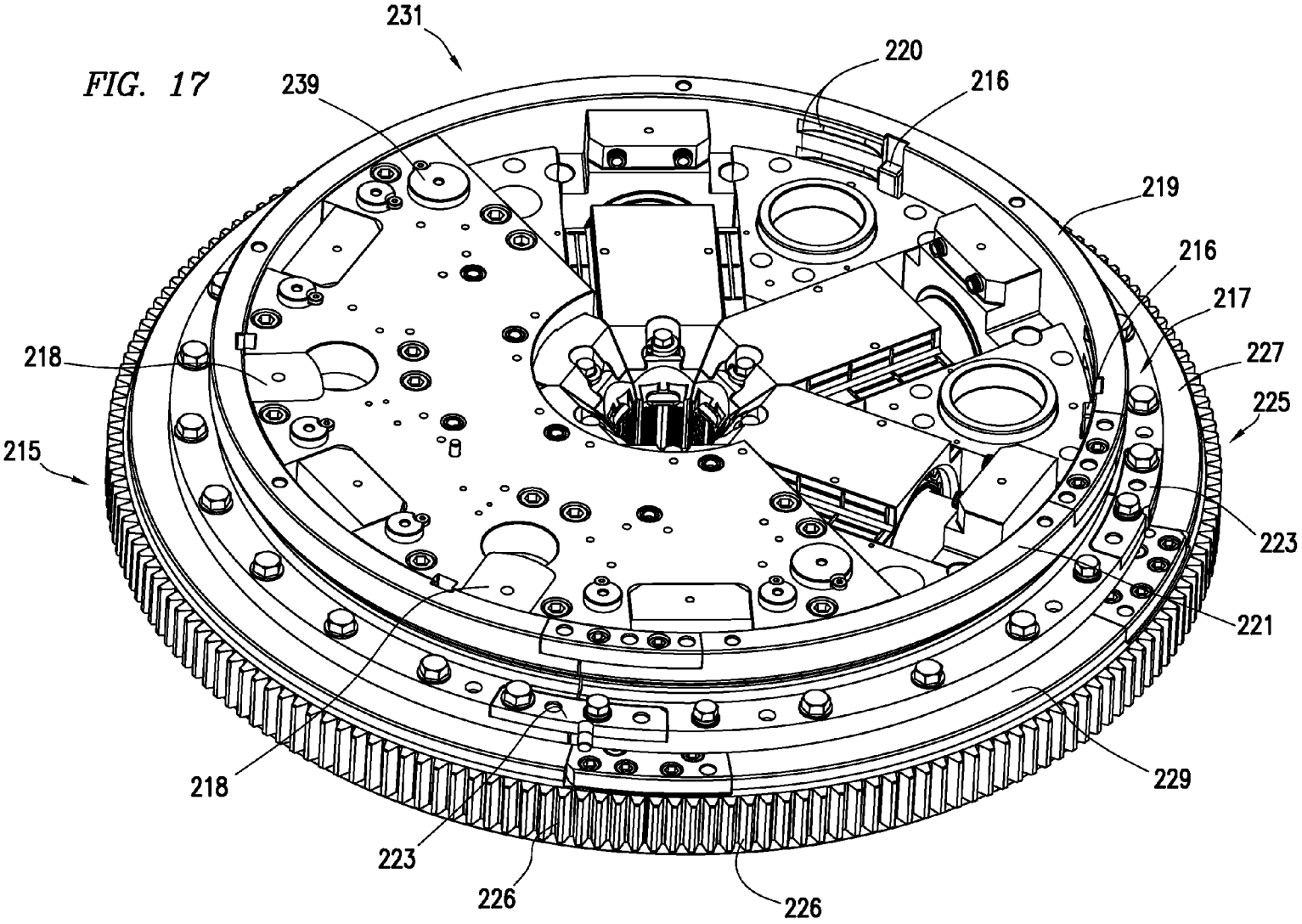
FIG. 17 depicts a makeup spinner assembly consistent with embodiments of the present disclosure.

In some embodiments, in order to assemble spinner assembly 231, body wedges 235*a* may be arranged atop lower spinner plates 233 corresponding with a single spinner subunit 232 as depicted in FIGS. 8, 9, and 17. Bridge wedges 235*b* may be positioned across the split between lower spinner plates 233 and may in some embodiments serve to couple spinner subunits 232. Upper spinner plates 237 may then be positioned atop body wedges 235*a* and bridge wedges 235*b*. In some embodiments, wedge pins 239 may be adapted to pass through pin holes formed through each of upper spinner plates 237, body wedges 235*a* and bridge wedges 235*b*, and lower spinner plates 233, the pin holes adapted to align when spinner assembly 231 is assembled. In some embodiments, body wedges 235*a* may include a single pin-hole adapted to receive a single wedge pin 239. In some embodiments, bridge wedges 235*b* may include two pin-holes such that bridge wedges 235*b* couple adjacent upper spinner plates 237 and lower spinner plates 233 when a wedge pin 239 is inserted through each pin hole of bridge wedges 235*b*.

In some embodiments, spinner assembly 231 may be assembled separately in spinner subunits 232, the spinner subunits 232 coupled after assembly to form spinner assembly 231. In some such embodiments, bridge wedge 235*b* may be positioned at the end of lower spinner plate 233 such that it is at least partially extending past the end of lower spinner plate 233. Upper spinner plate 237 may then be positioned atop the assembled body wedges 235*a* and bridge wedge 235*b*. Wedge pins 239 may then be inserted through the aligned pin holes, securing spinner subunit 232. Two (or more) spinner subunits 232 may then be aligned and slid together such that bridge wedges 235*b* enter into the open ends of the adjacent spinner subunit 232. Wedge pins 239 may then be inserted through the second pin holes through bridge wedges 235*b*, coupling the adjacent spinner subunits 232.

In some embodiments, lower spinner plates 233 and/or upper spinner plates 237 may include one or more anti-rotation pins 241 (shown in FIG. 9) adapted to insert into matching holes formed in body wedges 235*a* and bridge wedges 235*b*. Anti-rotation pins 241 may, for example and without limitation, prevent each body wedge 235*a* or bridge wedge 235*b* from rotating relative to the upper spinner plate 237 and lower spinner plate 233 to which it is pinned. In some embodiments, anti-rotation pins 241 for bridge wedges 235*b* may only be included for one lower spinner plate 233 and/or upper spinner plate 237 to, for example and without limitation, allow the spinner subunits 232 to be separated by the removal of the wedge pin 239 for each bridge wedge 235*b* corresponding to the spinner subunit 232 which does not include anti-rotation pins 241, allowing bridge wedges 235*b* to slide out from the adjacent spinner subunit 232 as the spinner subunits 232 are separated as depicted in FIG. 6.

Figure 12:
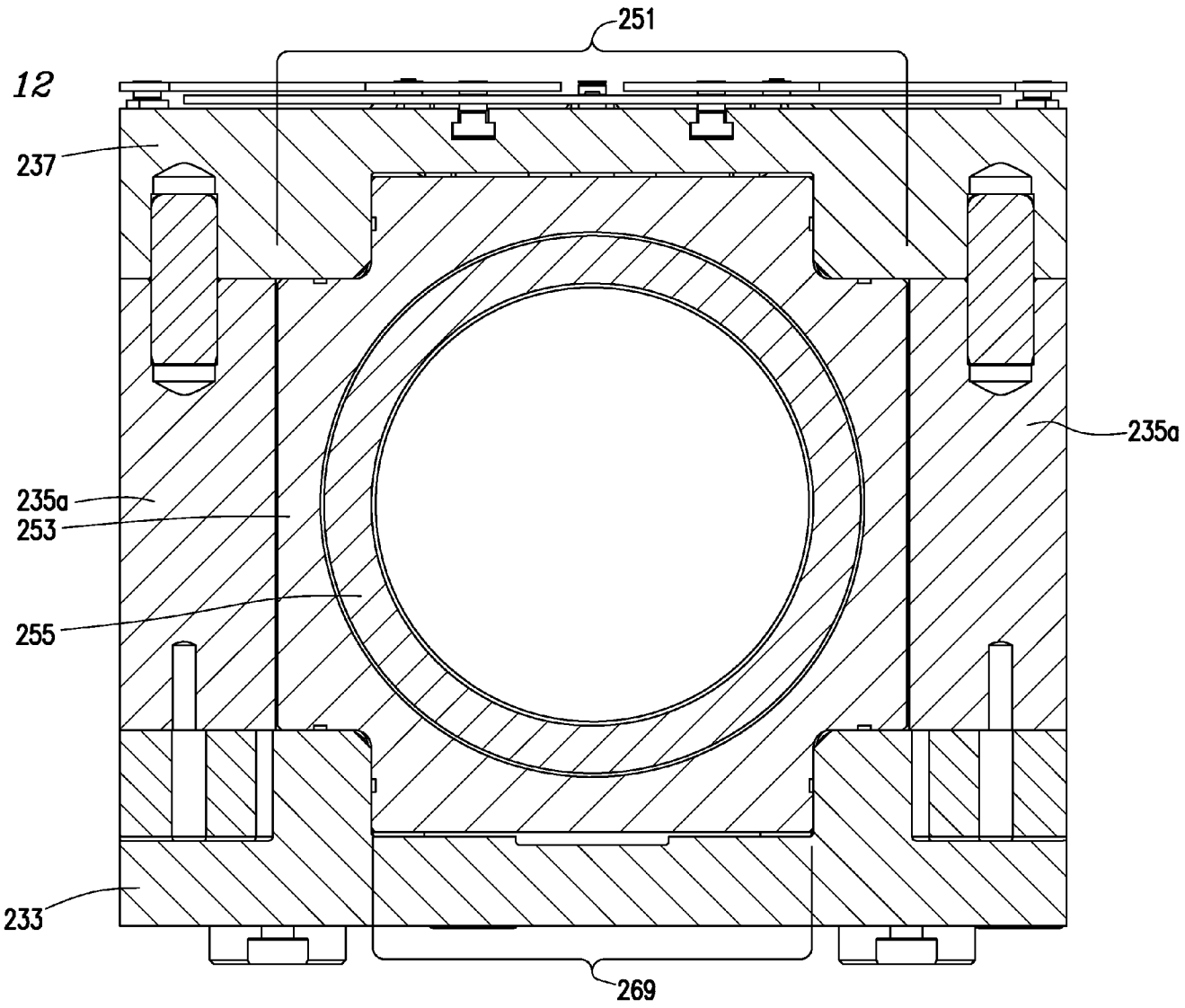
FIG. 12 depicts a cross section of the spinner jaw of FIG. 8 taken along line B-B.

In some embodiments, once spinner subunits 232 are assembled, whether joined to form spinner assembly 231 or separate, spinner jaws 251 may be installed. As depicted in FIGS. 8 and 12, each spinner jaw 251 may be installed by radially inserting spinner jaw 251 into the spaces formed between adjacent wedges 235*a* and/or 235*b*, and upper spinner plate 237 and lower spinner plate 233.

Figure 10:
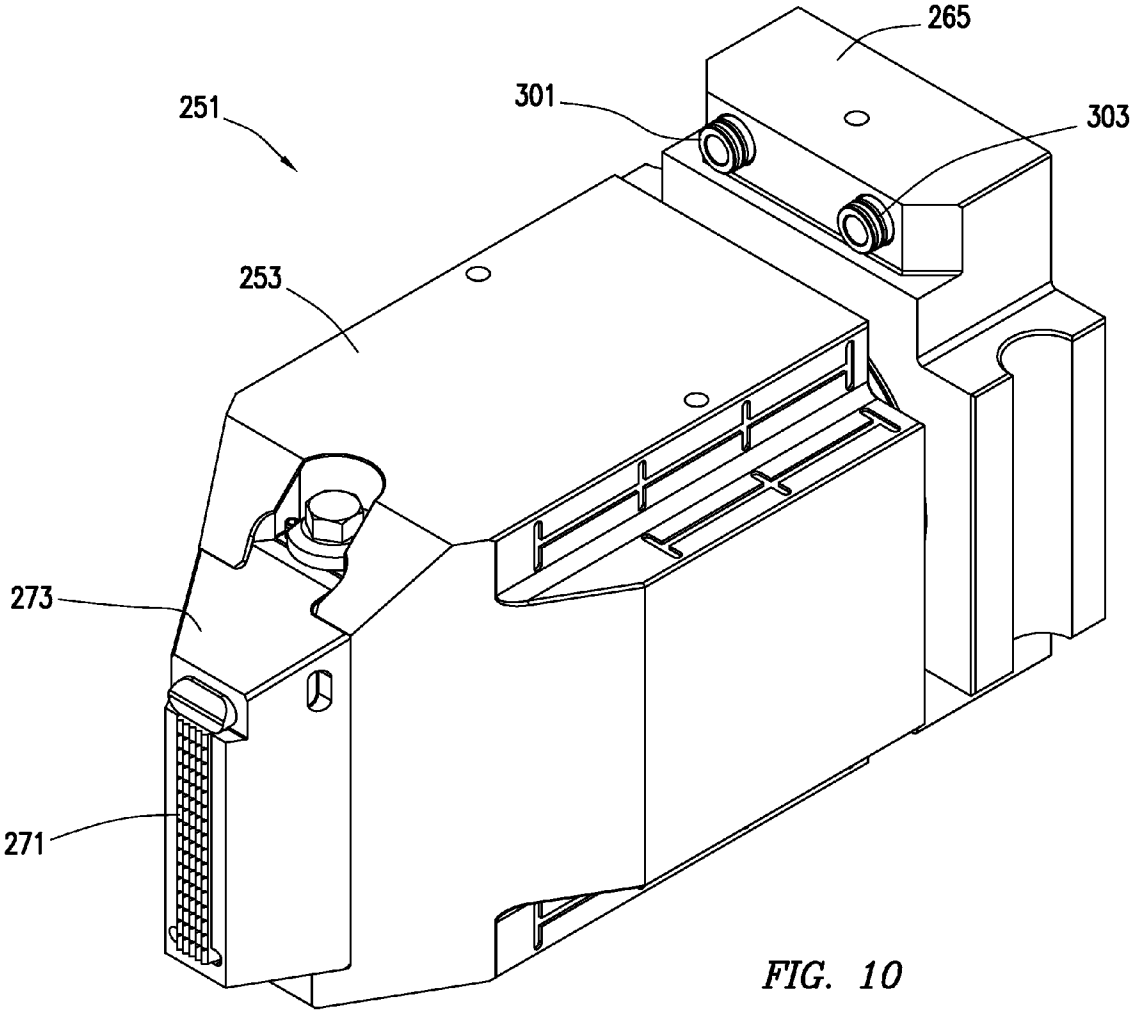
FIG. 10 depicts a perspective view of a spinner jaw consistent with embodiments of the present disclosure.

As depicted in FIGS. 10 and 12, in some embodiments, each spinner jaw 251 may be generally rectangular in cross section. One having ordinary skill in the art with the benefit of this disclosure will understand that spinner jaws 251 may have any cross sectional shape without deviating from the scope of this disclosure. In order to account for different radial cross sections, the side profiles of wedges 235*a*, 235*b* and inner profiles of upper spinner plate 237 and lower spinner plate 233 may be varied.

Figure 11:
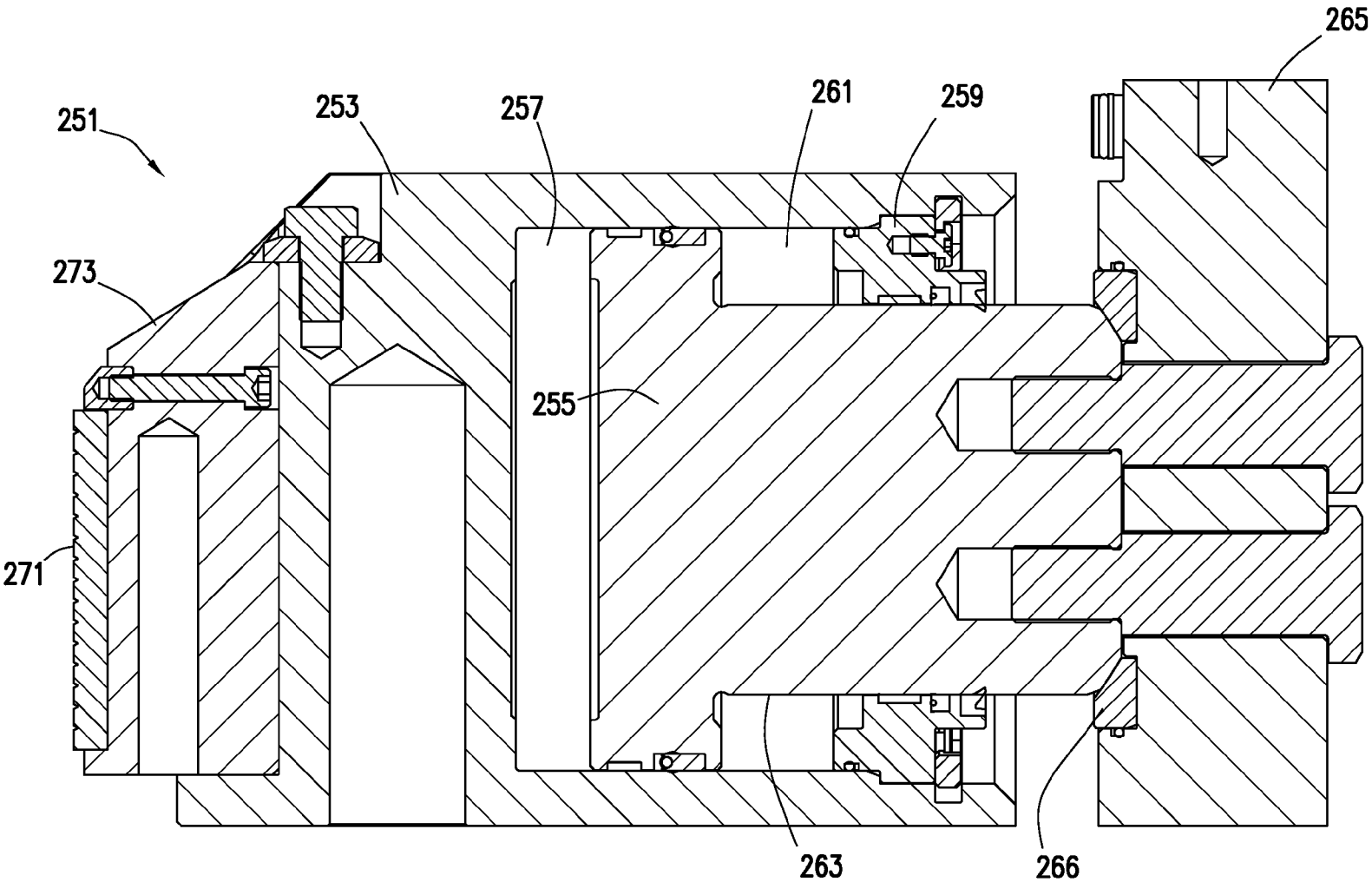
FIG. 11 depicts a cross section of the spinner jaw of FIG. 8 taken along line A-A.

In some embodiments, as depicted in FIG. 11, spinner jaw 251 may include spinner jaw cylinder 253. Spinner jaw cylinder 253 may be adapted to surround and slide relative to spinner jaw piston 255. Spinner jaw cylinder 253 may fluidly seal to spinner jaw piston 255, forming extension chamber 257 between them. Spinner jaw cylinder 253 may also include spinner jaw sealing body 259, adapted to seal against neck 263 of spinner jaw piston 255, forming retraction chamber 261. As understood in the art, when the pressure in extension chamber 257 is increased above that of retraction chamber 261, force exerted on spinner jaw cylinder 253 by the pressure in extension chamber 257 may cause spinner jaw cylinder 253 to be extended along spinner jaw piston 255, thus, as depicted in FIG. 8, extending spinner jaw 251 to grip a tubular (not shown) positioned in makeup tong 201. Likewise, when the pressure in retraction chamber 261 exceeds the pressure in extension chamber 257, the force exerted on spinner jaw sealing body 259 by the pressure in retraction chamber 261 may cause spinner jaw cylinder 253 to be retracted, thus releasing the tubular (not shown). By extending spinner jaws 251 radially inward, in some embodiments a single spinner assembly 231 may be able to grip a range of tubular diameters without, for example, needing to make any changes to spinner assembly 231.

Spinner jaw piston 255 may be coupled to hydraulic block 265 by, for example and without limitation, one or more threaded fasteners. In some embodiments, as depicted in FIG. 11, hydraulic block 265 may include misalignment element 266. Misalignment element 266 may be a generally inwardly tapered bushing adapted to allow a desired amount of relative movement between spinner jaw piston 255 and hydraulic block 265. As depicted in FIG. 8, hydraulic block 265 may include one or more notches, slots, or holes adapted to receive spinner jaw pin 267 passed through upper spinner plate 237 and lower spinner plate 233 to retain spinner jaw 251 within spinner assembly 231. In some embodiments, corresponding grooves or slots may be formed in body wedges 235*a* and/or bridge wedges 235*b* in order to likewise receive spinner jaw pins 267. In some embodiments, spinner jaw pins 267 may, for example and without limitation, serve to transfer radial loads exerted by spinner jaws 251 on tool joint 15 to spinner assembly 231.

In some embodiments, multiple configurations of spinner jaw 251 may be available for use in makeup tong 201. For example, in some embodiments, configurations of spinner jaw 251 may include differently dimensioned spinner jaw cylinders 253 or spinner jaw pistons 255. As an example, the length of throw for each configuration of spinner jaw 251 may be varied. Although able to handle a range of diameter of tubular by the nature of the radial extension of spinner jaws 251, in some embodiments, configurations of spinner jaw 251 allowing for extended or different range of tubular diameter may be available. Likewise, configurations of spinner jaw cylinder 253 and spinner jaw piston 255 may be optimized for, for example and without limitation, greater or lesser grip strength. Because spinner jaws 251 are radially inserted into spinner assembly 231 and are readily removable, reconfiguration of spinner assembly 231 may, for example and without limitation, be greatly simplified.

In some embodiments, as depicted in FIGS. 9 and 12, lower spinner plate 233 and upper spinner plate 237 may include guide channels 269. Guide channels 269 may be formed such that each spinner jaw cylinder 253 fits generally tightly into a guide channel 269 in each of upper spinner plate 237 and lower spinner plate 233. Guide channels 269 may, for example and without limitation, allow torsional force transfer between spinner jaws 251 and spinner assembly 231.

In some embodiments, spinner jaw 251 may further include die 271. Die 271 may, for example and without limitation, be adapted to contact and grip the exterior of a tubular segment gripped by spinner assembly 231. In some embodiments, die 271 may be coupled directly to spinner jaw cylinder 253. In some embodiments, die 271 may be coupled to die carrier 273, which may be selectively coupleable to spinner jaw cylinder 253. In some embodiments, die 271 may be replaceable by disconnecting die carrier 273 from spinner jaw cylinder 253. In some embodiments, die carrier 273 may be coupled to spinner jaw cylinder 253 by, for example and without limitation, a dovetail as understood in the art.

In some embodiments, die carriers 273 and dies 271 may be replaceable with die carriers 273 and dies 271 of different sizes, allowing the range of diameter of tubular that is able to be gripped by spinner assembly 231 to be extended or changed. In some embodiments, spinner jaws 251 may be replaceable with spinner jaws 251 of different sizes, allowing the range of diameter of tubular that is able to be gripped by spinner assembly 231 to be extended or changed.

In some embodiments, as depicted in FIGS. 6, 7, 15 and 16, hydraulic pressure may be supplied to spinner jaws 251 by rotary seal 281. In some embodiments, rotary seal 281 may be adapted to allow continuous hydraulic connection between non-rotating hydraulic manifold 283 and spinner assembly 231 as spinner assembly 231 is rotated. As understood in the art, non-rotating hydraulic manifold 283 may be supplied hydraulic pressure from a pressurized hydraulic system. Hydraulic pressure may be utilized to cause selective extension and retraction of spinner jaws 251 by supplying hydraulic pressure to extension chambers 257 and retraction chambers 261 as described herein and understood in the art. In some embodiments, hydraulic pressure may be supplied by one or more compressors (not shown), and may be controlled by one or more valves (not shown). In some embodiments, non-rotating hydraulic manifold 283 may include a drain line (not shown) for, for example and without limitation, allowing fluid from the low-pressure chamber of each spinner jaw 251 to be bled.

Figure 15:
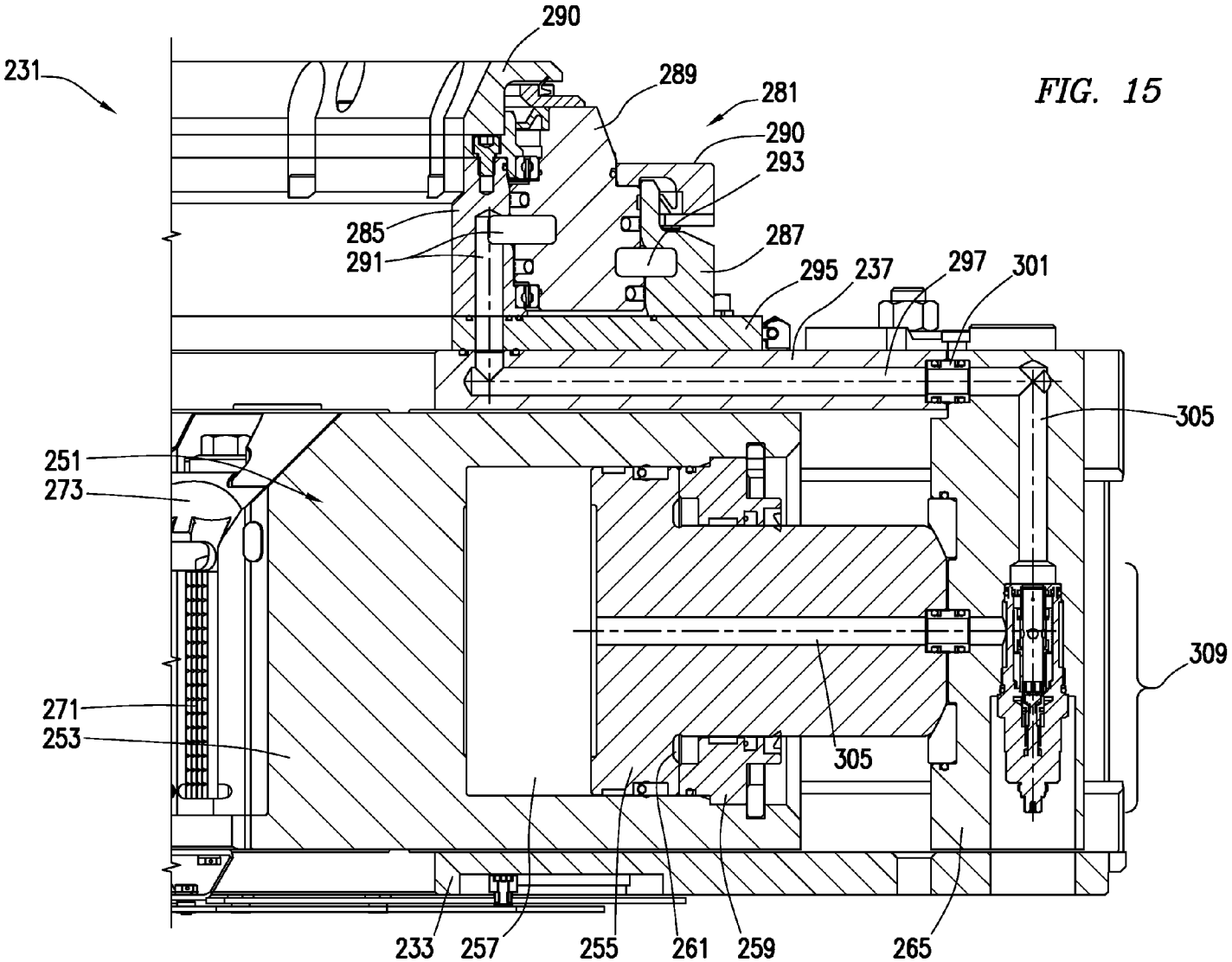
FIG. 15 depicts a partial cross section of the makeup spinner assembly of FIG. 8 taken along line C-C.
Figure 16:
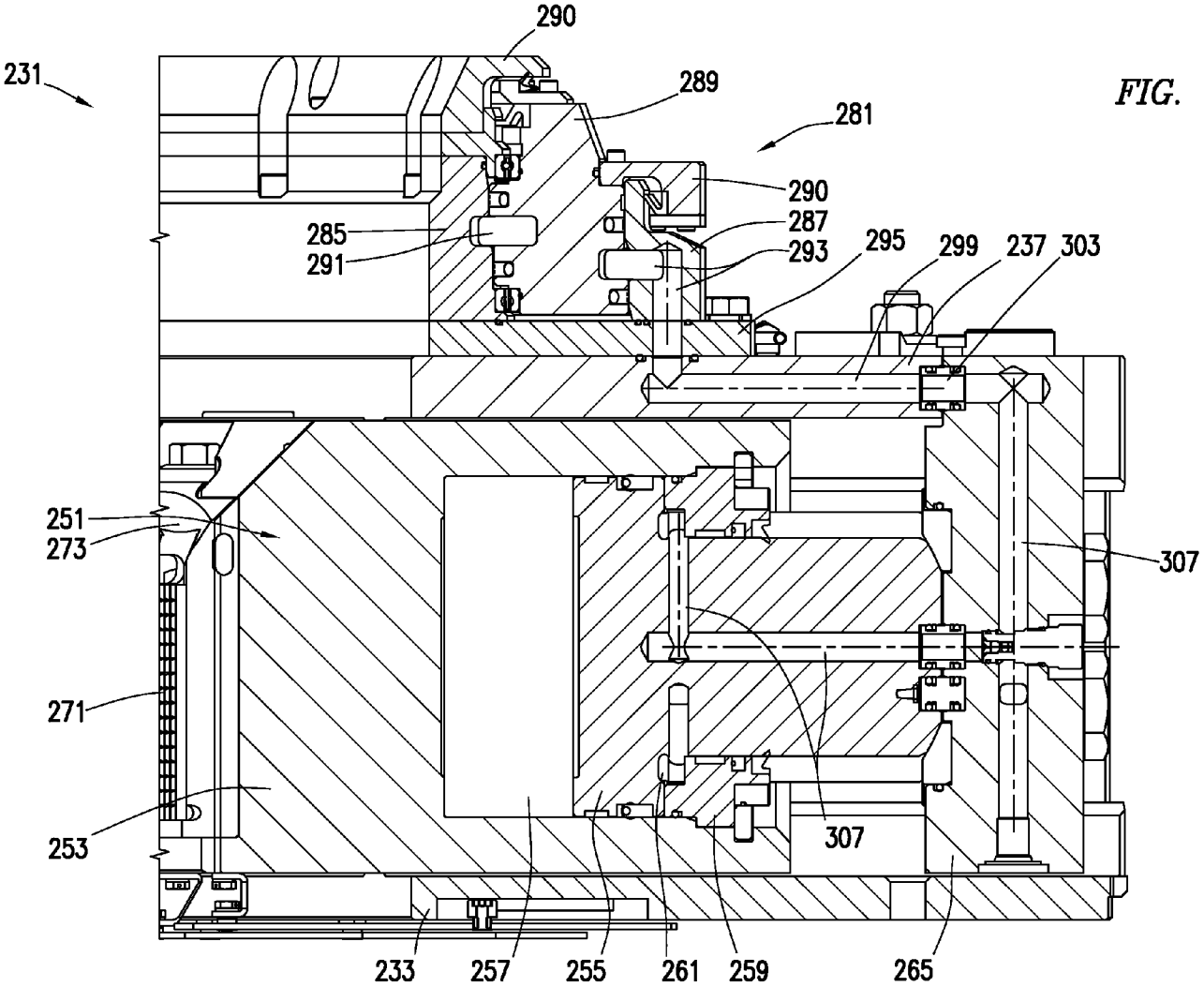
FIG. 16 depicts a partial cross section of the makeup spinner assembly of FIG. 8 taken along line D-D.

As depicted in FIGS. 15, 16, in some embodiments, rotary seal 281 may include inner rotating body 285, outer rotating body 287, static body 289, and rotary seal bottom plate 295. In some embodiments, inner rotating body 285 and outer rotating body 287 may be retained to and allowed to rotate relative to static body 289 by one or more ring clamps 290. In some embodiments, extension supply port 291 may be formed as an annular fluidly sealed space between inner rotating body 285 and static body 289. In some embodiments, retraction supply port 293 may be formed as an annular fluidly sealed space between outer rotating body 287 and static body 289. Ports formed in static body 289 (not shown) may allow fluid connection between non-rotating hydraulic manifold 283 and extension supply port 291 and retraction supply port 293. Inner rotating body 285 and outer rotating body 287 may be coupled to rotary seal bottom plate 295. Rotary seal bottom plate 295 may be coupled to spinner assembly 231.

Figure 13:
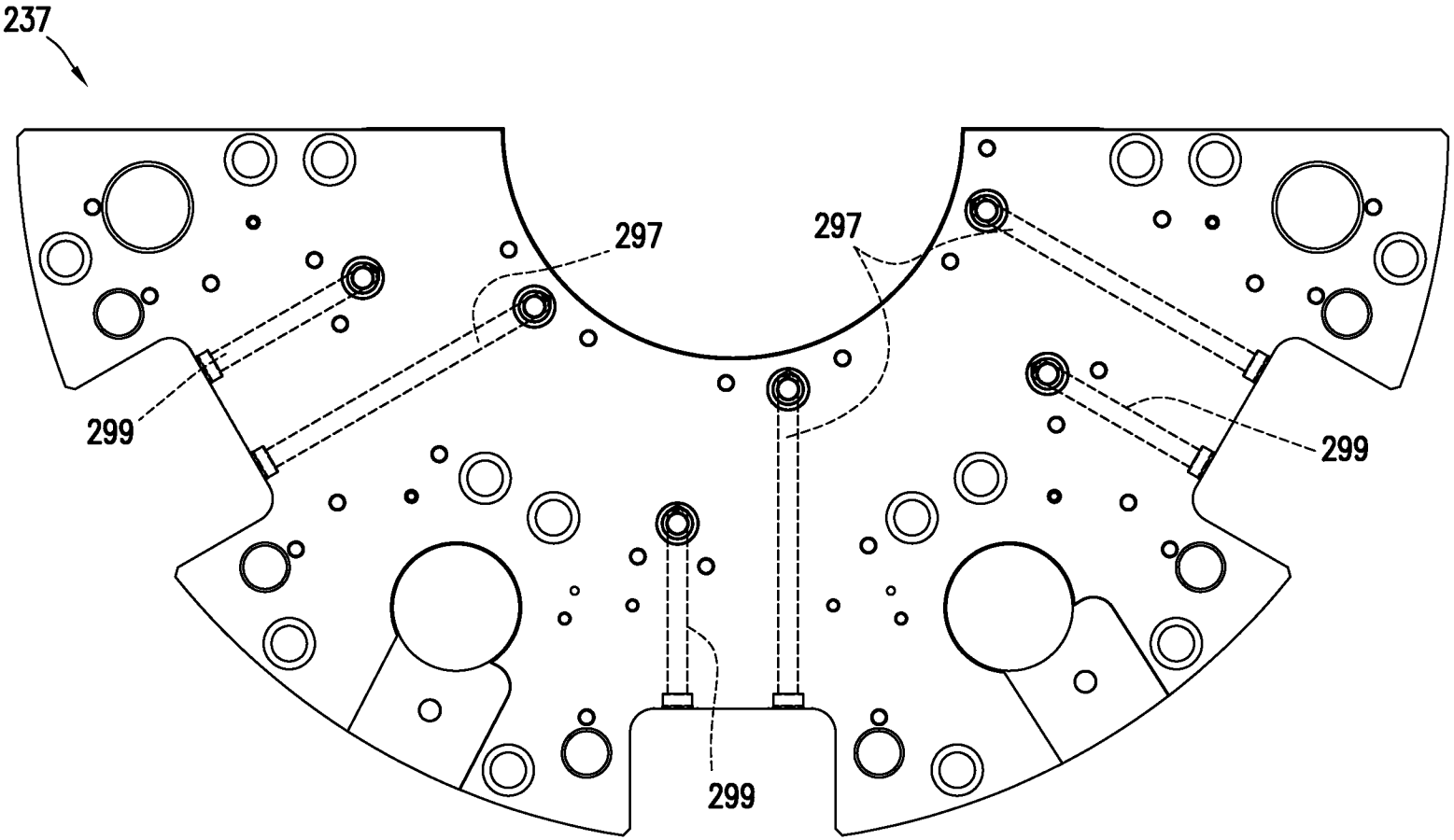
FIG. 13 depicts a top view of a top plate of a makeup spinner assembly consistent with embodiments of the present disclosure.
Figure 14:
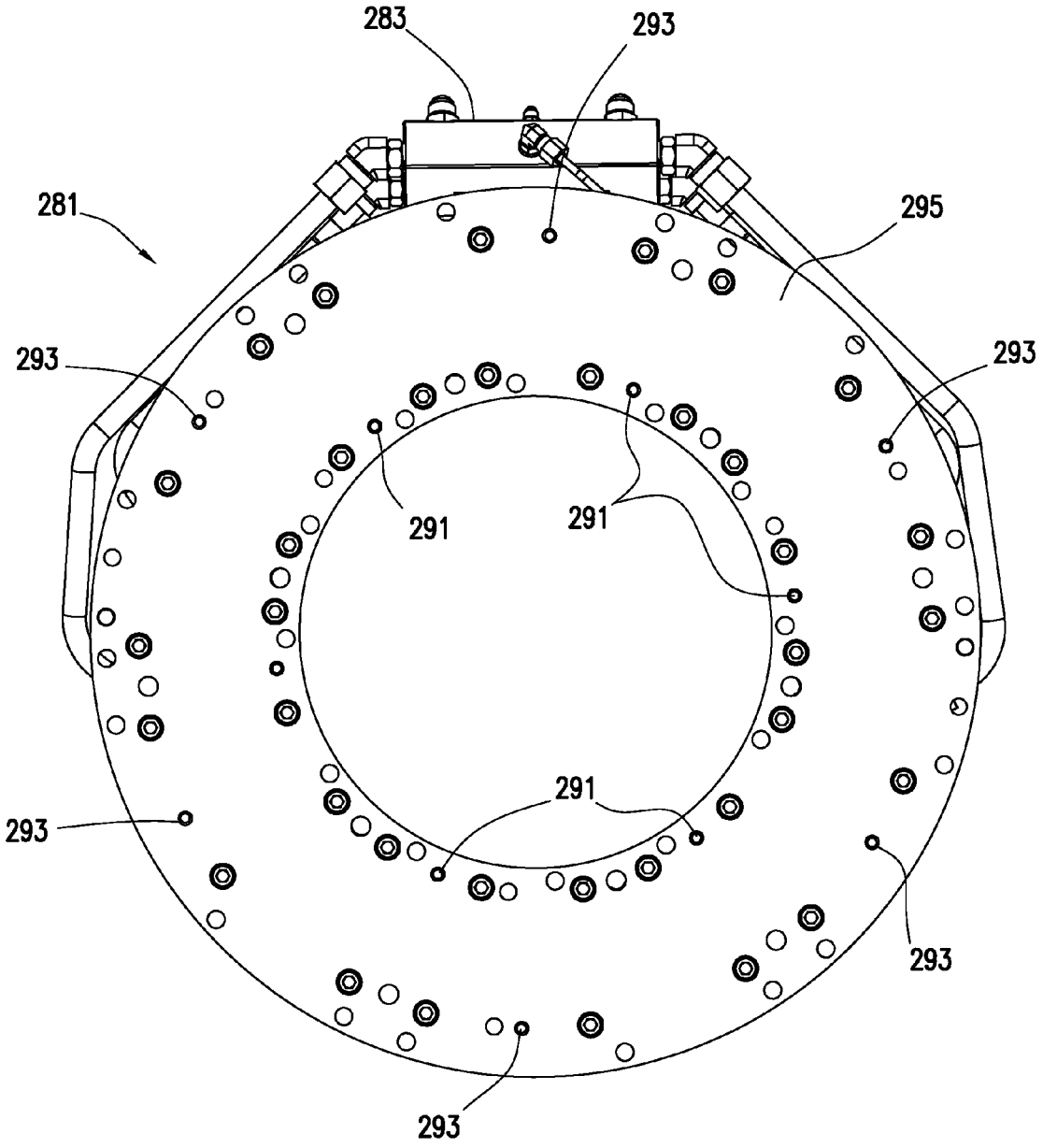
FIG. 14 depicts a bottom view of a rotary seal consistent with embodiments of the present disclosure.

In some embodiments, as depicted in FIGS. 14 and 15, extension supply port 291 may, at various locations positioned radially about rotary seal 281, extend downward through inner rotating body 285 and rotary seal bottom plate 295. Likewise, as depicted in FIGS. 14 and 16, retraction supply port 293 may, at various locations positioned radially about rotary seal 281, extend downward through outer rotating body 287 and rotary seal bottom plate 295. In some embodiments, each upper spinner plate 237 of spinner assembly 231 may, as depicted in FIGS. 13, 15, and 16, include one or more top plate extension ports 297 and top plate retraction ports 299. Top plate extension ports 297 and top plate retraction ports 299 may open onto the top surface of upper spinner plate 237 at a location generally corresponding with the locations through which extension supply ports 291 and retraction supply ports 293 extend through rotary seal bottom plate 295 as depicted in FIG. 14. In some embodiments, by aligning extension supply ports 291 with top plate extension ports 297 and retraction supply ports 293 with top plate retraction ports 299, hydraulic connection between rotary seal 281 and spinner assembly 231 may be established when rotary seal 281 is coupled to the upper surface of spinner assembly 231 as discussed previously. One having ordinary skill in the art with the benefit of this disclosure will understand that one or more couplers, gaskets, and/or O-rings may be utilized to seal between rotary seal 281 and upper spinner plates 237 at each port connection.

In some embodiments, top plate extension ports 297 and top plate retraction ports 299 may extend generally radially within upper spinner plate 237. As depicted in FIGS. 8, 10, 15, and 16, spinner jaws 251 may, in some embodiments, include extension coupler 301 and retraction coupler 303. As depicted in FIG. 15, extension coupler 301 may fluidly couple to arm extension port 305. Arm extension port 305 may, in some embodiments, extend through hydraulic block 265 and spinner jaw piston 255 to couple to extension chamber 257. Likewise, in some embodiments as depicted in FIG. 16, retraction coupler 303 may fluidly couple to arm retraction port 307. Arm retraction port 307 may, in some embodiments, extend through hydraulic block 265 and spinner jaw piston 255 to couple to retraction chamber 261. Although depicted as having extension supply port 291 and retraction supply port 293 corresponding to each spinner jaw 151, one having ordinary skill in the art with the benefit of this disclosure will understand that top plate extension ports 297 and top plate retraction ports 299 may in some embodiments couple extension supply port 291 and/or retraction supply port 293 to more than one spinner jaw 151.

Extension coupler 301 and retraction coupler 303 may, in some embodiments, be adapted to align with and fluidly seal with top plate extension port 297 and top plate retraction port 299 respectively when spinner jaw 251 is installed into spinner assembly 231 as depicted in FIG. 8. As depicted in FIG. 15, continuous fluid connection may thus be established between non-rotating hydraulic manifold 283 and extension chamber 257 via extension supply port 291, top plate extension port 297, extension coupler 301, and arm extension port 305 during the full rotation of spinner assembly 231. Likewise, as depicted in FIG. 16, continuous fluid connection may thus be established between non-rotating hydraulic manifold 283 and retraction chamber 261 via retraction supply port 293, top plate retraction port 299, retraction coupler 303, and arm retraction port 307 during the full rotation of spinner assembly 231.

In some embodiments, in order to, for example and without limitation, synchronize the extension of spinner jaws 251, one or more valves may be included in the hydraulic system described. In some embodiments, for example, minimum pressure valve 309 may, as depicted in FIG. 15, be located in line with arm extension port 305. In some embodiments, minimum pressure valve 309 may instead be located in line with arm retraction port 307. As understood in the art, a minimum pressure valve may be adapted to prevent fluid flow therethrough until the differential pressure across the minimum pressure valve reaches a preselected threshold value. By positioning minimum pressure valve 309 in line with, for example and without limitation, arm retraction port 307, spinner jaw 251 may be prevented from moving radially until the pressure in retraction chamber 261 caused by increased pressure in extension chamber 257 exceeds a selected threshold pressure. In some embodiments, the selected threshold pressure may be selected such that the differential pressure between extension chamber 257 and retraction chamber 261 is sufficient to, for example and without limitation, exceed any anticipated frictional resistance or resistance caused by debris acting to prevent spinner jaw 251 from extending. In some embodiments, by selecting a threshold pressure which would create an extension force significantly exceeding anticipated resistance forces, spinner jaws 251 may thus move generally independently from any resistance forces, allowing each to move in sync with the other spinner jaws 251. In some embodiments, by positioning minimum pressure valves 309 in line with extension port 305, minimum pressure valves 309 may act as regulators to, for example and without limitation, allow even pressure to be exerted on all spinner jaws 251.

In some embodiments, as depicted in FIGS. 6, 17, and 20, spinner assembly 231 may be rotatably driven by drive assembly 215. In some embodiments, drive assembly 215 may include drive ring assembly 217 and ring gear assembly 225. As depicted in FIG. 17, drive ring assembly 217 and ring gear assembly 225 may be generally annular in shape and adapted to couple to the outer circumference of spinner assembly 231. In some embodiments, spinner assembly 231 may be coupled to drive ring assembly 217 such that ring gear assembly 225 is concentrically aligned with spinner assembly 231. In some embodiments, ring gear assembly 225 may include outer-facing gear face 226 adapted to be rotated by spinner pinions 213 as depicted in FIG. 20. As previously discussed, spinner pinions 213 may be rotated by spinner motors 211. One having ordinary skill in the art with the benefit of this disclosure will understand that any gear arrangement for outer-facing gear face 226 and spinner pinions 213 may be utilized without deviating from the scope of this disclosure, and the gear profile depicted is merely exemplary and not intended to be limiting. Likewise, although four spinner motors 211 are depicted, one having ordinary skill in the art with the benefit of this disclosure will understand that other numbers of spinner motors 211 may be utilized without deviating from the scope of this disclosure. In some embodiments, spinner motors 211 may be coupled to spinner pinions 213 by power transmission mechanisms such as, for example and without limitation, gearboxes.

Figure 18:
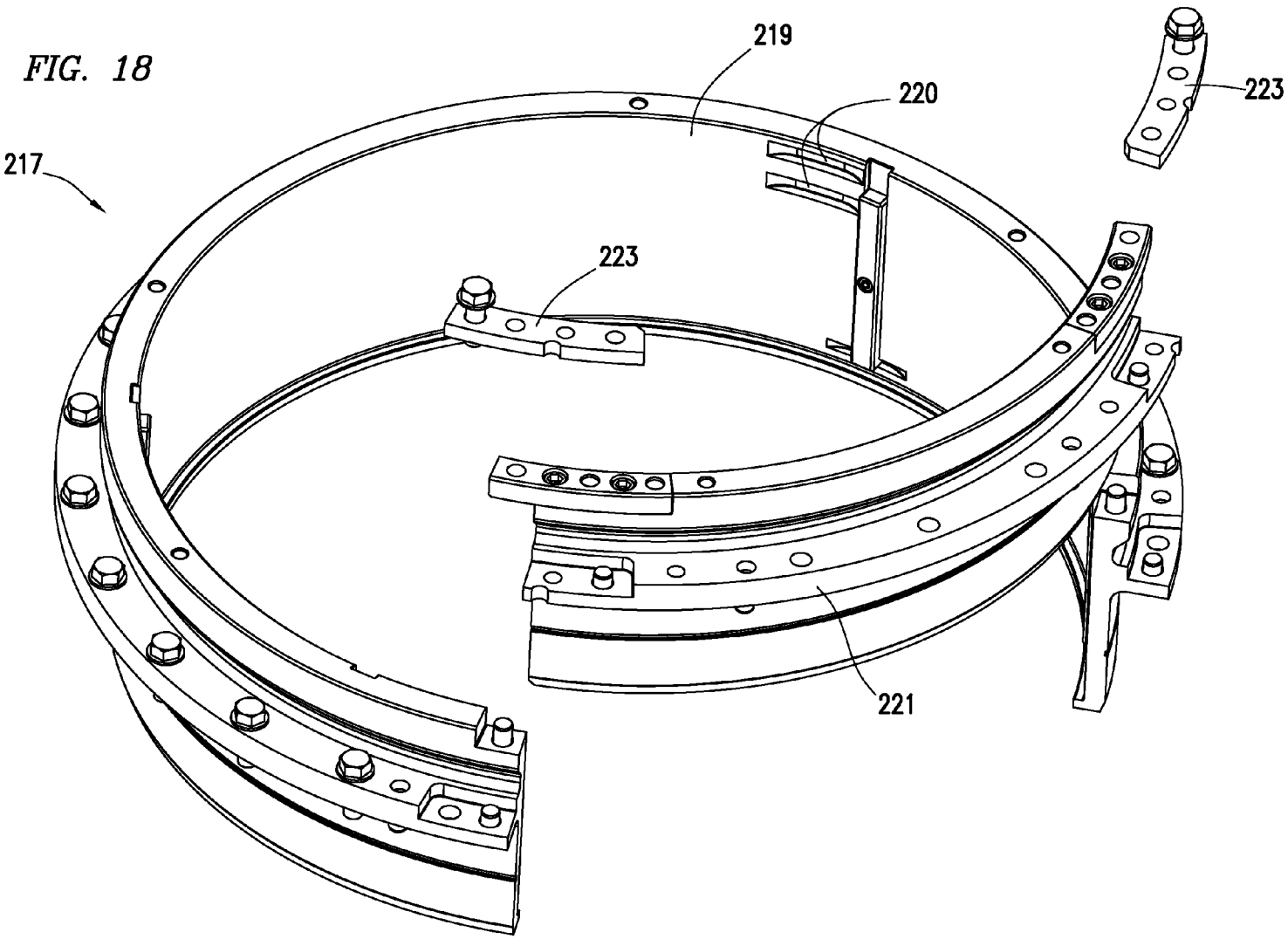
FIG. 18 depicts a drive ring consistent with embodiments of the present disclosure.

In some embodiments, as depicted in FIG. 18, drive ring assembly 217 may be formed from two or more subunits. In some embodiments, drive ring assembly 217 may include drive ring body 219, drive ring segment 221, and coupler plates 223. As depicted in FIG. 18, drive ring body 219 may be a generally annular member with a radial sector cutout. Drive ring segment 221 may be a generally annular member forming a radial sector which fits into the radial sector cutout of drive ring body 219. In some embodiments, one or more coupler plates 223 may be adapted to couple drive ring body 219 to drive ring segment 221.

Figure 19:
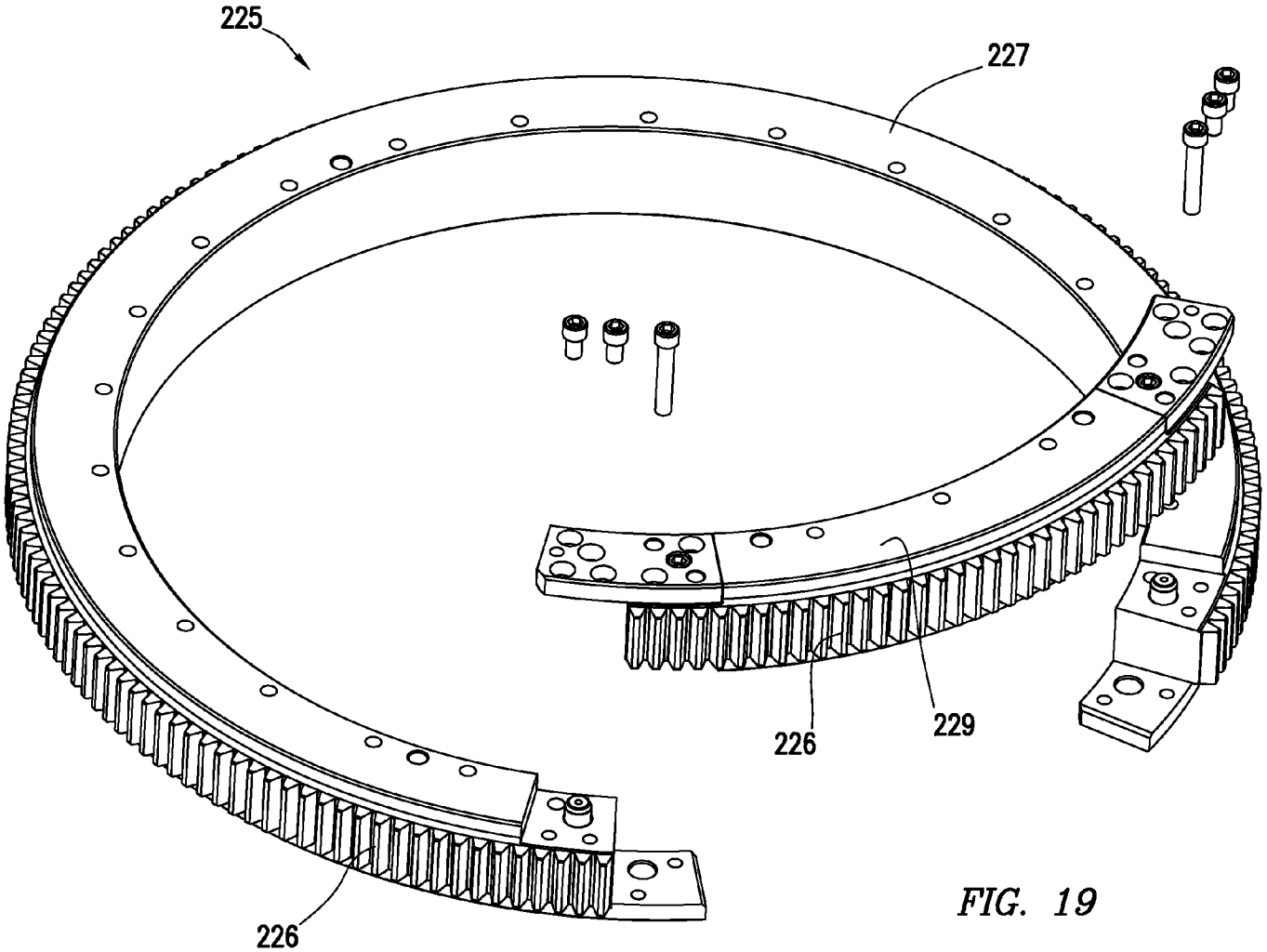
FIG. 19 depicts a ring gear consistent with embodiments of the present disclosure.

In some embodiments, as depicted in FIG. 19, ring gear assembly 225 may include ring gear body 227 and ring gear segment 229. Ring gear body 227 may be a generally annular segment having a radial sector cutout. Ring gear segment 229 may be a generally annular member forming a radial sector which fits into the radial sector cutout of ring gear body 227. In some embodiments, drive ring body 219 and ring gear body 227 may include radial sector cutouts of equal arc length. In some embodiments, drive ring segment 221 and ring gear segment 229 may be adapted to remain coupled together and to thus be removable from drive ring body 219 and ring gear body 227 as a single unit. In some embodiments, removal of coupler plates 223 may allow removal of both drive ring segment 221 and ring gear segment 229. In some embodiments, coupler plates 223, drive ring segment 221, and ring gear segment 229 may be adapted to be removable from the rest of drive assembly 215 from above drive assembly 215, thus allowing removal thereof while drive ring assembly 215 is installed into makeup tong 201 as depicted in FIG. 7.

In some embodiments, as depicted in FIG. 17, spinner assembly 231 may fit into the interior of drive ring assembly 217. In some embodiments, spinner assembly 231 and drive ring assembly 217 are rotationally coupled by one or more rotation keys 216. Rotation keys 216 may be removably slotted into corresponding keyways formed in spinner assembly 231 and drive ring assembly 217. In some embodiments, one or both of drive assembly 215 and spinner assembly 231 may slidingly rotate atop an inner generally horizontal surface of makeup tong housing 203. In some embodiments, drive assembly 215 may be retained vertically within makeup tong housing 203 by one or more retaining plates (not shown) coupled to makeup tong housing 203. In some embodiments, spinner assembly 231 may be retained vertically within drive assembly 215 by one or more retention tabs 218 as depicted in FIGS. 7, 8, and 17. Retention tabs 218 may be adapted to couple to an upper surface of spinner assembly 231 and interface with one or more retention slots 220, as depicted in FIGS. 17 and 18. By removing retention tabs 218, spinner assembly 231 may be vertically removed from drive assembly 215 and, as discussed below, makeup tong 201.

In some embodiments, multiple configurations of spinner assembly 231 may be available for use in makeup tong 201. For example, in some embodiments, configurations of spinner assembly 231 may include vertically shorter or taller components such as body wedges 235*a*, bridge wedges 235*b*, and spinner jaws 251. By changing the height of spinner jaws 251, spinner jaw cylinder 253 and spinner jaw piston 255 may vary in size, thus reducing or increasing the total volume of extension chamber 257 and retraction chamber 261. In some embodiments, in which high grip strength is necessary or desired, a taller spinner assembly 231 may be utilized. In some embodiments, in which high grip strength is not required, a shorter spinner assembly 231 may be utilized, allowing spinner jaws 251 to operate utilizing less hydraulic fluid. In some embodiments, in order to, for example, allow the use of multiple height spinner assemblies 231, multiple retention slots 220 may be included in drive assembly 215.

Figure 22:
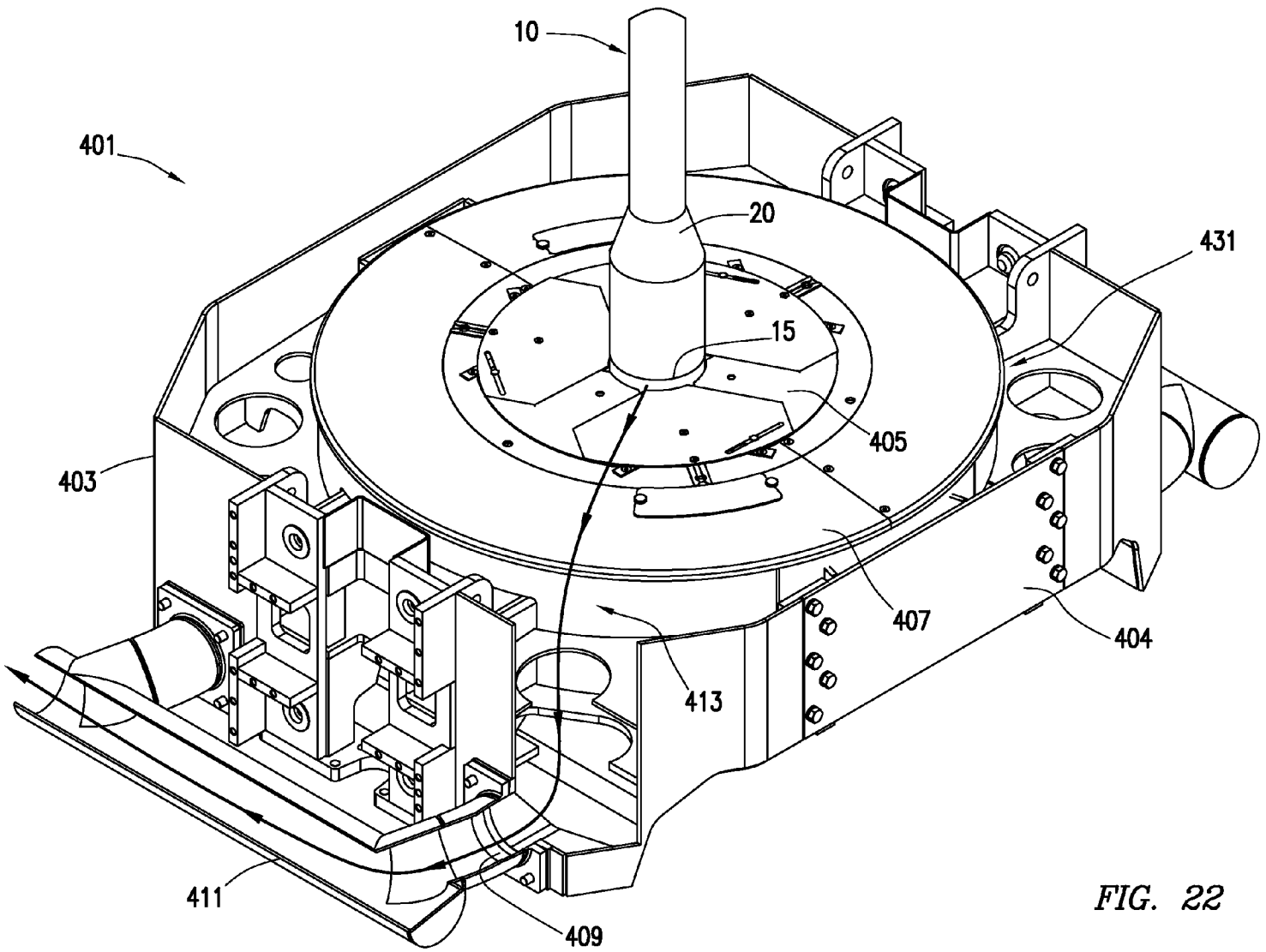
FIG. 22 depicts a perspective view of a backup tong consistent with embodiments of the present disclosure.
Figure 23:
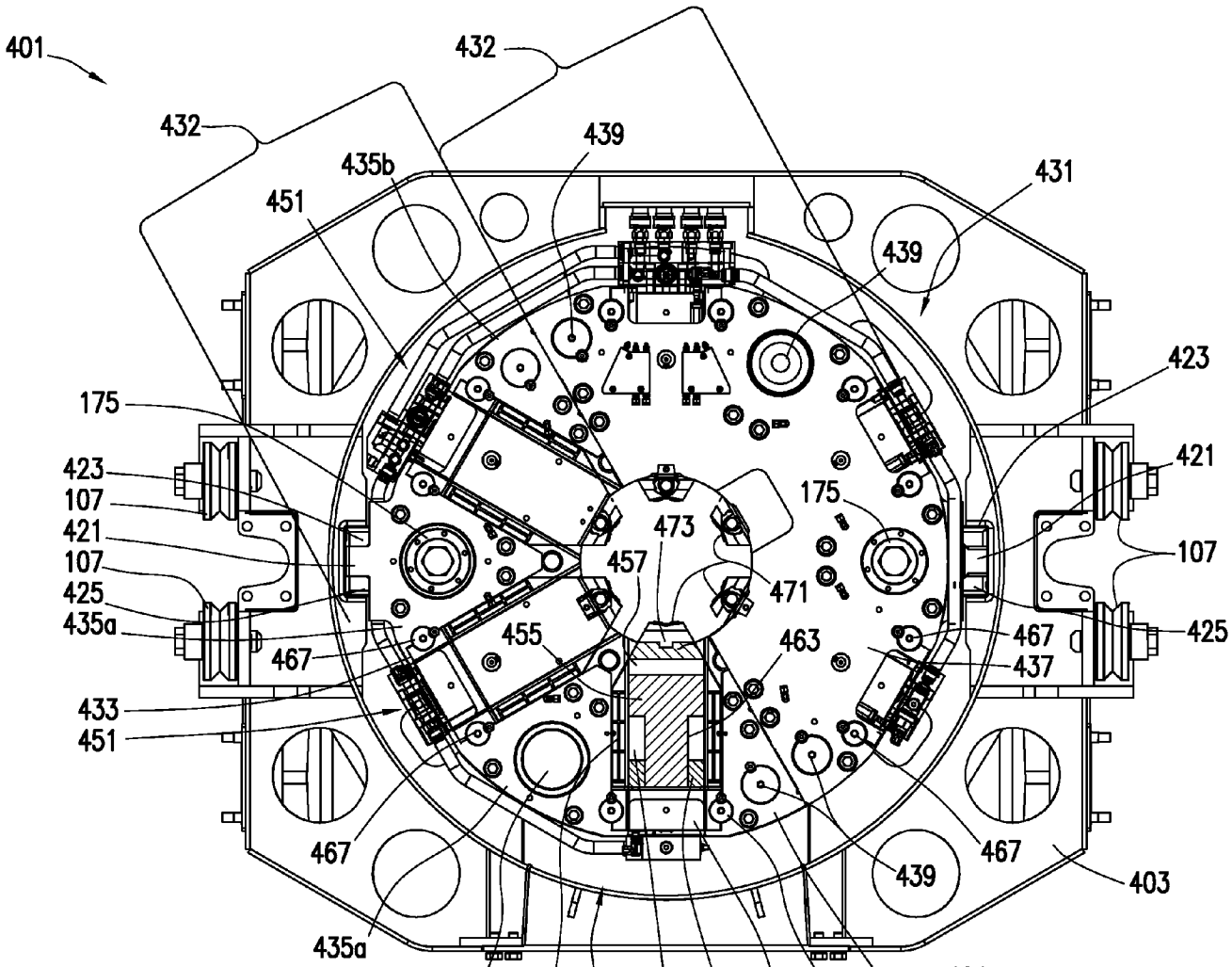
FIG. 23 depicts a top view of the backup tong of FIG. 22.

With reference to FIGS. 22 and 23, in some embodiments, backup tong 401 may include backup tong housing 403. Backup tong housing 403 may be adapted to, for example and without limitation, support and transfer weight and torsional load between frame 101 (as previously discussed) and gripper assembly 431 (depicted in FIGS. 23-26). In some embodiments, backup tong housing 403 may also support the weight of makeup tong 201 through, for example, hydraulic cylinders 151. In some embodiments, as depicted in FIGS. 22, 23, 29 and 31, backup tong housing 403 may include backup tong housing door 404. Backup tong housing door 404 may be removable from backup tong housing 403 in order to, for example and without limitation, create an access point to radially remove backup tong housing 403 from drill string 10 as discussed below.

In some embodiments of the present disclosure, gripper assembly 431 may be constructed similarly to spinner assembly 231 as discussed herein above. In some embodiments, gripper assembly 431 may be separable into two or more gripper subunits 432. By allowing gripper assembly 431 to be separable into two or more gripper subunits 432, gripper assembly 431 may be removed from backup tong 401 without removing drill string 10. Although described throughout this disclosure as being separable into two gripper subunits 432, one having ordinary skill in the art with the benefit of this disclosure will understand that any number of gripper subunits 432 as described herein without deviating from the scope of this disclosure.

Figure 24:
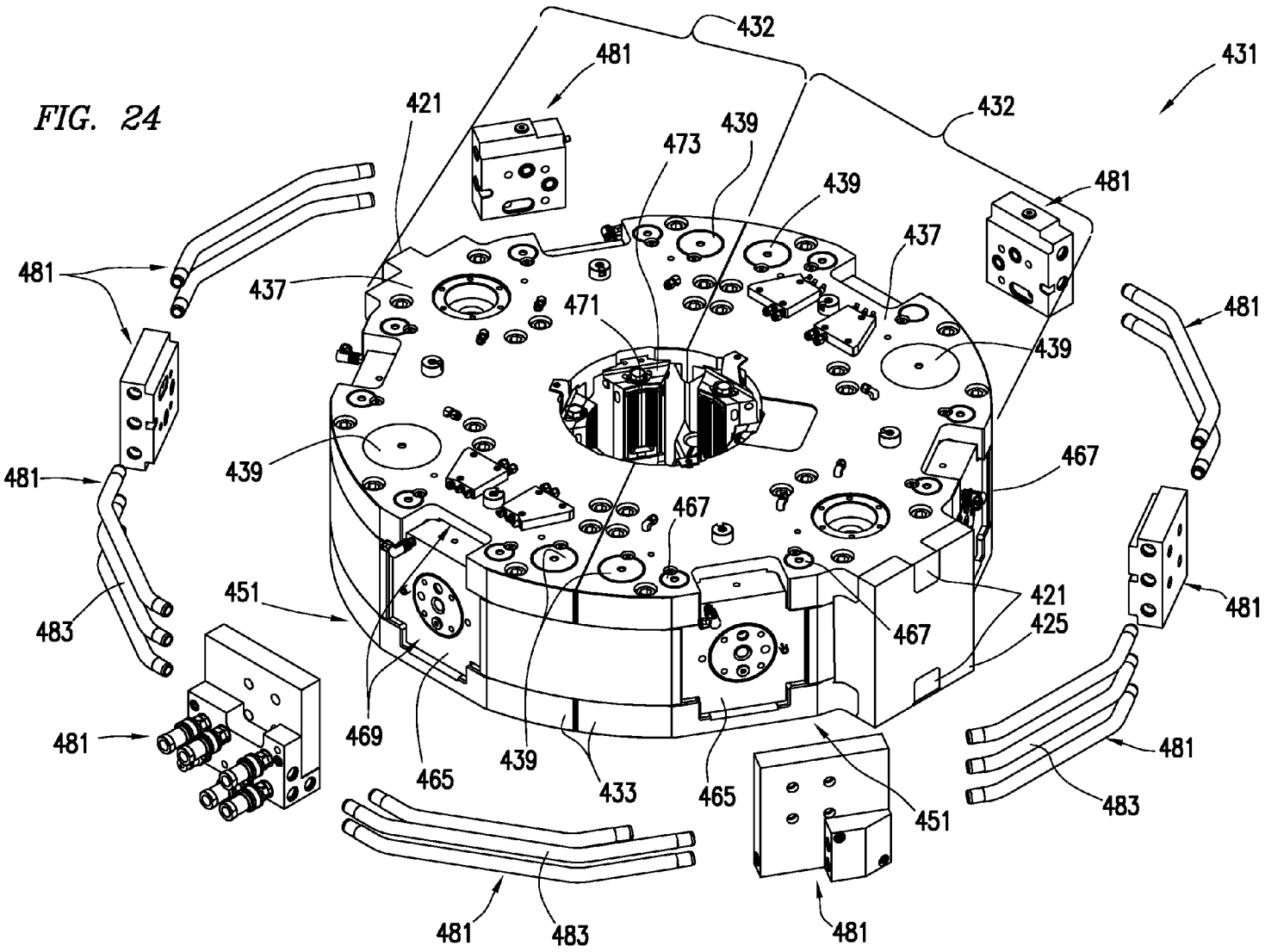
FIG. 24 depicts a perspective partially exploded view of a backup gripper assembly consistent with embodiments of the present disclosure.

As depicted in FIGS. 23 and 24, in some embodiments, gripper assembly 431 may include lower gripper plates 433; body wedges 435*a*, bridge wedges 435*b*; upper gripper plates 437; and gripper jaws 451. In some embodiments, each gripper subunit 432 may be formed identically to each other gripper subunit 432. Note that in FIG. 24, gripper subunit 432 are depicted as already coupled together. Although depicted throughout this disclosure as having six wedges 435*a*, 435*b* and six gripper jaws 451, one having ordinary skill in the art with the benefit of this disclosure will understand that any number of wedges 435*a*, 435*b* and gripper jaws 451 may be utilized as described herein without deviating from the scope of this disclosure. In some embodiments, gripper assembly 431 may be assembled and held together utilizing a plurality of wedge pins 439. However, one having ordinary skill in the art with the benefit of this disclosure will understand that although discussed as utilizing wedge pins 439, other fasteners may be utilized without deviating from the scope of this disclosure, including, for example and without limitation, bolts or other threaded fasteners.

In some embodiments, in order to assemble gripper assembly 431, body wedges 435*a* may be arranged atop lower gripper plates 433 corresponding with a single gripper subunit 432. Bridge wedges 435*b* may be positioned across the split between lower gripper plates 433 and may in some embodiments serve to couple gripper subunits 432. Upper gripper plates 437 may then be positioned atop body wedges 435*a* and bridge wedges 435*b*. In some embodiments, wedge pins 439 may be adapted to pass through pin holes formed through each of upper gripper plates 437, body wedges 435*a* and bridge wedges 435*b*, and lower gripper plates 433, the pin holes adapted to align when gripper assembly 431 is assembled. In some embodiments, body wedges 435*a* may include a single pin-hole adapted to receive a single wedge pin 439. In some embodiments, bridge wedges 435*b* may include two pin-holes such that bridge wedges 435*b* couple adjacent upper gripper plates 437 and lower gripper plates 433 when a wedge pin 439 is inserted through each pin hole of bridge wedges 435*b*.

In some embodiments, gripper assembly 431 may be assembled separately in gripper subunits 432, the gripper subunits 432 coupled after assembly to form gripper assembly 431. In some such embodiments, bridge wedge 435*b* may be positioned at the end of lower gripper plate 433 such that it is at least partially extending past the end of lower gripper plate 433. Upper gripper plate 437 may then be positioned atop the assembled body wedges 435*a* and bridge wedge 435*b*. Wedge pins 439 may then be inserted through the aligned pin holes, securing gripper subunit 432. Two (or more) gripper subunits 432 may then be aligned and slid together such that bridge wedges 435*b* enter into the open ends of the adjacent gripper subunit 432. Wedge pins 439 may then be inserted through the second pin holes through bridge wedges 435*b*, coupling the adjacent gripper subunits 432.

In some embodiments, lower gripper plates 433 and/or upper gripper plates 437 may include one or more anti-rotation pins (not shown) adapted to insert into matching holes formed in body wedges 435*a* and bridge wedges 435*b*. Anti-rotation pins may, for example and without limitation, prevent each body wedge 435*a* or bridge wedge 435*b* from rotating relative to the upper gripper plate 437 and lower gripper plate 433 to which it is pinned. In some embodiments, anti-rotation pins for bridge wedges 435*b* may only be included for one lower gripper plate 433 and/or upper gripper plate 437 to, for example and without limitation, allow the gripper subunits 432 to be separated by the removal of the wedge pin 439 for each bridge wedge 435*b* corresponding to the gripper subunit 432 which does not include anti-rotation pins, allowing bridge wedges 435*b* to slide out from the adjacent gripper subunit 432 as the gripper subunits 432 are separated (depicted in FIG. 29).

In some embodiments, once gripper subunit 432 is assembled, whether joined to form gripper assembly 431 or separate, gripper jaws 451 may be installed. As depicted in FIGS. 23 and 24, each gripper jaw 451 may be installed by radially inserting the gripper jaw 451 into the spaces formed between adjacent wedges 435*a* and/or 435*b*, and upper gripper plate 437 and lower gripper plate 433.

Figure 25:
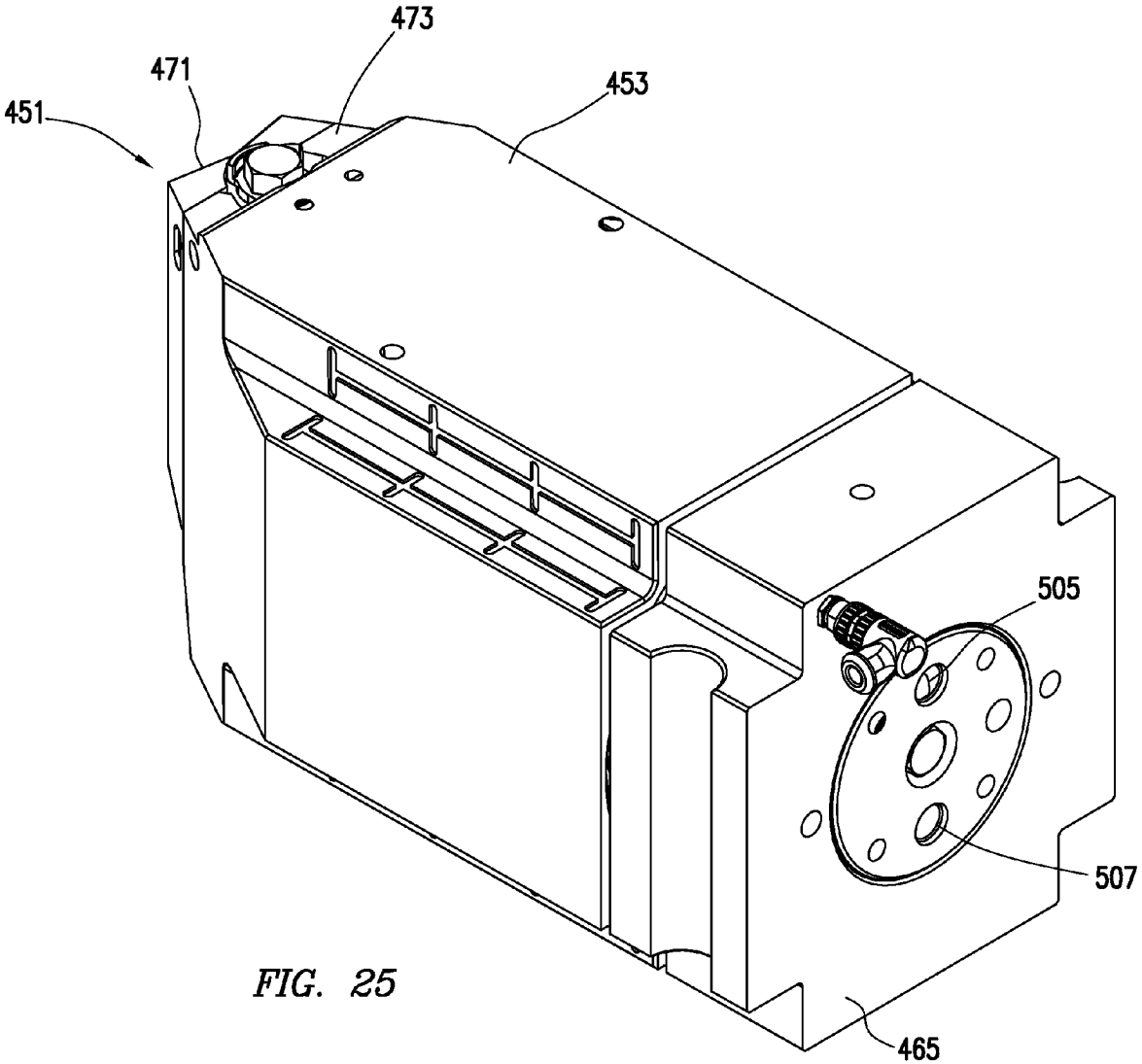
FIG. 25 depicts a perspective view of a backup gripper jaw of FIG. 22.

As depicted in FIGS. 23 and 25, in some embodiments, each gripper jaw 451 may be generally rectangular in cross section. One having ordinary skill in the art with the benefit of this disclosure will understand that gripper jaws 451 may have any cross sectional shape without deviating from the scope of this disclosure. In order to account for different radial cross sections, the side profiles of wedges 435*a*, 435*b* and inner profiles of upper gripper plate 437 and lower gripper plate 433 may be varied.

In some embodiments, as depicted in FIGS. 23, 25, gripper jaw 451 may include gripper jaw cylinder 453. Gripper jaw cylinder 453 may be adapted to surround and slide relative to gripper jaw piston 455. Gripper jaw cylinder 453 may fluidly seal to gripper jaw piston 455, forming extension chamber 457 between them. Gripper jaw cylinder 453 may also include gripper jaw sealing body 459, adapted to seal against neck 463 of gripper jaw piston 455, forming retraction chamber 461. As understood in the art, when the pressure in extension chamber 457 is increased above that of retraction chamber 461, the force exerted on gripper jaw cylinder 453 by the pressure in extension chamber 457 may cause gripper jaw cylinder 453 to be extended along gripper jaw piston 455, thus extending gripper jaw 451 to grip a tubular (not shown) positioned in backup tong 401. Likewise, when the pressure in retraction chamber 461 exceeds the pressure in extension chamber 457, the force exerted on gripper jaw sealing body 459 by the pressure in retraction chamber 461 may cause gripper jaw cylinder 453 to be retracted thus releasing the tubular (not shown). By extending gripper jaws 451 radially inward, in some embodiments a single gripper assembly 431 may be able to grip a range of tubular diameters without, for example, needing to make any changes to gripper assembly 431.

Gripper jaw piston 455 may be coupled to hydraulic block 465 by, for example and without limitation, one or more threaded fasteners. Hydraulic block 465 may include one or more notches, slots, or holes adapted to receive gripper jaw pin 467 passed through upper gripper plate 437 and lower gripper plate 433 to retain gripper jaw 451 within gripper assembly 431. In some embodiments, corresponding grooves or slots may be formed in body wedges 435*a* and/or bridge wedges 435*b* in order to likewise receive gripper jaw pins 467. In some embodiments, gripper jaw pins 467 may, for example and without limitation, serve to transfer radial loads exerted by gripper jaws 451 on tool joint 15 to gripper assembly 431.

In some embodiments, multiple configurations of gripper jaw 451 may be available for use in backup tong 401. For example, in some embodiments, configurations of gripper jaw 451 may include differently dimensioned gripper jaw cylinders 453 or gripper jaw pistons 455. As an example, the length of throw for each configuration of gripper jaw 451 may be varied. Although able to handle a range of diameter of tubular by the nature of the radial extension of gripper jaws 451, in some embodiments, configurations of gripper jaw 451 allowing for extended or different range of tubular diameter may be available. Likewise, configurations of gripper jaw cylinder 453 and gripper jaw piston 455 may be optimized for, for example and without limitation, greater or lesser grip strength. Because gripper jaws 451 are radially inserted into gripper assembly 431 and readily removable, reconfiguration of gripper assembly 431 may, for example and without limitation, be greatly simplified.

In some embodiments, as depicted in FIG. 24, lower gripper plate 433 and upper gripper plate 437 may include guide channels 469. Guide channels 469 may be formed such that each gripper jaw cylinder 453 fits generally tightly into a guide channel 469 in each of upper gripper plate 437 and lower gripper plate 433. Guide channels 469 may, for example and without limitation, allow torsional force transfer between gripper jaws 451 and gripper assembly 431.

Figure 26:
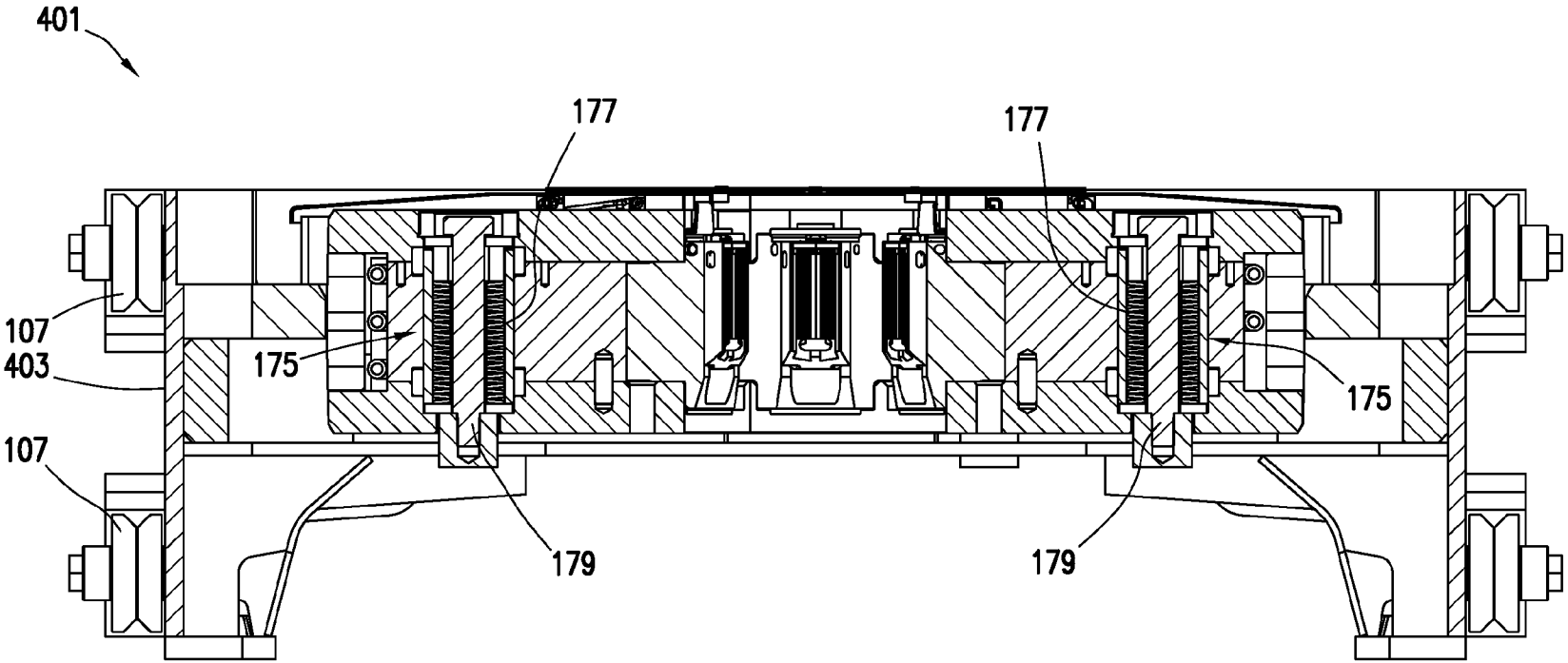
FIG. 26 depicts a cross section view of a backup tong consistent with embodiments of the present disclosure.

In some embodiments, as depicted in FIGS. 25 and 26, gripper jaw 451 may further include die 471. Die 471 may, for example and without limitation, be adapted to contact and grip the exterior of a tubular segment gripped by gripper assembly 431. In some embodiments, die 471 may be coupled directly to gripper jaw cylinder 453. In some embodiments, die 471 may be coupled to die carrier 473, which may be selectively coupleable to gripper jaw cylinder 453. In some embodiments, die 471 may be replaceable by disconnecting die carrier 473 from gripper jaw cylinder 453. In some embodiments, die carrier 473 may be coupled to gripper jaw cylinder 453 by, for example and without limitation, a dovetail as understood in the art.

In some embodiments, die carriers 473 and dies 471 may be replaceable with die carriers 473 and dies 471 of different sizes, allowing the range of diameter of tubular able to be gripped by gripper assembly 431 to be extended or changed. In some embodiments, gripper jaws 451 may be replaceable with gripper jaws 451 of different sizes, allowing the range of diameter of tubular able to be gripped by gripper assembly 431 to be extended or changed.

In some embodiments, as depicted in FIG. 24, hydraulic pressure may be supplied to gripper jaws 451 by hydraulic supply system 481, which may include a plurality of hydraulic lines and bulkheads. As understood in the art, hydraulic supply system 481 may be supplied hydraulic pressure from a pressurized hydraulic system. Hydraulic pressure may be utilized to cause selective extension and retraction of gripper jaws 451 by supplying hydraulic pressure to extension chambers 457 and retraction chambers 461 as described herein and understood in the art. In some embodiments, hydraulic pressure may be supplied by one or more compressors (not shown), and may be controlled by one or more valves (not shown). In some embodiments, gripper assembly 431 may include a drain line (not shown) to, for example and without limitation, allow fluid from the low-pressure chamber of each gripper jaw 451 to be bled. In other embodiments, as depicted in FIG. 24, gripper assembly 431 may further include hydraulic recirculation lines 483, adapted to allow hydraulic fluid used to extend or retract gripper jaws 451 to be readily recovered in the pressurized hydraulic system.

As depicted in FIG. 25, gripper jaw 451 may include arm extension port 505 and arm retraction port 507. In some embodiments, arm extension port 505 and arm retraction port 507 may be formed, for example and without limitation, through one or both of hydraulic block 465 and gripper jaw piston 455. Arm extension port 505 may, in some embodiments, fluidly connect to extension chamber 457, allowing hydraulic supply system 481 to provide hydraulic pressure thereto to extend gripper jaws 451. Likewise, arm retraction port 507 may, in some embodiments, fluidly connect to retraction chamber 461, allowing hydraulic supply system 481 to provide hydraulic pressure thereto to retract gripper jaws 451.

In some embodiments, in order to, for example and without limitation, synchronize the extension of gripper jaws 451, one or more valves may be included in the hydraulic system described. In some embodiments, for example, a minimum pressure valve may be located in line with arm extension port 505. In some embodiments, the minimum pressure valve may instead be located in line with arm retraction port 507. As understood in the art, a minimum pressure valve may be adapted prevent fluid flow therethrough until the differential pressure across the minimum pressure valve reaches a preselected threshold value. By positioning a minimum pressure valve in line with, for example and without limitation, arm retraction port 507, gripper jaw 451 may be prevented from moving radially until the pressure in retraction chamber 461 caused by increased pressure in extension chamber 457 exceeds a selected threshold pressure. In some embodiments, the selected threshold pressure may be selected such that the differential pressure between extension chamber 457 and retraction chamber 461 is sufficient to, for example and without limitation, exceed any anticipated frictional resistance or resistance caused by debris acting to prevent gripper jaw 451 from extending. In some embodiments, by selecting a threshold pressure which would create an extension force significantly exceeding anticipated resistance forces, gripper jaws 451 may thus move generally independently from any resistance forces, allowing each to move in sync with the other gripper jaws 451. In some embodiments, by positioning minimum pressure valves in line with extension port 505, the minimum pressure valves may act as regulators to, for example and without limitation, allow even pressure to be exerted on all gripper jaws 451.

In some embodiments of the present disclosure, gripper assembly 431 may be coupled directly to backup tong housing 403. In some embodiments, gripper assembly 431 may be coupled to backup tong housing 403 via one or more generally compliant joints. In some embodiments, for example and without limitation, gripper assembly 431 may be coupled to backup tong housing 403 by one or more suspension assemblies 175 as depicted in FIG. 26. In some embodiments, suspension assemblies 175 may include one or more springs 177 adapted to support the weight of gripper assembly 431 and transfer that weight and any loading to backup tong housing 403, thence onto frame 101. Suspension assemblies 175 may, as understood in the art, include a pin or bolt connection 179, adapted to allow both vertical relative displacement and, in some embodiments, a desired amount of horizontal or angular relative movement between gripper assembly 431 and backup tong housing 403 while preventing gripper assembly 431 and backup tong housing 403 from separating. In some embodiments, vertical, horizontal, and/or angular relative movement between gripper assembly 431 and backup tong housing 403 may, for example and without limitation, allow backup tong 401 to compensate for any irregularity, bending, or damage to a tubular being gripped by backup tong 401 during a make up or break out operation as will be discussed herein below.

In some embodiments of the present disclosure, suspension assemblies 175 may be positioned to pass through gripper assembly 431 and engage with a lower surface of backup tong housing 403. In some embodiments, as depicted in FIGS. 23 and 26, suspension assemblies 175 may be positioned to take the place of one or more wedge pins 439.

In some embodiments of the present disclosure, gripper assembly 431 may include one or more anti-rotation tabs 421. Anti-rotation tabs 421 may, in some embodiments, fit into corresponding anti-rotation slots 423 formed in backup tong housing 403. Anti-rotation tabs 421 may serve to transfer torsional force between gripper assembly 431 and backup tong housing 403. In some embodiments, in order to allow relative movement between gripper assembly 431 and backup tong housing 403 as described above with regard to suspension assemblies 175, anti-rotation tabs 421 may be generally loosely fit into anti-rotation slots 423 such that a selected amount of vertical, horizontal, and/or angular relative movement between gripper assembly 431 and backup tong housing 403 is allowed. In some embodiments, bushing 425 may be positioned between anti-rotation tabs 421 and anti-rotation slots 423 to, for example and without limitation, reduce friction between and wear upon anti-rotation tabs 421 and anti-rotation slots 423.

With reference to FIG. 22, during some break out operations, upper tubular segment 20 may be at least partially filled with a fluid such as drilling mud. When tool joint 15 is broken out, the drilling mud in upper tubular segment 20 may drain out through the no longer sealed tool joint 15 into the space between backup tong 401 and makeup tong 201. In some embodiments, backup tong 401 may include a mud management system. In some embodiments, backup tong 401 may further include pipe seal 405. Pipe seal 405 may be adapted to generally tightly encircle drill string 10. Pipe seal 405 may couple to backup tong cover 407. Pipe seal 405 and backup tong cover 407 may, in some embodiments, prevent fluids or other debris from entering into the interior of backup tong 401. In some embodiments, pipe seal 405 and backup tong cover 407 may be generally convex or tapered such that any fluid atop pipe seal 405 or backup tong cover 407 drains generally radially outward from drill string 10. In some embodiments, pipe seal 405 and backup tong cover 407 may be segmented to, for example and without limitation, allow them to be removed from backup tong 401 even when drill string 10 is in position. In some embodiments, pipe seal 405 may be reconfigurable to, for example, match the outer diameter of a range of potential tubulars used in drill string 10.

In some embodiments, backup tong housing 403 may be generally hollow. In some embodiments, backup tong housing 403 may be generally open at the top, allowing any fluids draining atop from pipe seal 405 and backup tong cover 407 to enter the interior of backup tong housing 403. In some embodiments, backup tong housing 403 may include one or more drainage ports 409 positioned to allow any fluids to drain from the interior of backup tong housing 403. In some embodiments, drainage ports 409 may be coupled to one or more drainage manifolds 411. Drainage manifolds 411 may, for example and without limitation, allow any fluids to be drained to a location away from automated roughneck 100. Arrow 413 indicates the path fluid exiting from a broken out tool joint 15 may take in embodiments of the present disclosure.

Figure 27:
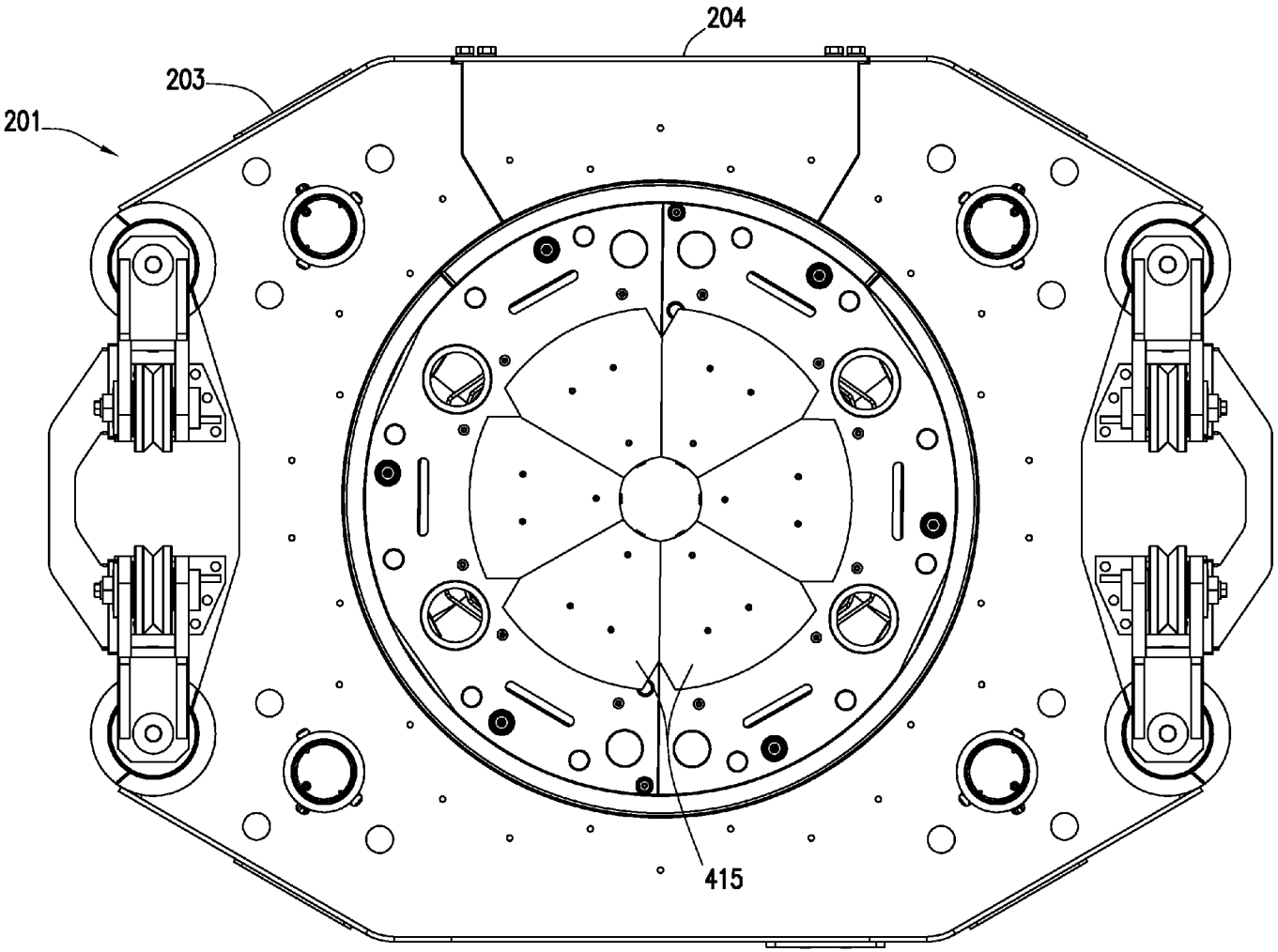
FIG. 27 depicts a bottom view of a makeup tong consistent with embodiments of the present disclosure.

In some embodiments, the volume of the interior of backup tong housing 403 may be selected such that it may meet or exceed the internal volume of the largest anticipated upper tubular segment 20. Thus, in such an embodiment, in a case where upper tubular segment 20 is completely full of fluid when broken out, backup tong housing 403 may be able to contain the entire volume of fluid flowing thereinto. In some embodiments, as shown in FIG. 27, makeup tong 201 may include one or more splash guards 415 to, for example and without limitation, prevent fluid or debris from entering makeup tong 201 from below. Splash guards 415 may, in some embodiments, be coupled to the underside of spinner assembly 231 or makeup tong housing 203.

Figure 28:
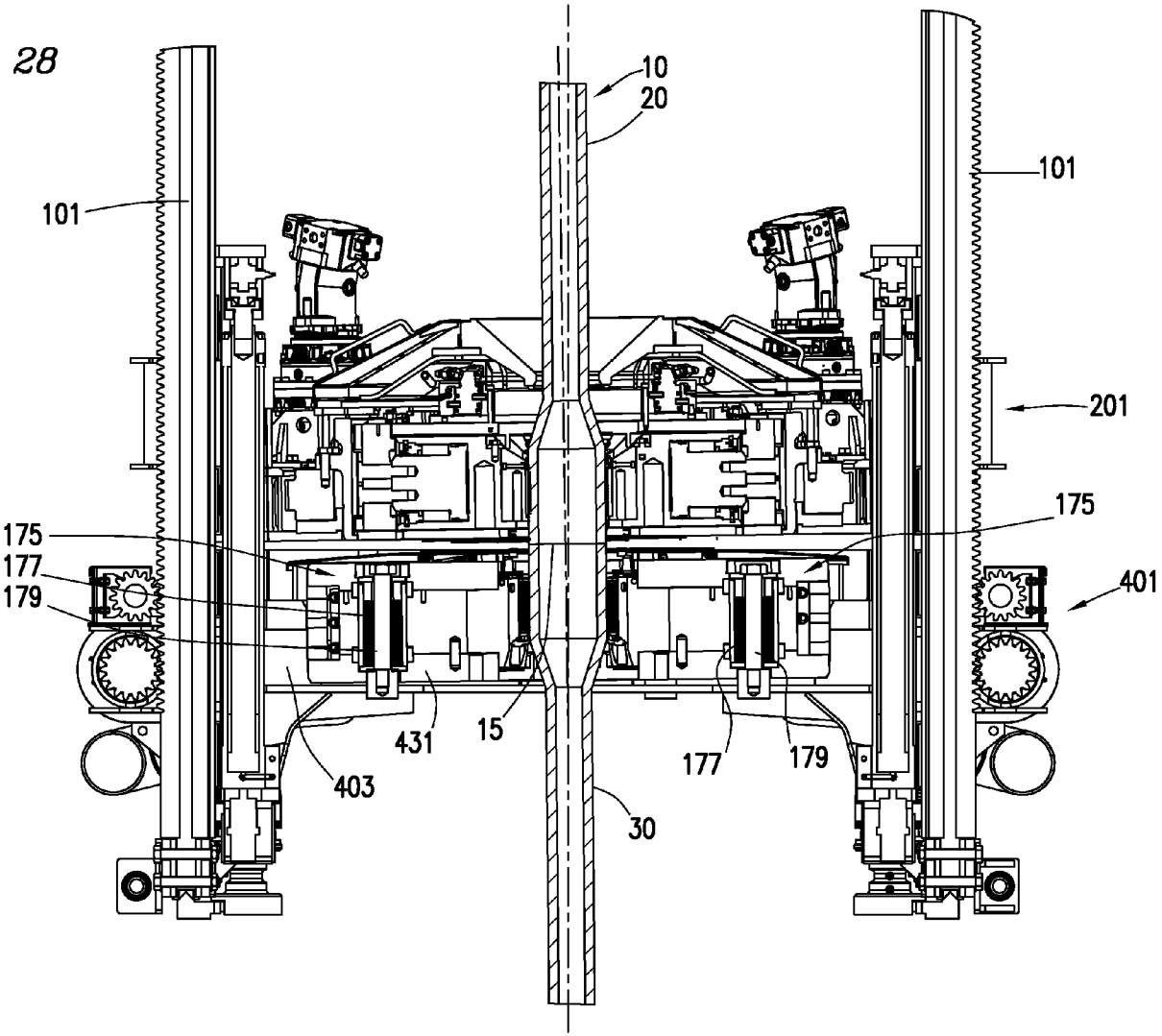
FIG. 28 depicts a cross section view of an automated roughneck consistent with embodiments of the present disclosure gripping an offset tool joint.

With reference to FIG. 28, during some make up or break out operations, drill string 10 may not extend perfectly vertically. In some cases, one or more of lower tubular segment 30, upper tubular segment 20, or tool joint 15 including the threads thereof may be bent or otherwise damaged. In order to make up or break out tool joint 15, make up tong 201 and break out tong 401 may need to be aligned concentrically with upper tubular segment 20 and lower tubular segment 30 respectively. As previously discussed, makeup tong 201 may be angularly or laterally displaced relative to frame 101 by the expansion or compression of springs 167 of suspension assemblies 165 (not shown in FIG. 28). In some embodiments, as spinner jaws 251 engage the outer surface of angularly or laterally displaced upper tubular segment 20, makeup tong 201 moves into angular and concentric alignment with the gripped upper tubular segment 20 as depicted in FIG. 28.

Likewise, as previously discussed, gripper assembly 431 of backup tong 401 may be angularly or laterally displaced relative to backup tong housing 403 by the expansion or compression of springs 177 of suspension assemblies 175. In some embodiments, as gripper jaws 451 engage the outer surface of angularly or laterally displaced lower tubular segment 30, gripper assembly 431 may move into angular and concentric alignment with the gripped lower tubular segment 30.

Once securely gripped by makeup tong 201 and backup tong 401, spinner assembly 231 may rotate to make up or break out tool joint 15. In some cases, damage to the threads of tool joint 15 or other damage may create a precession or "wobble" in upper tubular segment 20 as upper tubular segment 20 is rotated. By allowing continuous angular and/or lateral displacement of makeup tong 201, suspension assemblies 165 may allow makeup tong 201 to remain generally aligned with the axis of rotation of upper tubular segment 20 despite any lateral or angular displacement thereof.

As depicted in FIG. 3, automated roughneck 100 may, in some embodiments, remain in place about drill string 10 during all normal drilling operations. However, in some circumstances, it may be necessary to remove automated roughneck 100 from drill string 10. In order to remove automated roughneck 100 from drill string 10, automated roughneck 100 may be partially disassembled. The following description is not intended to be limiting in so far as an order of operations or to imply the necessity of inclusion of all elements described. Additionally, one having ordinary skill in the art with the benefit of this disclosure will understand that alternative methods for removing all or part of the components described herein may be utilized without deviating from the scope of this disclosure. Except where specifically noted, reference for the following steps is made to FIG. 29.

In some embodiments, any included funnel 205, upper support 207, and cover segment 209 as depicted in FIG. 6 may be removed from upper tong 201. Rotary seal 281 may be disconnected from spinner assembly 231. In some embodiments, rotary seal 281 may be continuous and non-segmented. In some such embodiments, rotary seal 281 may be removed by lifting rotary seal 281 above any tubulars passing through it by, for example and without limitation, a hoist, winch, or drawworks.

In some embodiments, spinner assembly 231 may be removed from drive assembly 215. Retention tabs 218, as depicted in FIGS. 7, 8, and 17 may be removed from retention slots 220, allowing spinner assembly 231 to be lifted out of drive assembly 215 by, for example and without limitation, a hoist, winch, or drawworks. In some embodiments, one or more wedge pins 239 corresponding to bridge wedges **235*b* may be removed, allowing spinner subunits 232 to be separated, and thus removed from drill string 10**.

In some embodiments, drive assembly 215 may be rotated such that drive ring segment 221 and ring gear segment 229 are generally in alignment with makeup tong housing door 204. Drive ring segment 221 and ring gear segment 229 may then be removed from makeup tong 201. In some embodiments, makeup tong housing door 204 may be removed from makeup tong housing 203.

Figure 29:
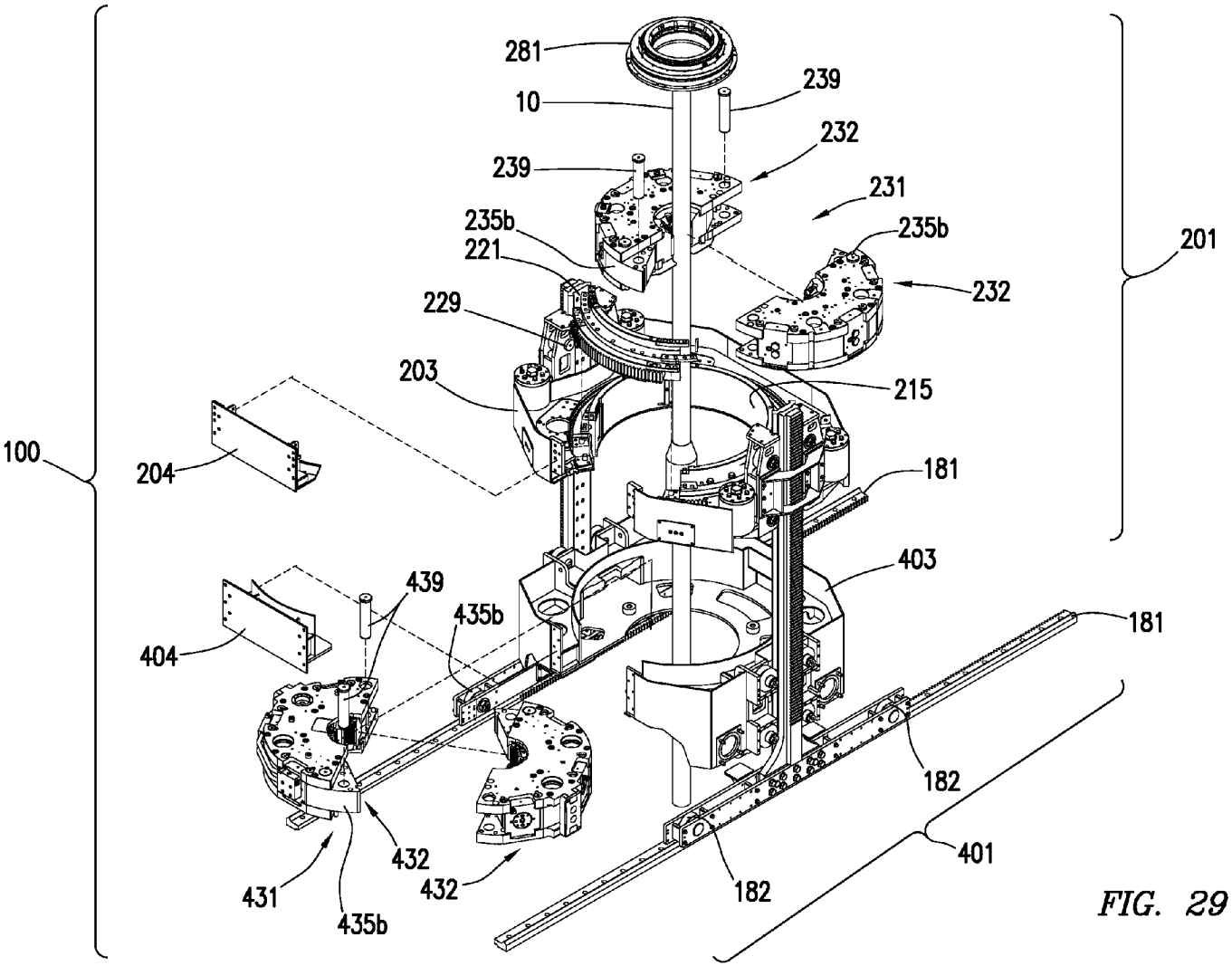
FIG. 29 depicts an exploded view of an automated roughneck consistent with embodiments of the present disclosure.
Figure 30:
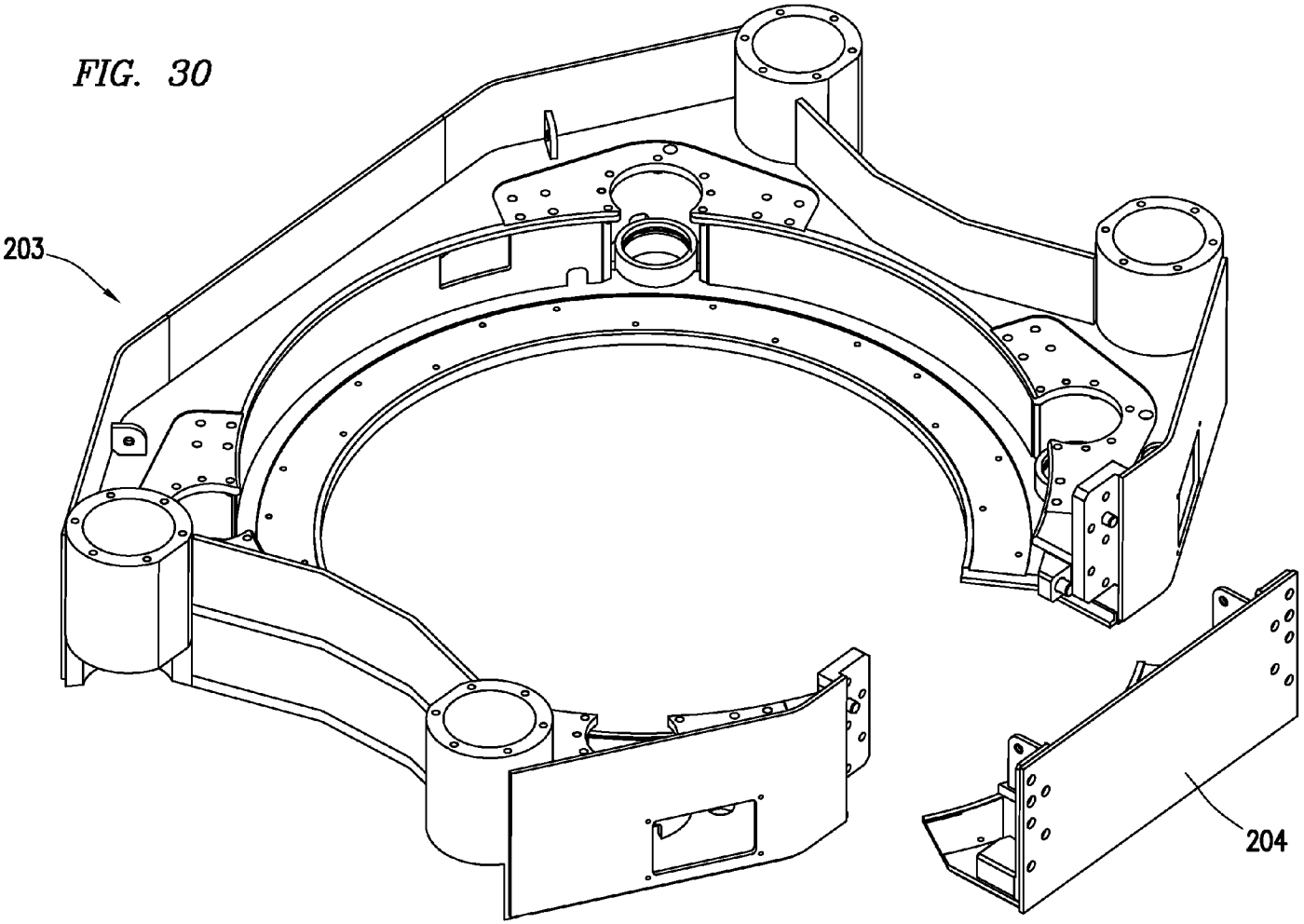
FIG. 30 depicts a disassembled view of the makeup tong housing of FIG. 29.
Figure 31:
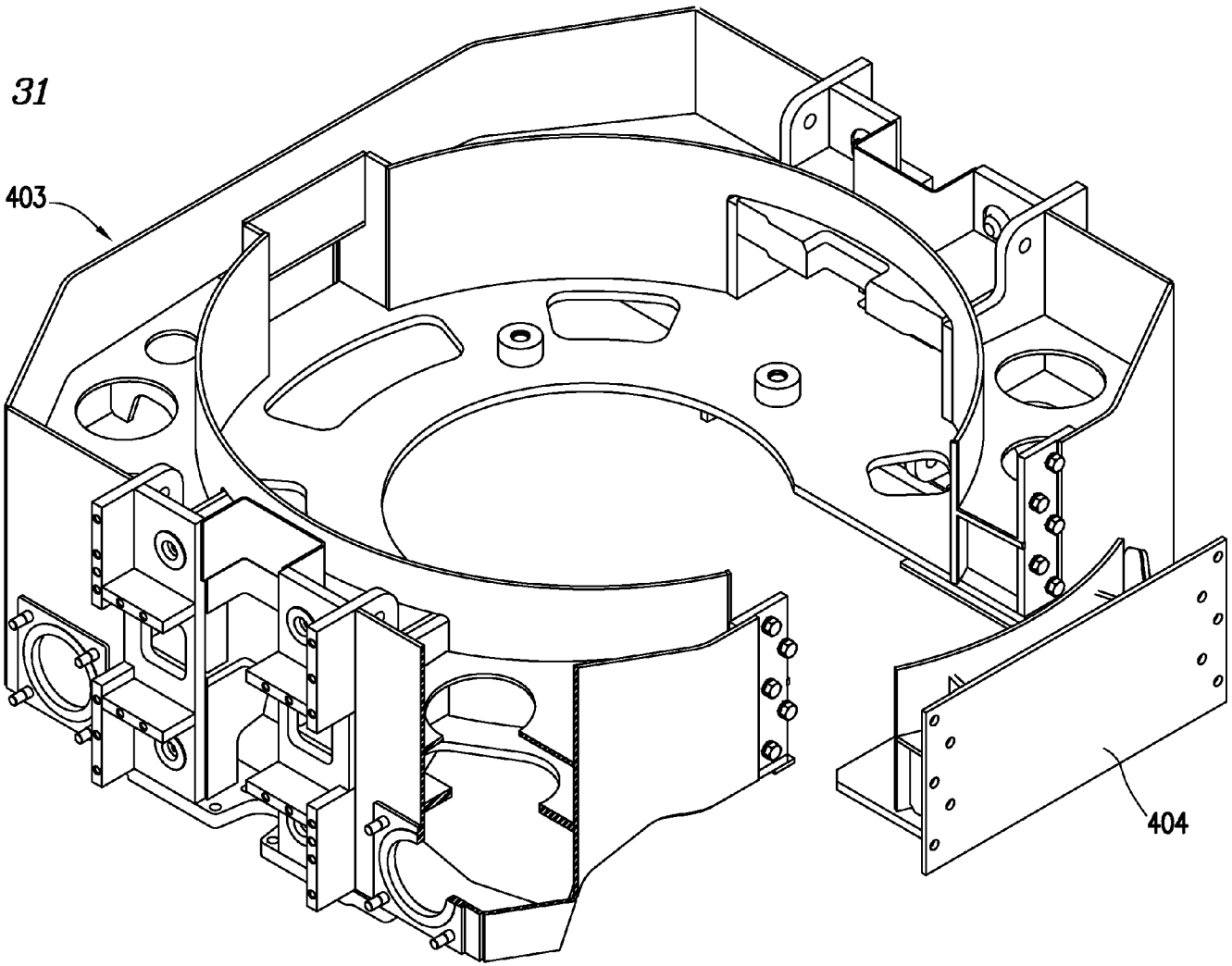
FIG. 31 depicts a disassembled view of the backup tong housing of FIG. 29.

In some embodiments, pipe seal 405 and backup tong cover 407 as depicted in FIG. 22 may be removed from backup tong 401. Gripper assembly 431 may be disconnected from backup tong housing 403. In some embodiments, gripper assembly 431 may be disconnected from backup tong housing 403 by disconnecting pin or bolt connection 179 of suspension assembly 175 as shown in FIG. 26. Gripper assembly 431 may then be lifted out of backup tong housing 403. In some embodiments, one or more wedge pins 439 corresponding to bridge wedges **435*b* may be removed, allowing gripper subunits 432 to be separated, and thus removed from drill string 10. In some embodiments, backup tong housing door 404 may be removed from backup tong housing 403. At this point, as depicted in FIG. 29, the remaining portions of automated roughneck 100 may be radially displaced away from drill string 10 without interference. In order to reassemble automated roughneck 100**, the operations above may be reversed.

In some embodiments, as depicted in FIGS. 1, 2, and 29, automated roughneck 100 may be mounted on one or more tracks 181. Frame 101 may include one or more rollers 182 positioned to follow along tracks 181. In some embodiments, frame 101 may include one or more drive motors 183 to move automated roughneck 100 along tracks 181. In some embodiments, drive motors 183 may be coupled to pinions positioned to mesh with racks 185, which may, in some embodiments, be coupled to tracks 181. In some embodiments, tracks 181 may be aligned with the vee-door of a drilling rig and may allow automated roughneck 100 to move to the mouse hole.

One having ordinary skill in the art with the benefit of this disclosure will understand that any apparatus for moving automated roughneck 100 radially apart from drill string 10 may be utilized without deviating from the scope of this disclosure. For example, automated roughneck 100 may, in some embodiments, be pedestal mounted as understood in the art. In other embodiments, automated roughneck 100 may be lifted or hoisted away from drill string 10.

In some embodiments, automated roughneck 100 may include a lifting apparatus (not shown) which may include one or more connection points for the attachment of other equipment. The equipment may be lifted by automated roughneck 100. For example, a bit-breaker (not shown) may be connected to a lifting apparatus on the bottom of backup tong housing 403 of backup tong 401. A bit-breaker, as understood in the art, is shaped so that a corresponding drill bit may be securely gripped without damage. Because many drill bits have complex outer geometries, backup tong 401 may not be capable of sufficiently gripping the drill bit without damaging it. Once the drill bit is positioned within the bit-breaker, makeup tong 201 may then rotate the tubular segment attached to the drill bit to remove the drill bit from the tubular segment. The bit-breaker may be manually attachable to attachment points on the lower side of backup tong housing 403. In some embodiments, the lifting apparatus may be used to lift an automated slips from the drill floor.

In some embodiments, automated roughneck 100 may include controls to allow the rapid release of spinner jaws 251 and/or gripper jaws 451 to, for example and without limitation, allow drill string 10 to be rapidly released to prevent damage to automated roughneck 100 and drill string 10.

In some embodiments, automated roughneck 100 may include a pipe cleaning apparatus, which serves to clean exposed threads of tool joint 15 while it is made up. In some embodiments, automated roughneck 100 may include a pipe doping apparatus, which may serve to apply pipe dope to the threads of tool joint 15 before the joint is made up. In some embodiments, automated roughneck 100 may include a pipe wiper positioned to remove fluids on the outside of drill string 10 as it is moved through automated roughneck 100.

One having ordinary skill in the art with the benefit of this disclosure will understand that all motors described herein, including lift motors 113, spinner motors 211, and drive motors 183 may be any type of motor capable of operating as described. In some embodiments, the motors may be hydraulic motors or electric motors. Likewise, the motors may be coupled to gearboxes. Additionally, the motors may be coupled to a brake to, for example and without limitation, prevent rotation of the motors to, for example, retain the position of the driven members. In some embodiments, each motor may include an encoder adapted to allow for the absolute position of each component driven by a motor to be known.

Although not explicitly described, one having ordinary skill in the art with the benefit of this disclosure will understand that seals may be included between fluidly sealed components without deviating from the scope of this disclosure. Additionally, although not explicitly described, one having ordinary skill in the art with the benefit of this disclosure will understand that surfaces between parts which move relative to one another may include one or more friction reducing features without deviating from the scope of this disclosure, including but not limited to bearings, bushings, lubrication supply systems, lubrication access points, or surface treatments. In some embodiments, lubrication supply systems may be included in one or more components to allow a lubricant such as grease to be injected into a space between two components which are in sliding contact.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. An automated roughneck for connecting and disconnecting threadedly coupled tubular members of a tubular string comprising:

a backup tong, the backup tong having a central opening adapted to receive the tubular string, the backup tong including:

a backup tong housing, the backup tong housing including a backup tong housing door removably coupled to the backup tong housing adapted to allow the backup tong to be radially installed or removed from the tubular string; and a gripper assembly, the gripper assembly coupled to the backup tong housing, the gripper assembly including a plurality of gripper jaws adapted to extend radially inwardly into the central opening and engage the outer surface of a first tubular member and prevent the rotation of the first tubular member, the gripper assembly adapted to be selectively separable into at least two gripper subunits;

a makeup tong, the makeup tong positioned generally parallel with the backup tong, the makeup tong having a central opening generally collinear with the central opening of the backup tong, the makeup tong coupled to and movable relative to the backup tong, the makeup tong including:

a makeup tong housing, the makeup tong housing including a makeup tong housing door removably coupled to the makeup tong housing adapted to allow the makeup tong to be radially installed or removed from the tubular string;

a spinner assembly, the spinner assembly coupled to the makeup tong housing, the spinner assembly including a plurality of spinner jaws adapted to extend radially inwardly into the central opening and engage an outer surface of a second tubular member, the spinner assembly adapted to be rotatable relative to the makeup tong housing to rotate the second tubular member, the spinner assembly adapted to be selectively separable into at least two spinner subunits; and a drive assembly, the drive assembly being generally annular in shape and adapted to house the spinner assembly in a generally cylindrical interior thereof, the drive assembly adapted to be rotated by one or more spinner motors coupled to the makeup tong housing, the drive assembly coupled to the spinner assembly and adapted to rotate the spinner assembly relative to the makeup tong housing, the drive assembly including a removable segment rotatably positionable in alignment with the makeup tong housing door of the makeup tong housing to allow the drive assembly to be radially removable from the tubular string;

wherein the spinner assembly subunits comprise a spinner bottom plate, one or more spinner wedges, a spinner top plate, and one or more spinner jaws, the spinner wedges and spinner jaws arranged alternatingly and generally radially between the spinner bottom plate and the spinner top plate.

2. The automated roughneck of claim 1, further comprising a frame, the backup tong and makeup tong coupled to the frame, and the backup tong and the makeup tong movable relative to the frame.

3. The automated roughneck of claim 2, wherein the frame further comprises one or more rails adapted to be engaged by one or more casters positioned on one or more of the backup tong or the makeup tong.

4. The automated roughneck of claim 2, wherein the backup tong is coupled to the frame by a linear actuator adapted to raise or lower the backup tong relative to the frame.

5. The automated roughneck of claim 4, wherein the frame further comprises a generally vertical rack, and the backup tong further comprises a motor adapted to rotate a pinion to raise or lower the backup tong relative to the frame.

6. The automated roughneck of claim 2, wherein the makeup tong is coupled to the frame by a linear actuator adapted to raise or lower the makeup tong relative to the frame.

7. The automated roughneck of claim 2, wherein the frame further comprises one or more rollers adapted to allow the automatic roughneck to be moved horizontally along one or more tracks.

8. The automated roughneck of claim 7, wherein the frame further comprises one or more motors adapted to move the automated roughneck along the tracks.

9. The automated roughneck of claim 1, wherein the spinner wedges are secured to the spinner bottom plate and the spinner top plate by one or more spinner wedge pins.

10. The automated roughneck of claim 9, wherein at least one spinner wedge comprises a spinner bridge wedge adapted to extend past an end of the spinner bottom plate and the spinner top plate such that, when the spinner assembly is assembled, the spinner bridge wedge is positioned between and pinned to the spinner top plates and spinner bottom plates of adjacent spinner subunits.

11. The automated roughneck of claim 1, wherein the spinner jaw is adapted to be removable from the spinner assembly by sliding the spinner jaw radially outwardly from the spinner assembly.

12. The automated roughneck of claim 11, wherein the spinner jaw is adapted to be housed by and transfer torsional force to one or more guide channels formed in one or more of the spinner top plate or the spinner bottom plate.

13. The automated roughneck of claim 1, wherein the spinner jaws are actuated hydraulically.

14. The automated roughneck of claim 13, wherein each spinner jaw comprises:

a spinner jaw piston, the spinner piston adapted to be coupled to the spinner assembly, the spinner jaw piston including a head and a neck;

a spinner jaw cylinder, the spinner jaw cylinder slidingly coupled to the spinner jaw piston and adapted to substantially surround and form a fluid seal with the spinner jaw piston, a cavity defined by the spinner jaw piston head and the spinner jaw cylinder defining an extension chamber, and a sealing body adapted to fluidly seal between the spinner jaw cylinder and the spinner jaw piston neck, the sealing body coupled to the spinner jaw cylinder and adapted to slide along spinner jaw piston neck, the cavity defined by the spinner jaw piston head and the sealing body defining a retraction chamber;

such that when the force created by fluid pressure in the extension chamber exceeds the force created by fluid pressure in the retraction chamber, the spinner jaw cylinder generally extends, and when the force created by fluid pressure in the retraction chamber exceeds the force created by fluid pressure in the extension chamber, the spinner jaw cylinder generally retracts.

15. The automated roughneck of claim 14, wherein the extension chamber and retraction chambers are coupled to an extension port and a retraction port respectively, the extension port and retraction port formed through the body of the spinner jaw piston.

16. The automated roughneck of claim 15, wherein the extension port and retraction port are supplied hydraulic pressure through a rotary seal, the rotary seal adapted to allow continuous hydraulic connection between the spinner assembly and a non-rotating hydraulic manifold.

17. The automated roughneck of claim 16, wherein the rotary seal comprises an inner rotating body, an outer rotating body, a static body, and a rotary seal base plate, the inner rotating body, outer rotating body, and rotary seal base plate coupled to the spinner assembly and the static body coupled to the makeup tong housing, the inner rotating body and outer rotating body each forming a generally annular port between itself and the static body defining inner and outer ports respectively, the static body including at least one first port adapted to couple the non-rotating hydraulic manifold to the inner port and at least one second port adapted to couple the non-rotating hydraulic manifold to the outer port, the inner rotating body and rotary seal base plate adapted to include at least one port adapted to couple the inner port with one of the extension port or the retraction port of the spinner jaw, the outer rotating body and rotary seal base plate adapted to include at least one port adapted to couple the outer port with the other of the extension port or the retraction port of the spinner jaw.

18. The automated roughneck of claim 17, wherein the ports formed in the rotary seal base plate are coupled to one or more ports formed in one or more upper spinner plates of the spinner assembly.

19. The automated roughneck of claim 1, wherein the backup tong housing is generally hollow and is generally opened at the top, the backup tong housing adapted to receive and contain any fluid exiting the tool joint during a breakout operation.

20. The automated roughneck of claim 19, wherein the backup tong housing further comprises at least one drain port adapted to allow any fluid within the backup tong housing to egress.

21. The automated roughneck of claim 20, further comprising a manifold coupled to the drain port allowing the egressing fluid to be transferred away from the automated roughneck.

22. The automated roughneck of claim 19, wherein the backup tong further comprises a cover, the cover adapted to prevent fluid from entering the gripper assembly, the cover being generally sloped downward radially outwardly to allow fluid drainage from the cover to the backup tong housing.

23. The automated roughneck of claim 22, wherein the cover further comprises a pipe seal adapted to seal against the second tubular member to prevent fluid from flowing between the cover and the first tubular member.

24. An automated roughneck for connecting and disconnecting threadedly coupled tubular members of a tubular string comprising:

a backup tong, the backup tong having a central opening adapted to receive the tubular string, the backup tong including:

a backup tong housing, the backup tong housing including a backup tong housing door removably coupled to the backup tong housing adapted to allow the backup tong to be radially installed or removed from the tubular string; and a gripper assembly, the gripper assembly coupled to the backup tong housing, the gripper assembly including a plurality of gripper jaws adapted to extend radially inwardly into the central opening and engage the outer surface of a first tubular member and prevent the rotation of the first tubular member, the gripper assembly adapted to be selectively separable into at least two gripper subunits;

a makeup tong, the makeup tong positioned generally parallel with the backup tong, the makeup tong having a central opening generally collinear with the central opening of the backup tong, the makeup tong coupled to and movable relative to the backup tong, the makeup tong including:

a makeup tong housing, the makeup tong housing including a makeup tong housing door removably coupled to the makeup tong housing adapted to allow the makeup tong to be radially installed or removed from the tubular string;

a spinner assembly, the spinner assembly coupled to the makeup tong housing, the spinner assembly including a plurality of spinner jaws adapted to extend radially inwardly into the central opening and engage an outer surface of a second tubular member, the spinner assembly adapted to be rotatable relative to the makeup tong housing to rotate the second tubular member, the spinner assembly adapted to be selectively separable into at least two spinner subunits; and a drive assembly, the drive assembly being generally annular in shape and adapted to house the spinner assembly in a generally cylindrical interior thereof, the drive assembly adapted to be rotated by one or more spinner motors coupled to the makeup tong housing, the drive assembly coupled to the spinner assembly and adapted to rotate the spinner assembly relative to the makeup tong housing, the drive assembly including a removable segment rotatably positionable in alignment with the makeup tong housing door of the makeup tong housing to allow the drive assembly to be radially removable from the tubular string;

wherein the makeup tong is coupled to the backup tong by a linear actuator adapted to raise or lower the makeup tong relative to the backup tong and wherein the makeup tong is coupled to the backup tong by a hydraulic cylinder, the hydraulic cylinder adapted to raise or lower the makeup tong relative to the backup tong and, wherein the hydraulic cylinder is coupled to one or more sensors adapted to detect one or more of relative position of the makeup tong and the backup tong, force transfer between the hydraulic cylinder and the makeup tong, or the pressure in the hydraulic cylinder.

25. The automated roughneck of claim 24, wherein the hydraulic cylinder is coupled to a control system adapted to vary the position of the makeup tong relative to the backup tong based on the readings of the one or more sensors.

26. The automated roughneck of claim 25, wherein the hydraulic cylinder is coupled directly to the makeup tong housing.

27. An automated roughneck for connecting and disconnecting threadedly coupled tubular members of a tubular string comprising:

a backup tong, the backup tong having a central opening adapted to receive the tubular string, the backup tong including:

a backup tong housing, the backup tong housing including a backup tong housing door removably coupled to the backup tong housing adapted to allow the backup tong to be radially installed or removed from the tubular string; and a gripper assembly, the gripper assembly coupled to the backup tong housing, the gripper assembly including a plurality of gripper jaws adapted to extend radially inwardly into the central opening and engage the outer surface of a first tubular member and prevent the rotation of the first tubular member, the gripper assembly adapted to be selectively separable into at least two gripper subunits;

a makeup tong, the makeup tong positioned generally parallel with the backup tong, the makeup tong having a central opening generally collinear with the central opening of the backup tong, the makeup tong coupled to and movable relative to the backup tong, the makeup tong including:

a makeup tong housing, the makeup tong housing including a makeup tong housing door removably coupled to the makeup tong housing adapted to allow the makeup tong to be radially installed or removed from the tubular string;

a spinner assembly, the spinner assembly coupled to the makeup tong housing, the spinner assembly including a plurality of spinner jaws adapted to extend radially inwardly into the central opening and engage an outer surface of a second tubular member, the spinner assembly adapted to be rotatable relative to the makeup tong housing to rotate the second tubular member, the spinner assembly adapted to be selectively separable into at least two spinner subunits; and a drive assembly, the drive assembly being generally annular in shape and adapted to house the spinner assembly in a generally cylindrical interior thereof, the drive assembly adapted to be rotated by one or more spinner motors coupled to the makeup tong housing, the drive assembly coupled to the spinner assembly and adapted to rotate the spinner assembly relative to the makeup tong housing, the drive assembly including a removable segment rotatably positionable in alignment with the makeup tong housing door of the makeup tong housing to allow the drive assembly to be radially removable from the tubular string;

wherein the makeup tong is coupled to the backup tong by a linear actuator adapted to raise or lower the makeup tong relative to the backup tong and wherein the makeup tong is coupled to the backup tong by a hydraulic cylinder, the hydraulic cylinder adapted to raise or lower the makeup tong relative to the backup tong and wherein the hydraulic cylinder is coupled to the makeup tong housing through one or more makeup tong suspension assemblies adapted to allow relative vertical, horizontal, and angular movement between the makeup tong housing and backup tong housing.

28. The automated roughneck of claim 27, wherein the makeup tong suspension assembly comprises one or more springs coupled between a trolley and the makeup tong housing.

29. The automated roughneck of claim 27, wherein the gripper assembly is coupled directly to the backup tong housing.

30. An automated roughneck for connecting and disconnecting threadedly coupled tubular members of a tubular string comprising:

a backup tong, the backup tong having a central opening adapted to receive the tubular string, the backup tong including:

a backup tong housing, the backup tong housing including a backup tong housing door removably coupled to the backup tong housing adapted to allow the backup tong to be radially installed or removed from the tubular string; and a gripper assembly, the gripper assembly coupled to the backup tong housing, the gripper assembly including a plurality of gripper jaws adapted to extend radially inwardly into the central opening and engage the outer surface of a first tubular member and prevent the rotation of the first tubular member, the gripper assembly adapted to be selectively separable into at least two gripper subunits;

a makeup tong, the makeup tong positioned generally parallel with the backup tong, the makeup tong having a central opening generally collinear with the central opening of the backup tong, the makeup tong coupled to and movable relative to the backup tong, the makeup tong including:

a makeup tong housing, the makeup tong housing including a makeup tong housing door removably coupled to the makeup tong housing adapted to allow the makeup tong to be radially installed or removed from the tubular string;

a spinner assembly, the spinner assembly coupled to the makeup tong housing, the spinner assembly including a plurality of spinner jaws adapted to extend radially inwardly into the central opening and engage an outer surface of a second tubular member, the spinner assembly adapted to be rotatable relative to the makeup tong housing to rotate the second tubular member, the spinner assembly adapted to be selectively separable into at least two spinner subunits; and a drive assembly, the drive assembly being generally annular in shape and adapted to house the spinner assembly in a generally cylindrical interior thereof, the drive assembly adapted to be rotated by one or more spinner motors coupled to the makeup tong housing, the drive assembly coupled to the spinner assembly and adapted to rotate the spinner assembly relative to the makeup tong housing, the drive assembly including a removable segment rotatably positionable in alignment with the makeup tong housing door of the makeup tong housing to allow the drive assembly to be radially removable from the tubular string;

wherein the gripper assembly is coupled to the backup tong housing through one or more backup tong suspension assemblies adapted to allow relative vertical, horizontal, and angular movement between the gripper assembly and the backup tong housing.

31. The automated roughneck of claim 30, wherein the backup tong suspension assembly comprises one or more springs coupled between the backup tong housing and the gripper assembly.

32. The automated roughneck of claim 30, wherein the makeup tong further comprises a funnel, the funnel including a generally inward taper, the funnel adapted to allow a tubular segment to be aligned with the central opening of the makeup tong as it is inserted from above the makeup tong.

33. The automated roughneck of claim 30, wherein the makeup tong further comprises a cover.

34. An automated roughneck for connecting and disconnecting threadedly coupled tubular members of a tubular string comprising:

a backup tong, the backup tong having a central opening adapted to receive the tubular string, the backup tong including:

a backup tong housing, the backup tong housing including a backup tong housing door removably coupled to the backup tong housing adapted to allow the backup tong to be radially installed or removed from the tubular string; and a gripper assembly, the gripper assembly coupled to the backup tong housing, the gripper assembly including a plurality of gripper jaws adapted to extend radially inwardly into the central opening and engage the outer surface of a first tubular member and prevent the rotation of the first tubular member, the gripper assembly adapted to be selectively separable into at least two gripper subunits;

a makeup tong, the makeup tong positioned generally parallel with the backup tong, the makeup tong having a central opening generally collinear with the central opening of the backup tong, the makeup tong coupled to and movable relative to the backup tong, the makeup tong including:

a makeup tong housing, the makeup tong housing including a makeup tong housing door removably coupled to the makeup tong housing adapted to allow the makeup tong to be radially installed or removed from the tubular string;

a spinner assembly, the spinner assembly coupled to the makeup tong housing, the spinner assembly including a plurality of spinner jaws adapted to extend radially inwardly into the central opening and engage an outer surface of a second tubular member, the spinner assembly adapted to be rotatable relative to the makeup tong housing to rotate the second tubular member, the spinner assembly adapted to be selectively separable into at least two spinner subunits; and a drive assembly, the drive assembly being generally annular in shape and adapted to house the spinner assembly in a generally cylindrical interior thereof, the drive assembly adapted to be rotated by one or more spinner motors coupled to the makeup tong housing, the drive assembly coupled to the spinner assembly and adapted to rotate the spinner assembly relative to the makeup tong housing, the drive assembly including a removable segment rotatably positionable in alignment with the makeup tong housing door of the makeup tong housing to allow the drive assembly to be radially removable from the tubular string;

wherein the gripper assembly subunits comprise a gripper bottom plate, one or more gripper wedges, a gripper top plate, and one or more gripper jaws, the gripper wedges and gripper jaws arranged alternatingly and generally radially between the gripper bottom plate and the gripper top plate.

35. The automated roughneck of claim 34, wherein the gripper wedges are secured to the gripper bottom plate and the gripper top plate by one or more gripper wedge pins.

36. The automated roughneck of claim 35, wherein at least one gripper wedge comprises a gripper bridge wedge adapted to extend past an end of the gripper bottom plate and the gripper top plate such that, when the gripper assembly is assembled, the gripper bridge wedge is positioned between and pinned to the gripper top plates and gripper bottom plates of adjacent gripper subunits.

37. The automated roughneck of claim 34, wherein the gripper jaw is adapted to be removable from the gripper assembly by sliding the gripper jaw radially outwardly from the gripper assembly.

38. The automated roughneck of claim 37, wherein the gripper jaw is adapted to be housed by and transfer torsional force to one or more guide channels formed in one or more of the gripper top plate or the gripper bottom plate.

39. An automated roughneck for connecting and disconnecting threadedly coupled tubular members of a tubular string comprising:

a backup tong, the backup tong having a central opening adapted to receive the tubular string, the backup tong including:

a backup tong housing, the backup tong housing including a backup tong housing door removably coupled to the backup tong housing adapted to allow the backup tong to be radially installed or removed from the tubular string; and a gripper assembly, the gripper assembly coupled to the backup tong housing, the gripper assembly including a plurality of gripper jaws adapted to extend radially inwardly into the central opening and engage the outer surface of a first tubular member and prevent the rotation of the first tubular member, the gripper assembly adapted to be selectively separable into at least two gripper subunits;

a makeup tong, the makeup tong positioned generally parallel with the backup tong, the makeup tong having a central opening generally collinear with the central opening of the backup tong, the makeup tong coupled to and movable relative to the backup tong, the makeup tong including:

a makeup tong housing, the makeup tong housing including a makeup tong housing door removably coupled to the makeup tong housing adapted to allow the makeup tong to be radially installed or removed from the tubular string;

a spinner assembly, the spinner assembly coupled to the makeup tong housing, the spinner assembly including a plurality of spinner jaws adapted to extend radially inwardly into the central opening and engage an outer surface of a second tubular member, the spinner assembly adapted to be rotatable relative to the makeup tong housing to rotate the second tubular member, the spinner assembly adapted to be selectively separable into at least two spinner subunits; and a drive assembly, the drive assembly being generally annular in shape and adapted to house the spinner assembly in a generally cylindrical interior thereof, the drive assembly adapted to be rotated by one or more spinner motors coupled to the makeup tong housing, the drive assembly coupled to the spinner assembly and adapted to rotate the spinner assembly relative to the makeup tong housing, the drive assembly including a removable segment rotatably positionable in alignment with the makeup tong housing door of the makeup tong housing to allow the drive assembly to be radially removable from the tubular string, wherein the gripper jaws are actuated hydraulically; and wherein each gripper jaw comprises:

a gripper jaw piston, the gripper jaw piston adapted to be coupled to the gripper jaw assembly, the gripper jaw piston including a head and a neck;

a gripper jaw cylinder, the gripper jaw cylinder slidingly coupled to the gripper jaw piston and adapted to substantially surround and form a fluid seal with the gripper jaw piston, the cavity defined by the gripper jaw piston head and the gripper jaw cylinder defining an extension chamber, and a sealing body adapted to fluidly seal between the gripper jaw cylinder and the gripper jaw piston neck, the sealing body coupled to the gripper jaw cylinder and adapted to slide along gripper jaw piston neck, the cavity defined by the gripper jaw piston head and the sealing body defining a retraction chamber;

such that when the force created by fluid pressure in the extension chamber exceeds the force created by fluid pressure in the retraction chamber, the gripper jaw cylinder generally extends, and when the force created by fluid pressure in the retraction chamber exceeds the force created by fluid pressure in the extension chamber, the gripper jaw cylinder generally retracts.

40. The automated roughneck of claim 39, wherein the extension chamber and retraction chambers are coupled to an extension port and a retraction port respectively, the extension port and retraction port formed through the body of the gripper jaw piston.

41. The automated roughneck of claim 40, wherein the extension port and retraction port are supplied hydraulic pressure from a hydraulic supply system.

42. An automated roughneck for connecting and disconnecting threadedly coupled tubular members of a tubular string comprising:

a backup tong, the backup tong having a central opening adapted to receive the tubular string, the backup tong including:

a backup tong housing, the backup tong housing including a backup tong housing door removably coupled to the backup tong housing adapted to allow the backup tong to be radially installed or removed from the tubular string; and a gripper assembly, the gripper assembly coupled to the backup tong housing, the gripper assembly including a plurality of gripper jaws adapted to extend radially inwardly into the central opening and engage the outer surface of a first tubular member and prevent the rotation of the first tubular member, the gripper assembly adapted to be selectively separable into at least two gripper subunits;

a makeup tong, the makeup tong positioned generally parallel with the backup tong, the makeup tong having a central opening generally collinear with the central opening of the backup tong, the makeup tong coupled to and movable relative to the backup tong, the makeup tong including:

a makeup tong housing, the makeup tong housing including a makeup tong housing door removably coupled to the makeup tong housing adapted to allow the makeup tong to be radially installed or removed from the tubular string;

a spinner assembly, the spinner assembly coupled to the makeup tong housing, the spinner assembly including a plurality of spinner jaws adapted to extend radially inwardly into the central opening and engage an outer surface of a second tubular member, the spinner assembly adapted to be rotatable relative to the makeup tong housing to rotate the second tubular member, the spinner assembly adapted to be selectively separable into at least two spinner subunits; and a drive assembly, the drive assembly being generally annular in shape and adapted to house the spinner assembly in a generally cylindrical interior thereof, the drive assembly adapted to be rotated by one or more spinner motors coupled to the makeup tong housing, the drive assembly coupled to the spinner assembly and adapted to rotate the spinner assembly relative to the makeup tong housing, the drive assembly including a removable segment rotatably positionable in alignment with the makeup tong housing door of the makeup tong housing to allow the drive assembly to be radially removable from the tubular string;

wherein the spinner assembly is coupled to the drive assembly by one or more keys, the keys adapted to fit into keyways formed in the spinner assembly and the drive assembly and transfer torsional loading between the spinner assembly and the drive assembly.

43. The automated roughneck of claim 42, wherein the spinner assembly is coupled to the drive assembly by one or more retention tabs, the retention tabs removably coupled to the upper surface of the spinner assembly and adapted to fit into one or more retention slots formed in the inner wall of the drive assembly, the retention tabs adapted to prevent undesired upward movement of the spinner assembly relative to the drive assembly.

44. The automated roughneck of claim 42, wherein the drive assembly comprises a ring gear, the ring gear adapted to be rotated by one or more spinner motors, the spinner motors operatively coupled to pinions adapted to mesh with the ring gear, the spinner motors coupled to the makeup tong housing.

45. An automated roughneck for connecting and disconnecting threadedly coupled tubular members of a tubular string comprising:

a backup tong, the backup tong having a central opening adapted to receive the tubular string, the backup tong including:

a backup tong housing, the backup tong housing including a backup tong housing door removably coupled to the backup tong housing adapted to allow the backup tong to be radially installed or removed from the tubular string; and a gripper assembly, the gripper assembly coupled to the backup tong housing, the gripper assembly including a plurality of gripper jaws adapted to extend radially inwardly into the central opening and engage the outer surface of a first tubular member and prevent the rotation of the first tubular member, the gripper assembly adapted to be selectively separable into at least two gripper subunits;

a makeup tong, the makeup tong positioned generally parallel with the backup tong, the makeup tong having a central opening generally collinear with the central opening of the backup tong, the makeup tong coupled to and movable relative to the backup tong, the makeup tong including:

a makeup tong housing, the makeup tong housing including a makeup tong housing door removably coupled to the makeup tong housing adapted to allow the makeup tong to be radially installed or removed from the tubular string;

a spinner assembly, the spinner assembly coupled to the makeup tong housing, the spinner assembly including a plurality of spinner jaws adapted to extend radially inwardly into the central opening and engage an outer surface of a second tubular member, the spinner assembly adapted to be rotatable relative to the makeup tong housing to rotate the second tubular member, the spinner assembly adapted to be selectively separable into at least two spinner subunits; and a drive assembly, the drive assembly being generally annular in shape and adapted to house the spinner assembly in a generally cylindrical interior thereof, the drive assembly adapted to be rotated by one or more spinner motors coupled to the makeup tong housing, the drive assembly coupled to the spinner assembly and adapted to rotate the spinner assembly relative to the makeup tong housing, the drive assembly including a removable segment rotatably positionable in alignment with the makeup tong housing door of the makeup tong housing to allow the drive assembly to be radially removable from the tubular string;

wherein the gripper assembly further comprises one or more anti-rotation tabs adapted to be received by corresponding anti-rotation slots formed in the backup tong housing such that torsional loading on the gripper assembly is transferred to the backup tong housing.

46. The automated roughneck of claim 45, further comprising one or more bushings adapted to fit between an anti-rotation tab and a corresponding anti-rotation slot, the bushing adapted to reduce friction and wear on the anti-rotation tabs and anti-rotation tabs caused by relative motion between the gripper assembly and the backup tong housing.

47. The automated roughneck of claim 45, wherein the makeup tong further comprises a splash guard, the splash guard positioned on the lower side of the makeup tong, the splash guard adapted to reduce or prevent fluid ingress into the spinner assembly of the makeup tong.

48. The automated roughneck of claim 45, wherein each spinner jaw further comprises a spinner die, the spinner die adapted to grip against the outer surface of the second tubular member.

49. The automated roughneck of claim 48, wherein each spinner die is coupled to the spinner jaw by a spinner die carrier.

50. The automated roughneck of claim 45, wherein each gripper jaw further comprises a gripper die, the gripper die adapted to grip against the outer surface of the first tubular member.

51. The automated roughneck of claim 50, wherein each gripper die is coupled to the gripper jaw by a gripper die carrier.

52. The automated roughneck of claim 45, further comprising a pipe cleaning apparatus.

53. The automated roughneck of claim 45, further comprising a pipe lubrication apparatus.

54. The automated roughneck of claim 45, further comprising a lifting apparatus coupled to the backup tong, the lifting apparatus adapted to lift a piece of equipment.

55. A method for removing an automated roughneck from a drill string while the drill string remains in place comprising:

providing an automated roughneck, the automated roughneck including:

a backup tong, the backup tong including a central opening adapted to receive the tubular string, the backup tong including:

a backup tong housing, the backup tong housing including a backup tong housing door removably coupled to the backup tong housing adapted to allow the backup tong to be radially installed or removed from the tubular string; and a gripper assembly, the gripper assembly coupled to the backup tong housing, the gripper assembly including a plurality of gripper jaws adapted to extend radially inwardly into the central opening and engage the outer surface of a first tubular member and prevent the rotation of the first tubular member, the gripper assembly adapted to be selectively separable into at least two gripper subunits; and a makeup tong, the makeup tong positioned generally parallel with the backup tong, the makeup tong having a central opening generally collinear with the central opening of the backup tong, the makeup tong coupled to and movable relative to the backup tong, the makeup tong including:

a makeup tong housing, the makeup tong housing including a makeup tong housing door removably coupled to the makeup tong housing;

a spinner assembly, the spinner assembly coupled to the makeup tong housing, the spinner assembly including a plurality of spinner jaws adapted to extend radially inwardly into the central opening and engage an outer surface of a second tubular member, the spinner assembly adapted to be rotatable relative to the makeup tong housing to rotate the second tubular member, the spinner assembly adapted to be selectively separable into at least two spinner subunits; and a drive assembly, the drive assembly being generally annular in shape and adapted to house the spinner assembly in a generally cylindrical interior thereof, the drive assembly adapted to be rotated by one or more spinner motors coupled to the makeup tong housing, the drive assembly coupled to the spinner assembly and adapted to rotate the spinner assembly relative to the makeup tong housing, the drive assembly including a removable segment rotatably positionable in alignment with the makeup tong housing door of the makeup tong housing;

positioning the drill string through the automated roughneck;

removing the spinner assembly from the makeup tong;

separating the spinner assembly into two or more spinner subunits;

aligning the removable segment of the drive assembly with the makeup tong housing door;

removing the removable segment of the drive assembly;

removing the makeup tong housing door;

removing the gripper assembly from the backup tong;

separating the gripper assembly into two or more gripper subunits;

removing the backup tong removable door; and displacing the automated roughneck laterally such that the drill string passes through the radial opening formed in the drive assembly, makeup tong housing, and backup tong housing.

56. The method of claim 55, wherein the gripper subunits are connected by one or more pins, and the gripper subunits are separated by removing the one or more pins.

57. The method of claim 55, wherein the spinner subunits are connected by one or more pins, and the spinner subunits are separated by removing the one or more pins.

58. The method of claim 55, wherein the makeup tong further comprises a rotary seal adapted to allow hydraulic pressure to be supplied to the spinner jaws as the spinner assembly is rotated, and the method further comprises:

disconnecting a rotary seal from the spinner assembly; and lifting the rotary seal above the drill pipe.

* * * * *